US008443641B2

(12) United States Patent
Zak et al.

(10) Patent No.: US 8,443,641 B2
(45) Date of Patent: May 21, 2013

(54) EXPLOSION FORMING SYSTEM

(75) Inventors: Alexander Zak, Moedling (AT); Seetarama S. Kotagiri, Rochester Hills, MI (US); Frank A. Horton, Rochester Hills, MI (US)

(73) Assignee: Cosma Engineering Europe AG, Oberwaltersdorf (AT)

( * ) Notice: Subject to any disclaimer, the term of this patent is extended or adjusted under 35 U.S.C. 154(b) by 924 days.

(21) Appl. No.: 12/432,954

(22) Filed: Apr. 30, 2009

(65) Prior Publication Data

US 2009/0205396 A1 Aug. 20, 2009

Related U.S. Application Data

(63) Continuation-in-part of application No. 12/447,727, filed as application No. PCT/EP2007/010966 on Dec. 13, 2007.

(60) Provisional application No. 61/049,021, filed on Apr. 30, 2008.

(51) Int. Cl.
*B21D 26/02* (2011.01)

(52) U.S. Cl.
USPC ..... 72/56; 72/706

(58) Field of Classification Search
USPC ..... 72/56, 61, 706; 29/421.2
See application file for complete search history.

(56) References Cited

U.S. PATENT DOCUMENTS

| | | | | |
|---|---|---|---|---|
| 392,635 | A | | 11/1888 | Powers |
| 1,280,451 | A | | 10/1918 | Hagen |
| 3,640,110 | A | | 2/1972 | Inoue |
| 4,024,744 | A | * | 5/1977 | Trakhtenberg et al. ..... 72/56 |
| 4,471,640 | A | | 9/1984 | Kortenski et al. |
| 4,492,104 | A | | 1/1985 | Weaver et al. |
| 4,494,392 | A | | 1/1985 | Schroeder |
| 4,856,311 | A | | 8/1989 | Conaway |
| 4,925,499 | A | * | 5/1990 | Wohr ..... 148/195 |
| 5,339,666 | A | * | 8/1994 | Suzuki et al. ..... 72/56 |
| 5,377,594 | A | | 1/1995 | Alford |
| 5,890,698 | A | | 4/1999 | Domytrak |
| 6,073,437 | A | * | 6/2000 | Jones ..... 60/204 |
| 2006/0060601 | A1 | | 3/2006 | Kubacki et al. |

FOREIGN PATENT DOCUMENTS

| | | | |
|---|---|---|---|
| EP | 0151490 | A2 | 8/1985 |
| EP | 00371018 | B1 | 7/1992 |
| EP | 0592068 | A1 | 4/1994 |
| GB | 742460 | | 6/1952 |
| GB | 878178 | A | 9/1961 |
| GB | 1129562 | A | 10/1968 |
| GB | 1280451 | A | 7/1972 |
| GB | 1419889 | | 12/1975 |
| GB | 1436538 | | 5/1976 |
| GB | 1501049 | A | 2/1978 |
| GB | 1542519 | A | 3/1979 |
| GB | 2009651 | A | 6/1979 |
| GB | 2047147 | A | 11/1980 |
| JP | 58145381 | A | 8/1983 |
| JP | 2117728 | A | 5/1990 |
| JP | 70505176 | | 2/1995 |

(Continued)

*Primary Examiner* — Edward Tolan
*Assistant Examiner* — Matthew G Katcoff
(74) *Attorney, Agent, or Firm* — Millman IP Inc.

(57) ABSTRACT

An explosion forming apparatus (10) that preferably utilizes a shock wave (42) directed along a work piece (12) to progressively conform the work piece to a contour die cavity (44).

15 Claims, 32 Drawing Sheets

FOREIGN PATENT DOCUMENTS

| | | | |
|---|---|---|---|
| WO | 9933590 | A2 | 7/1999 |
| WO | 0000309 | A1 | 1/2000 |
| WO | 2004028719 | A1 | 4/2004 |
| WO | 2006128519 | A | 12/2006 |
| WO | 2008098608 | A1 | 8/2008 |
| WO | 2009095042 | A1 | 8/2009 |

* cited by examiner

EXPLOSION FORMING SYSTEM

CROSS-REFERENCE TO RELATED APPLICATIONS

This application claims the benefit of U.S. Provisional Application No. 61/049,021 filed Apr. 30, 2008. This application is also a continuation-in-part of U.S. application Ser. No. 12/447,727 filed Mar. 30, 2010 and entitled "Method and Mould Arrangement for Explosion Forming", which is a national phase entry of PCT Application No. EP07/010,966 filed Dec. 13, 2007, which claimed priority to DE Serial No. 102007007330.7 filed Feb. 14, 2007.

FIELD OF INVENTION

The invention relates to systems for modifying parts using a pressurized fluid and more particularly to systems for modifying parts using a pressurized working fluid wherein pressurization of the working fluid is achieved by means of an explosion.

BACKGROUND OF INVENTION

Some types of pressure forming systems are explosion forming systems that use an explosion to generate pressure to form a work piece in a die cavity. Generally speaking, proposed systems for this purpose suffer several problems. One problem is that they require significant amounts of energy to operate and to hold the die cavity closed to resist the pressure therein that results from the explosion.

Another problem is that they can in some instances require a relatively large amount of time per forming cycle, which reduces the part production rate. In addition, the work piece may require further processing, such as eliminating non-finished portions of the work piece, which further adds to the cost of production.

Some explosion forming systems use rupture discs to contain a combustible gas. The explosion resulting from combustion of the gas ruptures the rupture disc to reach the work piece. The rupture discs are consumed with each forming cycle, further adding to the cost of producing the work pieces. The rupture discs are themselves also a source of inefficiency since some of the explosive energy is lost in rupturing the disc.

It is desirable to provide a more efficient explosion forming system, particularly for use in the automotive industry which can require the forming, shaping and cutting of high strength steel.

SUMMARY OF INVENTION

The nature of the explosion is an important factor in determining the overall cost of an explosion forming system. In one broad aspect of the invention, an explosion forming system is provided where the system generates a shock wave that is progressively applied to a work piece. This enables the tonnage required to press or seal a conforming die for the work piece to be reduced in comparison to other pressure forming systems such as hydro-forming systems or other explosion forming systems. This is primarily due to the fact that the force of the shock wave, although relatively high as discussed in detail herein, is applied over a relatively small area of the work piece and underlying die at any point in time, and thus the power required to press the die can be reduced in comparison to prior art pressure forming systems. Smaller tonnage means reduced capital costs. In addition, by progressively applying a shock wave, it is easier to punch relatively small holes in the work piece and/or trim sections of the work piece in comparison to the prior art.

The following aspects of the invention generally relate to the foregoing:

First, the invention provides an apparatus for modifying a work piece having a longitudinal length. The apparatus includes an ignition chamber configured for generating a traveling shock wave that has a shock wave length that is less than the longitudinal length of the work piece; a die, wherein the die includes a first die plate and a second die plate, wherein at least one of the first and second die plates is movable relative to the other between an open position and a closed position wherein the first and second die plates together define a die cavity in which the work piece can be positioned; and a transfer structure configured to convey the shock wave from the ignition chamber into the die cavity; wherein, in operation, the shock wave applies a localized pressure to the work piece in a direction that is transverse to the direction of travel of the shock wave.

Second, the invention provides an apparatus for modifying a work piece having a work piece interior that defines a work piece shock wave path for the passage of a shock wave therethrough, wherein the work piece has a work piece pressure inlet into the work piece interior. The apparatus includes an ignition chamber configured for generating a shock wave that has a shock wave length that is less than the work piece shock wave path length; a die, wherein the die includes a first die plate and a second die plate, wherein at least one of the first and second die plates is movable relative to the other between an open position and a closed position wherein the first and second die plates together define a die cavity in which the work piece can be positioned, wherein when the shock wave is in the work piece the shock wave applies pressure to the work piece in a direction that is transverse to the work piece shock wave path, and wherein the die is holdable in the closed position by a selected die holding force against pressure in the work piece; and a transfer structure configured to convey the shock wave from the ignition chamber into the work piece interior through the work piece pressure inlet to modify the work piece.

Third, the invention provides an apparatus for modifying a work piece having a work piece interior, and having a work piece pressure inlet into the work piece interior. The apparatus includes an ignition chamber configured for generating a shock wave; a die in which the work piece can be positioned; and a transfer structure configured to convey the shock wave from the ignition chamber into the work piece interior through the work piece pressure inlet to modify the work piece.

Fourth, the invention provides a method for modifying a work piece. The method includes: a) providing a die including a first die plate and a second die plate, wherein at least one of the first and second die plates is movable relative to the other between an open position and a closed position wherein the first and second die plates together define a die cavity; b) positioning the work piece in the die cavity; c) generating a traveling shock wave, wherein the shock wave has a length that is smaller than the length of the shock wave travel path relative to the work piece; d) conveying the shock wave along the work piece to progressively apply a localized pressure against the work piece; e) holding the first and second die plates in the closed position with a selected die holding force against pressure from the shock wave in a direction that is transverse to the shock wave path of travel throughout step d); and f) ejecting the work piece from the die cavity after step d).

Fifth, the invention provides a method for modifying a work piece. The method includes: a) providing a die having a die cavity; b) positioning the work piece in the die cavity; c) generating a shock wave; d) conveying the shock wave into the work piece in the die cavity to modify the work piece; and e) ejecting the work piece from the die cavity after step d).

As discussed in detail herein, another factor in reducing the tonnage required to press the die in an explosion forming system lies in the after pressure or back pressure resulting from the gaseous products of combustion. To minimize such after pressure, it is desirable to use a stoichiometric ratio of oxygen and hydrogen to produce water vapour, and to cool the ignition chamber in order to rapidly condense the water vapour and hence reduce the after pressure.

The following aspects of the invention generally relate to the foregoing:

Sixth, an apparatus for modifying a tubular work piece defining a conduit length. The apparatus includes: an ignition chamber configured for generating a shock wave that has a shock wave length that is less than the conduit length of the work piece, wherein the ignition chamber utilizes oxygen and hydrogen as combustibles and includes at least one combustibles inlet; an igniter; a die, wherein the die includes a first die plate and a second die plate, wherein at least one of the first and second die plates is movable relative to the other between an open position and a closed position wherein the first and second die plates together define a die cavity in which the work piece can be positioned, wherein, in operation, the shock wave travels through the work piece and applies a localized pressure to the work piece in a direction that is transverse to the shock wave travel path, and wherein the die is holdable in the closed position by a selected die holding force against pressure in the work piece; a transfer structure configured to convey the shock wave from the ignition chamber into the work piece to modify the work piece; a controller for the transfer of a selected ratio and quantity of oxygen and hydrogen combustibles into the ignition chamber and for actuating the igniter to react the combustibles, wherein the controller serially executes explosions; and a cooling system for cooling the ignition chamber so as to reduce the pressure of water vapour created by reacting oxygen and hydrogen.

Seventh, an apparatus for modifying a work piece having a longitudinal length. The apparatus includes: an ignition chamber configured for generating a traveling shock wave that has a shock wave length that is less than the longitudinal length of the work piece, wherein the ignition chamber utilizes oxygen and hydrogen combustibles to generate the shock wave and includes at least one combustibles inlet; an igniter; a die, wherein the die includes a first die plate and a second die plate, wherein at least one of the first and second die plates is movable relative to the other between an open position and a closed position wherein the first and second die plates together define a die cavity in which the work piece can be positioned; a transfer structure configured to convey the shock wave from the ignition chamber into the die cavity; wherein, in operation, the shock wave applies a localized pressure to the work piece in a direction that is transverse to the direction of travel of the shock wave, and wherein the die is holdable in the closed position by a selected die holding force; a controller for the transfer of a selected ratio and quantity of oxygen and hydrogen into the ignition chamber and for actuating the igniter to react the combustibles, wherein the controller serially executes explosions; and a cooling system for cooling the ignition chamber so as to reduce the pressure of water vapour created by reacting oxygen and hydrogen.

For the production of automotive parts, for example, it may be necessary to generate explosions that produce thousands of bars of pressure. Through experimentation it was discovered that, despite the use of massive equipment to handle such pressures, the geometry of the pressure conveying parts of an explosion forming system can have a bearing on the performance and/or longevity of the system. To minimize the risk, it is desirable for the conduits conveying pressure to the work piece to be substantially free of reflective surfaces. Moreover, given the discovery that even changes in the cross-sectional shape and size of the pressure carrying conduits could cause their walls to erode over time, the most preferred embodiments of the invention employ pressure carrying conduits of substantially constant cross-section shape and size.

The following aspects of the invention generally relate to the foregoing:

Eighth, an apparatus for modifying a work piece having a longitudinal length. The apparatus includes: an ignition chamber configured for generating a traveling shock wave that has a shock wave length that is less than the longitudinal length of the work piece; a die, wherein the die includes a first die plate and a second die plate, wherein at least one of the first and second die plates is movable relative to the other between an open position and a closed position wherein the first and second die plates together define a die cavity in which the work piece can be positioned; a transfer structure configured to convey the shock wave from the ignition chamber into the die cavity; wherein the ignition chamber and the transfer structure together define a pre-work piece shock wave flow conduit that has a cross-sectional size and a cross-sectional shape that are substantially constant and substantially free of reflection elements; wherein, in operation, the shock wave applies a localized pressure to the work piece in a direction that is transverse to the direction of travel of the shock wave, and wherein the die is holdable in the closed position by a selected die holding force.

Ninth, an apparatus for modifying a work piece having a longitudinal length. The apparatus includes: an ignition chamber configured for generating a traveling shock wave that has a shock wave length that is less than the longitudinal length of the work piece; a die, wherein the die includes a first die plate and a second die plate, wherein at least one of the first and second die plates is movable relative to the other between an open position and a closed position wherein the first and second die plates together define a die cavity in which the work piece can be positioned; a transfer structure configured to convey the shock wave from the ignition chamber into the die cavity, the transfer structure including an isolation valve positionable in an open position wherein the ignition chamber is fluidly connected with the die cavity and a closed position wherein the ignition chamber is fluidly disconnected from the die cavity; wherein the ignition chamber and the transfer structure, when the isolation valve is in the open position, together define a pre-work piece shock wave flow conduit that has a cross-sectional size and a cross-sectional shape that are substantially constant and substantially free of reflection elements; wherein, in operation, the shock wave applies a localized pressure to the work piece in a direction that is transverse to the direction of travel of the shock wave, and wherein the die is holdable in the closed position by a selected die holding force.

Tenth, an apparatus for modifying a tubular work piece defining a conduit length. The apparatus includes: an ignition chamber configured for generating a shock wave that has a shock wave length that is less than the conduit length of the work piece; a die, wherein the die includes a first die plate and a second die plate, wherein at least one of the first and second die plates is movable relative to the other between an open position and a closed position wherein the first and second die plates together define a die cavity in which the work piece can be positioned, wherein, in operation, the shock wave travels through the work piece and applies a localized pressure to the work piece in a direction that is transverse to the shock wave travel path, and wherein the die is holdable in the closed position by a selected die holding force against pressure in the work piece; and a transfer structure configured to convey the shock wave from the ignition chamber into the work piece to modify the work piece; wherein the ignition chamber and the transfer structure together define a pre-work piece shock wave flow conduit that has a cross-sectional size and a cross-sectional shape that are substantially constant and substantially free of reflection elements.

Eleventh, an apparatus for modifying a tubular work piece defining a conduit length. The apparatus includes: an ignition chamber configured for generating a shock wave that has a shock wave length that is less than the conduit length of the work piece; a die, wherein the die includes a first die plate and a second die plate, wherein at least one of the first and second die plates is movable relative to the other between an open position and a closed position wherein the first and second die plates together define a die cavity in which the work piece can be positioned, wherein, in operation, the shock wave travels through the work piece and applies a localized pressure to the work piece in a direction that is transverse to the shock wave travel path, and wherein the die is holdable in the closed position by a selected die holding force against pressure in the work piece; and a transfer structure configured to convey the shock wave from the ignition chamber into the work piece to modify the work piece, the transfer structure including an isolation valve positionable in an open position wherein the ignition chamber is fluidly connected with the die cavity and a closed position wherein the ignition chamber is fluidly disconnected from the die cavity; wherein the ignition chamber and the transfer structure, when the isolation valve is in the open position, together define a pre-work piece shock wave flow conduit that has a cross-sectional size and a cross-sectional shape that are substantially constant and substantially free of reflection elements.

The generation of possibly thousands of bars of pressure typically required for producing automotive parts such as automotive or truck frame or chassis body members is, in the words of one inventor, no laughing matter. Any operating device such as a valve, sensor or actuator in the path of or otherwise subject to such pressure is prone to considerable stresses and wear. The invention provides a protective mechanism to ameliorate against the effects of such pressure.

The following aspects of the invention generally relate to the foregoing:

Twelfth, an apparatus for modifying a work piece, including: an ignition chamber for the generation of an explosion; a die having at least one wall defining a die cavity for receiving the work piece, the die cavity having a pressure inlet and a pressure outlet and wherein, the ignition chamber is fluidly connectable to the die cavity for the transmission of a pressure wave resulting from the explosion through the die cavity from its pressure inlet to its pressure outlet such that, in operation, the pressure wave modifies the work piece to at least partially conform to the at least one die cavity wall; and a pressure reducer disposed downstream of the die cavity pressure outlet that is configured to at least partially destroy the pressure wave.

Thirteenth, an apparatus for modifying a work piece having a longitudinal length, the apparatus comprising: an ignition chamber configured for generating a shock wave that has a shock wave length that is less than the longitudinal length of the work piece; a die having a die cavity for receiving the work piece; a transfer structure configured to convey the shock wave from the ignition chamber into the die cavity; wherein, in operation, the shock wave applies a localized pressure to the work piece in a direction that is transverse to the direction of travel of the shock wave, and wherein the die is holdable in the closed position by a selected die holding force; and a pressure reducer disposed downstream of the work piece configured to at least partially destroy the shock wave.

Fourteenth, an apparatus for modifying a tubular work piece having a tubular wall and a tubular length, the apparatus including: an ignition chamber configured for generating a shock wave that has a shock wave length that is less than the tubular length of the work piece; a die having at least one wall defining a die cavity for receiving the work piece; a transfer structure configured to convey the shock wave from the ignition chamber into the die cavity; wherein, in operation, the shock wave applies a localized pressure to the tubular wall of the work piece in a direction that is transverse to the direction of travel of the shock wave so as to at least partially conform the tubular wall of the work piece against the at least one die wall; and a pressure reducer disposed downstream of the work piece configured to at least partially destroy the pressure wave, the pressure reducer being disposed upstream of one or more valves fluidly connectable to the die cavity.

Fifteenth, a method for modifying a tubular work piece, including: a) providing an ignition chamber; b) providing a die having a die cavity for receiving the work piece; c) transferring the work piece into the die cavity; d) generating an explosion in the ignition chamber to generate a pressure wave in the ignition chamber; e) transmitting the pressure wave from the ignition chamber to the work piece to modify the work piece; f) transmitting the pressure wave out of the die cavity after step e); g) at least partially destroying the pressure wave after step f); and h) ejecting the work piece from the die cavity after step f).

The cost of a part produced by any capital intensive manufacturing equipment typically also depends on the part production rate, or forming cycle time. The invention provides numerous improvements over the prior art to minimize the cycle time, including provisioning an isolation valve to isolate different parts of an explosion forming system so that certain operating functions can be carried out in parallel.

The following aspects of the invention generally relate to the foregoing:

Sixteenth, an apparatus for modifying a work piece, including: an ignition chamber for generating an explosion through the ignition of combustibles; a die having a die cavity in which the work piece is positionable, the die having an incompressible fluid inlet that is fluidly connectable to the die cavity; and an isolation valve positionable in an open position wherein the ignition chamber is fluidly connected with the die cavity such that pressure from the explosion is transmittable to the work piece to modify the work piece, and a closed position wherein the ignition chamber is fluidly disconnected from the die cavity.

Seventeenth, a method for modifying a work piece, including: a) providing an ignition chamber; b) providing a die having a die cavity for receiving the work piece; c) isolating the ignition chamber from the die; d) transferring combustibles into the ignition chamber after step c); e) transferring the work piece into the die cavity; f) fluidly connecting the ignition chamber and the work piece after step d); g) generating an explosion with the combustibles after step f); h) transmitting pressure from the explosion to the work piece in the die cavity to modify the work piece; and i) ejecting the work piece from the die cavity after step h).

Eighteenth, an apparatus for modifying a work piece, including: an ignition chamber for generating an explosion; a die having a die cavity configured to receive the work piece; and an isolation valve repetitively controllable between a closed position wherein the die cavity is fluidly disconnected from ignition chamber and an open position wherein the die cavity is fluidly connected with the ignition chamber such that pressure from the explosion is transmittable to the die cavity.

Nineteenth, an apparatus for modifying a work piece, including: an ignition chamber configured for the generation of an explosion and having a plurality of combustibles inlets; a die, having a first die plate and a second die plate, wherein the first and second die plates together define a die cavity for holding the work piece, wherein at least one of the first and second die plates is movable relative to the other to open and close the die; and an isolation valve positionable in an open position wherein the ignition chamber is fluidly connected with the work piece such that pressure from the explosion is transmittable to the work piece to modify the work piece, and a closed position wherein the ignition chamber is isolated from the die.

Twentieth, an apparatus for modifying a work piece, including: an ignition chamber configured for the generation of an explosion and having a plurality of combustibles inlets; a controller for filling the ignition chamber with combustibles to a selected pressure higher than atmospheric pressure; a die, having a die cavity for holding the work piece; and an isolation valve positionable in an open position wherein the ignition chamber is fluidly connected with the work piece such that pressure from the explosion is transmittable to the work piece to modify the work piece, and a closed position wherein the ignition chamber is isolated from the die; wherein the isolation valve includes a valve body having a pressure inlet and a pressure outlet, a flow control member movable between an open position wherein the flow control member permits fluid flow through the valve body and a closed position wherein the flow control member prevents fluid flow through the valve body, a sealing member positioned between the flow control member and the valve body, wherein, when in the closed position the flow control member is movable in a downstream direction against the sealing member by differential pressure across the valve, a bypass conduit fluidly connected to points upstream and downstream from the flow control member, wherein the bypass conduit has a cross-sectional area that is smaller than the cross-sectional area of the pressure inlet, and a bypass valve that is movable between an open position providing fluid communication between the points upstream and downstream from the flow control member through the bypass conduit to equalize pressure therebetween, and a closed position preventing fluid communication between the points upstream and downstream from the flow control member.

Twenty-first, an apparatus for modifying a work piece, including: an ignition chamber for generating an explosion, the ignition chamber having at least one inlet for ingress of combustibles thereto and at least one valve for controlling the flow of combustibles into the ignition chamber via the at least one combustibles inlet; a die having a die cavity configured to receive the work piece, the die having an incompressible fluid inlet that is fluidly connectable to the die cavity and at least one valve for controlling the flow of the incompressible fluid into the die cavity via the incompressible fluid inlet, wherein the die includes first and second die plates that together define the die cavity and least one of the first and second die plates is movable relative to the other to open and close the die; a transfer mechanism for placing the work piece in the die or removing the work piece therefrom whilst the die is open; an isolation valve settable in an open position wherein the ignition chamber is fluidly connected with the die cavity such that pressure from the explosion is transmittable to the work piece to modify the work piece, and in a closed position wherein the ignition chamber is isolated from the die cavity; and a controller programmed to close the isolation valve, transfer combustibles into the ignition chamber, open the isolation valve, and ignite the combustibles to generate the explosion, the controller opening the die for actuation of the work piece transfer mechanism and starting to fill the ignition chamber with the combustibles prior to closing the die.

Twenty-second, an apparatus for modifying a work piece, including: an ignition chamber for generating an explosion, the ignition chamber having at least one inlet for ingress of combustibles and an inlet for ingress of an incompressible fluid; a combustibles valve for controlling the flow of combustibles into the ignition chamber via the at least one combustibles inlet; a secondary valve for controlling the flow of incompressible fluid into the ignition chamber via the at least one incompressible fluid inlet; a die press; a die mounted to the die press and having a die cavity configured to receive the work piece, wherein the die includes first and second die plates that together define the die cavity and least one of the first and second die plates is movable relative to the other to open and close the die, and wherein the die cavity has a pressure inlet and a pressure outlet, and wherein the die has an incompressible fluid inlet disposed downstream of the die cavity pressure outlet; a primary valve for controlling the flow of the incompressible fluid into the die cavity via the incompressible fluid inlet; an isolation valve disposed between the ignition chamber and the die cavity, the isolation valve being settable in an open position wherein the ignition chamber is fluidly connected with the die cavity such that pressure from the explosion is transmittable to the work piece to modify the work piece, and in a closed position wherein the ignition chamber is isolated from the die cavity; a controller connected to the at least one combustibles valve, the primary and secondary incompressible fluid valves, the isolation valve, and the die press, the controller programmed to open the die, close the isolation valve, transfer combustibles and incompressible fluid into the ignition chamber whilst transferring incompressible fluid into the die cavity, open the isolation valve, and ignite the combustibles to generate the explosion, the controller starting to fill the ignition chamber with the combustibles prior to closing the die.

Other cycle time improvements relate to the manner in which a work piece is loaded or otherwise handled in an explosion forming system.

The following aspects of the invention generally relate to the foregoing:

Twenty-third, an apparatus for modifying a work piece having a work piece interior and having a first opening into the work piece interior, including: an ignition chamber for the generation of pressure; a die having a die cavity for receiving the work piece; and a transfer conduit for transferring pressure from the ignition chamber to the work piece to modify the work piece, wherein the transfer structure has a first transfer conduit portion and a second transfer conduit portion, wherein the first and second transfer conduit portions are fluidly connected to each other, wherein the first transfer conduit portion is fixedly connected with respect to the ignition chamber, wherein the second transfer conduit portion is movable between an advanced position wherein the second transfer conduit portion is inserted into the first opening of the work piece, and a retracted position wherein the second transfer conduit portion is withdrawn from the first opening of the work piece to permit ejection of the work piece from the die cavity, and wherein the first and second transfer conduit portions are rotatably connected to each other.

Twenty-fourth, an apparatus for modifying a work piece, including: an ignition chamber for the generation of pressure, the ignition chamber reciprocating at least along a first axis; a die having a die cavity for receiving the work piece, the die cavity having an inlet defining a second axis that is not parallel with the first axis; a transfer conduit for fluidly transmitting pressure from the ignition chamber to the die cavity, wherein the transfer conduit has a first section and a second section, the first section connected to the ignition chamber and reciprocating at least along the first axis, the second section being adjustable in angle relative to the first section to permit the second section to slide into and out of the die cavity inlet as the ignition chamber reciprocates at least along the first axis.

Twenty-fifth, an apparatus for modifying a work piece, including: an ignition chamber for the generation of pressure; a die having a die cavity for receiving the work piece; and a transfer conduit for transmitting pressure from the ignition chamber to the die cavity, wherein transfer conduit has a first section and a second section, at least one of the first and second sections being adjustable in angle relative to one another.

Twenty-sixth, an apparatus for modifying a tubular work piece, the tubular work piece having an end including an outer periphery and an inner periphery, the apparatus including: an ignition chamber for the generation of pressure; a die having a die cavity configured to receive the work piece, wherein the die includes first and second die plates that together define the die cavity and least one of the first and second die plates is movable relative to the other to open and close the die, and wherein the die includes a collar provided by the first and second die plates when the die is in the closed position for holding the first end of the work piece at its outer periphery; a transfer conduit for transferring pressure from the ignition chamber to the work piece to modify the work piece, wherein the transfer conduit is mounted for movement between an advanced position where the transfer conduit engages the inner periphery of the work piece so as to pinch the end of the work piece against the collar to provide fluid communication between the transfer conduit and the interior of the work piece and a retracted position where the transfer conduit is not fluidly connected to the tubular work piece.

In addition, some embodiments of the explosion forming system minimize cycle time by producing a finished work piece that may not require additional processing steps such as such as cutting or trimming. For instance, one system described herein accurately forms and/or pierces and trims work pieces to produce finished parts, thus not requiring subsequently trimming the ends of work pieces with lasers or other cutting implements that can require a significant period of time to carry out, especially when the work piece is formed from high strength steel.

The following aspects of the invention generally relate to the foregoing:

Twenty-seventh, an apparatus for modifying a work piece having a work piece wall that defines a work piece interior and having a work piece body and a first end portion having a first opening into the work piece interior. The apparatus includes: an ignition chamber for the generation of pressure; a die having a die cavity for receiving the work piece, wherein the die includes a first collar positioned to hold a first end portion of the work piece, wherein the die further includes an intermediate work piece holder to securely hold the work piece body in a fixed position in the die cavity; and a transfer conduit for transferring the pressure from the ignition chamber to the work piece to modify the work piece, wherein the transfer conduit has a transfer conduit fluid passage therein, wherein the transfer conduit is insertable into the first end portion of the work piece to provide fluid communication between the transfer conduit fluid passage and the work piece interior, wherein the die cavity includes a first trim aperture that extends at a selected position around the first end portion, such that pressure transferred from the ignition chamber to the work piece interior passes through the work piece wall into the first trim aperture to trim the first end portion from the work piece body.

Twenty-Eighth, an apparatus for modifying a first work piece and a second work piece, where each work piece has a work piece wall that defines a work piece interior. The apparatus includes: a first ignition chamber configured for the generation of pressure; a second ignition chamber configured for the generation of pressure; a die having a first die cavity for receiving the first work piece, wherein the first die cavity has a first die cavity wall configured to provide a selected shape to the work piece when pressure from the first ignition chamber is transferred to the work piece interior of the first work piece, wherein the die has a second die cavity configured for receiving the second work piece having the selected shape, wherein the second die cavity has a second die cavity wall having at least one hole-punch aperture therein configured such that pressure transferred from the second ignition chamber to the work piece interior of the second work piece punches at least one aperture through the work piece wall into the at least one hole-punch aperture; and a transfer mechanism that is movable to transfer the first work piece from the first die cavity into the second die cavity, and that is movable to transfer the second work piece from the second die cavity out of the die.

One of the hallmarks of a production quality explosion forming system is the ability to rapidly produce parts of consistent quality. To do that, the explosion and the pressure generated by the system should be held relatively constant on every run or execution. It was discovered that the temperature of the combustibles could have a deleterious effect on the production rate and the quality of the parts produced.

The following aspects of the invention generally relate to the foregoing:

Twenty-Ninth, a combustive forming system for serially modifying work pieces, comprising: an ignition chamber having at least one inlet for the ingress of combustibles; at least one valve controlling the flow of combustibles from a source of combustibles to the ignition chamber; an igniter fluidly connected to the ignition chamber; venting means for transferring exhaust gases out the ignition chamber; temperature control means for controlling the temperature of the ignition chamber; a die having a die cavity for receiving work piece wherein, in operation, the work piece is fluidly connected to the ignition chamber; a transfer mechanism for moving a modified work piece out of the die and moving a new work piece into the die; and a controller operably connected to the at least one combustibles valve, igniter, the venting means, the temperature control means and the transfer mechanism, wherein the controller repeatedly executes an operating cycle including (a) moving a modified work piece out of the die and transferring a new work piece into the die, (b) transferring combustibles to the ignition chamber, (c) igniting the combustibles to thereby generate a pressure wave operable to modify the work piece in the die, and (d) transferring exhaust gases out of the ignition chamber, and wherein the controller maintains the temperature of the ignition chamber to within a predetermined temperature range whilst repeatedly carrying out the operating cycle.

BRIEF DESCRIPTION OF THE DRAWINGS

The invention will now be described by way of example only with reference to the attached drawings, in which.

DETAILED DESCRIPTION OF EMBODIMENTS OF THE INVENTION

This application incorporates by reference in its entirety the contents of U.S. application Ser. No. 12/447,727 filed Apr. 29, 2009 and entitled "Method and Mould Arrangement for Explosion Forming.

Figure 1:
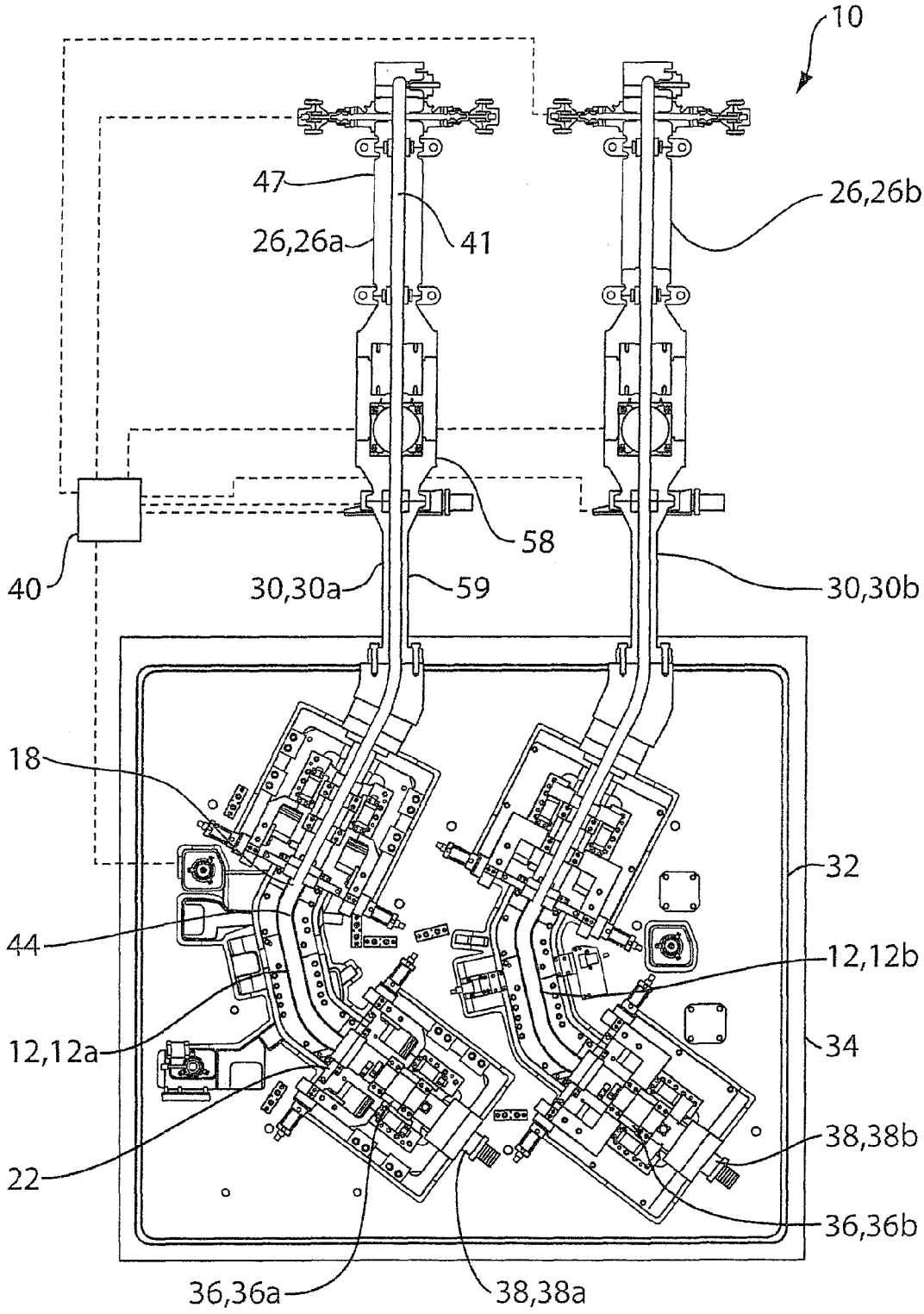
FIG. 1 is an elevation view of an apparatus for modifying a work piece in accordance with an embodiment of the present invention, with some elements removed for clarity.

FIG. 1 shows an apparatus 10 for modifying a work piece 12 in accordance with a preferred embodiment of the invention. The apparatus 10 uses fluid pressure generated by an explosion (resulting from igniting combustibles shown at 47) to modify the work piece 12. In the preferred embodiment the apparatus 10 is configured to generate a shock wave 42 (FIG. 3) from the explosion and the pressure from the shock wave modifies the work piece 12, as discussed in greater detail below. However, the apparatus 10 may also be operated to modify the work piece 12 even if the explosion does not generate a shock wave, as discussed in greater detail below.

The apparatus 10 may perform different types of operation on the work piece 12 to modify the work piece 12 in one or more different ways. For example, the apparatus 10 may form the work piece 12 to a particular shape. Alternatively or additionally, the apparatus 10 may be used to punch holes in and/or trim sections of the work piece 12. The particular apparatus 10 shown in FIG. 1 is configured to form a work piece 12 into a desired shape and to punch holes in the work piece 12 and trim sections thereof. In particular, where the apparatus 10 generates the shock wave 42, the apparatus 10 may be configured to punch relatively small holes in the work piece 12, which is difficult to do in prior art hydro-forming systems.

Figure 2:
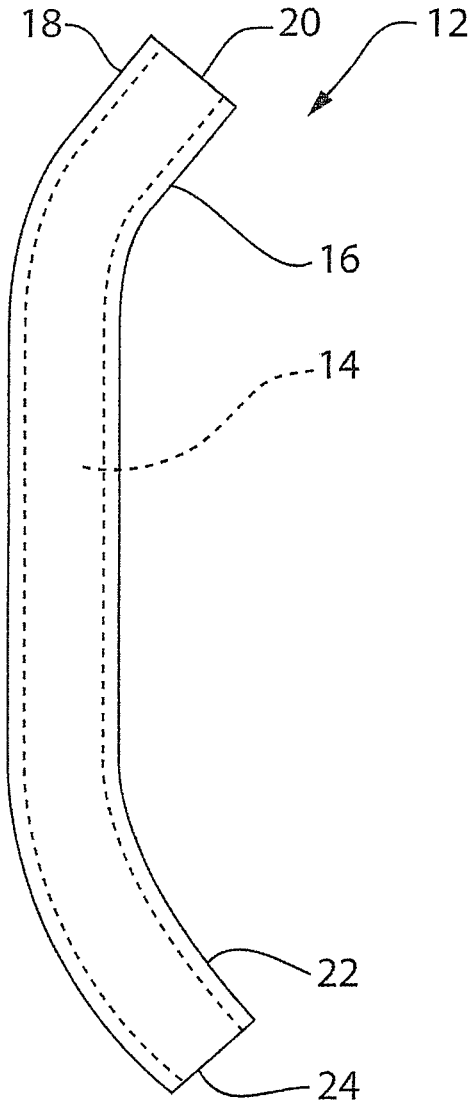
FIG. 2 is a sectional view of a work piece to be modified with the apparatus shown in FIG. 1.

FIG. 2 shows the specific work piece 12 used in the apparatus 10 illustrated in FIG. 1. The work piece 12 is preferably tubular and elongate in shape having a tubular wall 16 defining a work piece interior 14. The work piece 12 has a first or top end 18 at which there is a first opening 20 into the interior 14, and a second, opposing or bottom end 22 at which there is a second opening 24 into the interior 14.

The work piece 12 may have any suitable shape. For example, the work piece 12 shown in FIG. 2 is tubular and generally parenthesis-shaped. However, the invention is not limited to tubular work pieces and in alternative embodiments discussed in greater detail below the work piece may assume other shapes such as a flat or substantially flat sheet or board, or an open tubular shape.

Referring to FIG. 1, the apparatus 10 preferably includes substantially similar first and second sections 10A, 10B for modifying a work piece 12, with the first section 10A being used to form the work piece and the second section 10B being used to punch and trim the work piece 12 to generate a finished part, it being understood that the apparatus 10 can hold and operate on two work pieces 12 simultaneously. Each section 10A or 10B includes an ignition chamber 26 (individually labeled as 26*a* and 26*b*), a pressure transfer structure 30 (individually labeled as 30*a* and 30*b*), a contouring portion of a die 32 for holding the work pieces 12 (labeled individually at 12*a* and 12*b*), a pressure reducer 36 (individually labeled as 36*a* and 36*b*), a primary incompressible fluid inlet valve 38 (shown individually labeled as 38*a* and 38*b*). Each pressure transfer structure also includes an isolation valve 58, which is used to isolate the ignition chamber 26 from other actions that are carried out by the apparatus 10 prior to generating an explosion. The apparatus 10 also includes a die press 34, a work piece transfer mechanism 39 (FIG. 8*a*), and a controller 40.

Generally speaking, the apparatus 10 works as follows: The controller 40 closes the isolation valve 58, and actuates the die press 34 to open the die 32, allowing the transfer mechanism 39 to move a finished work piece 12 out of the second section 10B, move a formed work pierce from forming section 10A to punching and trimming section 10B, and move a new work piece to forming section 10A. The controller 40 then closes the die 32 and fluidly and sealingly connects the ignition chambers 26 and pressure transfer structures 30 (which were previously moved somewhat out of the way to allow for the transfer of the work pieces 12) to the top ends 18 of the tubular work pieces 12*a*, 12*b*. Likewise, the pressure reducers 36 are fluidly and sealingly connected to the bottom ends 20 of the tubular work pieces 12*a*, 12*b*. The work pieces 12*a*, 12*b* and preferably a portion of the pressure transfer structures 30 are filled with an incompressible fluid 41, and the ignition chambers 26 are filled with combustibles. The controller 40 then opens the isolation valve 58 and explodes the combustibles to generate the preferred shock wave 42 that provides the fluid pressure to form and/or punch the work pieces 12. The pressure reducers 36 protect the primary incompressible fluid inlet valves 38 from the effects of the shock wave 42. The die press then opens and the process is repeated.

The incompressible fluid 41 is preferably water and may be referred to as water herein, however it will be understood that any suitable incompressible fluid may be used. The water may contain an emulsion for inhibiting the presence of rust, corrosion or oxidation for those components that may be susceptible to it.

The detailed structure and operation of the first section 10A is discussed next, it being understood that the second section 10B has a similar structure and function.

The explosion in the ignition chamber 26*a* generates a pressure therein that is transferred to the water 41 and from the water 41 to the work piece 12*a* in the die 32, to modify the work piece 12*a*. As previously discussed the pressure generated in the ignition chamber 26*a* is preferably in the form of the shock wave 42 (FIG. 3), and the apparatus 10 is preferably configured such that the shock wave 42 passes from the gas in the first ignition chamber 26*a* into the water 41, through the transfer structure 30*a* to the work piece 12*a*, and through the work piece 12*a* to the pressure reducer 36*a*.

Figure 3:
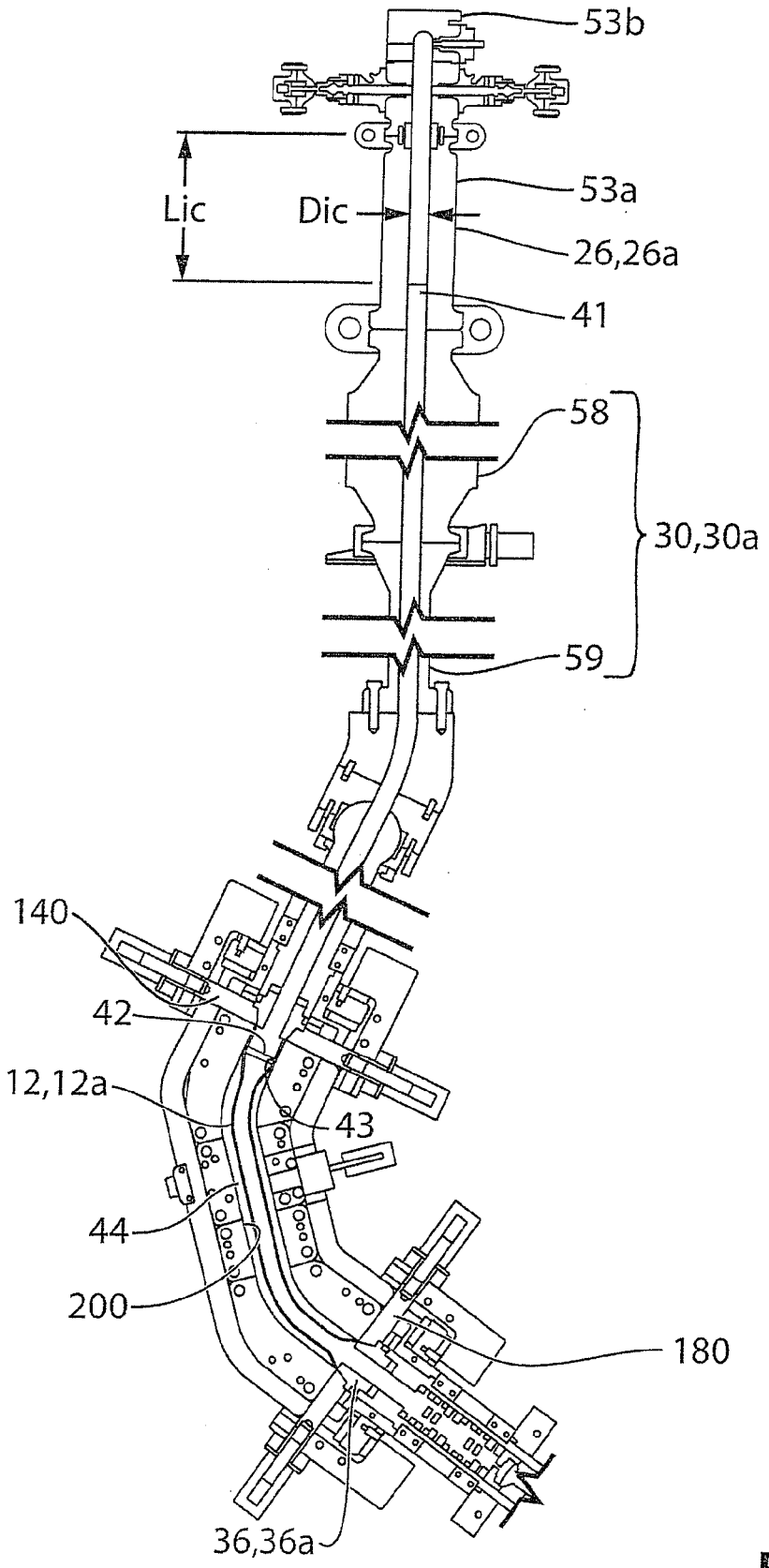
FIG. 3 is a partial sectional elevation view of a portion of the apparatus shown in FIG. 1, illustrating the modification of a work piece using a shock wave.

With continued reference to FIG. 3, the shock wave 42 is a localized pressure spike that travels faster than sound. As a result, any segment of fluid that is downstream from the shock wave 42 is not affected by the shock wave 42 until the shock wave 42 itself arrives at that segment of fluid. As a result, there is no pressure increase in fluid downstream from the shock wave 42. The shock wave 42 itself, however, applies a lateral pressure (ie. pressure in a direction that is transverse to the direction of travel of the shock wave 42) at its contact patch shown at 43 with whatever it is traveling in. When the shock wave 42 travels through the work piece 12*a* the lateral pressure applied by the shock wave 42 on the work piece 12*a* at the contact patch 43 is used to modify the work piece 12*a* in some way. For example, the lateral pressure may be used to expand the work piece 12*a* against the wall of a die cavity 44 in the die 32. Alternatively or additionally, the lateral pressure may be used to punch one or more holes in the work piece 12*a*. The lateral pressure may also be used to trim end portions off the work piece 12*a*, to be described further below. In the view shown in FIG. 3, the shock wave 42 is traveling through the work piece 12*a* and has expanded a portion of the work piece 12*a*, and has not yet reached another downstream portion of the work piece 12*a*.

The properties of the shock wave 42 may vary within a range of suitable values. For example, the speed of the shock wave 42 may be greater than about 1000 m/s in the gas in the ignition chamber 26*a*. In the water 41, the speed of the shock wave 42 may be less than about 8000 m/s. The pressure Psw of the shock wave 42 may peak somewhere in a range of about 50 bar to about 10,000 bar, depending on the work piece material. The length of the shock wave 42 may vary in a range from a few millimeters to twenty millimeters or more, the limit being that the shock wave is smaller than the length of the part over which the shock wave is applied, although preferably in practice the shock wave is significantly smaller than the length of the part over which the shock wave is applied. Generally speaking, the pressure Psw of the shock wave 42 is many times higher than the filling pressure Pf of the combustibles 47 (FIG. 1) in the ignition chamber 26*a* prior to ignition of the combustibles 47. The pressure Psw used for a particular application may be selected based on one or more factors, including, for example, the wall thickness of the work piece 12, the material of the work piece 12 and the operation being performed on the work piece (eg. punching holes in the work piece 12 versus expanding the work piece 12). The speed of the shock wave 42 increases with an increase the filling pressure Pf of the combustibles in the ignition chamber 26*a*. The length of the shock wave 42 decreases as the filling pressure Pf of the combustibles 47 (FIG. 1) increases.

Figure 4A:
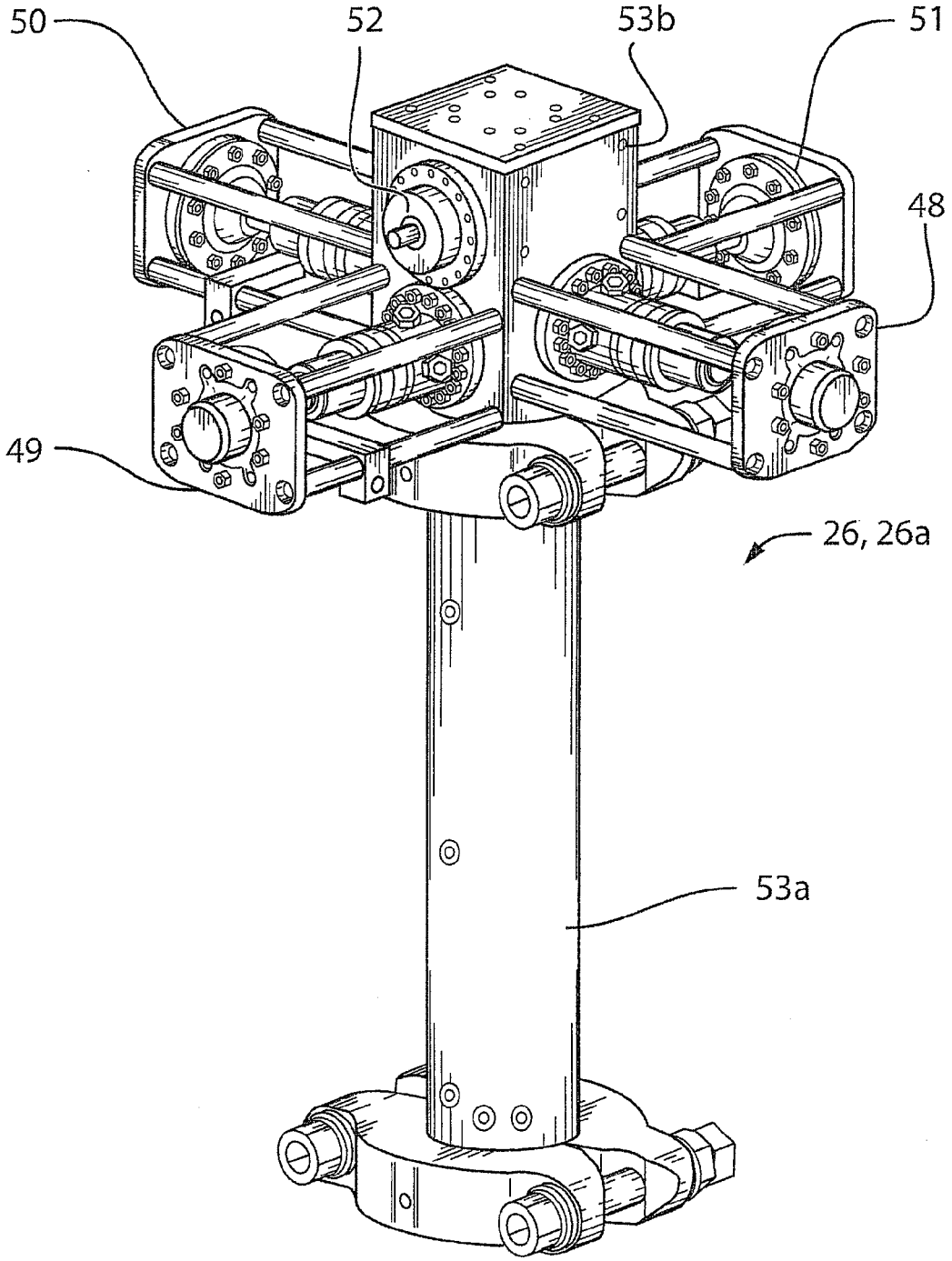
FIG. 4*a* is a perspective view of an ignition chamber that is part of the apparatus shown in FIG. 1.
Figure 4B:
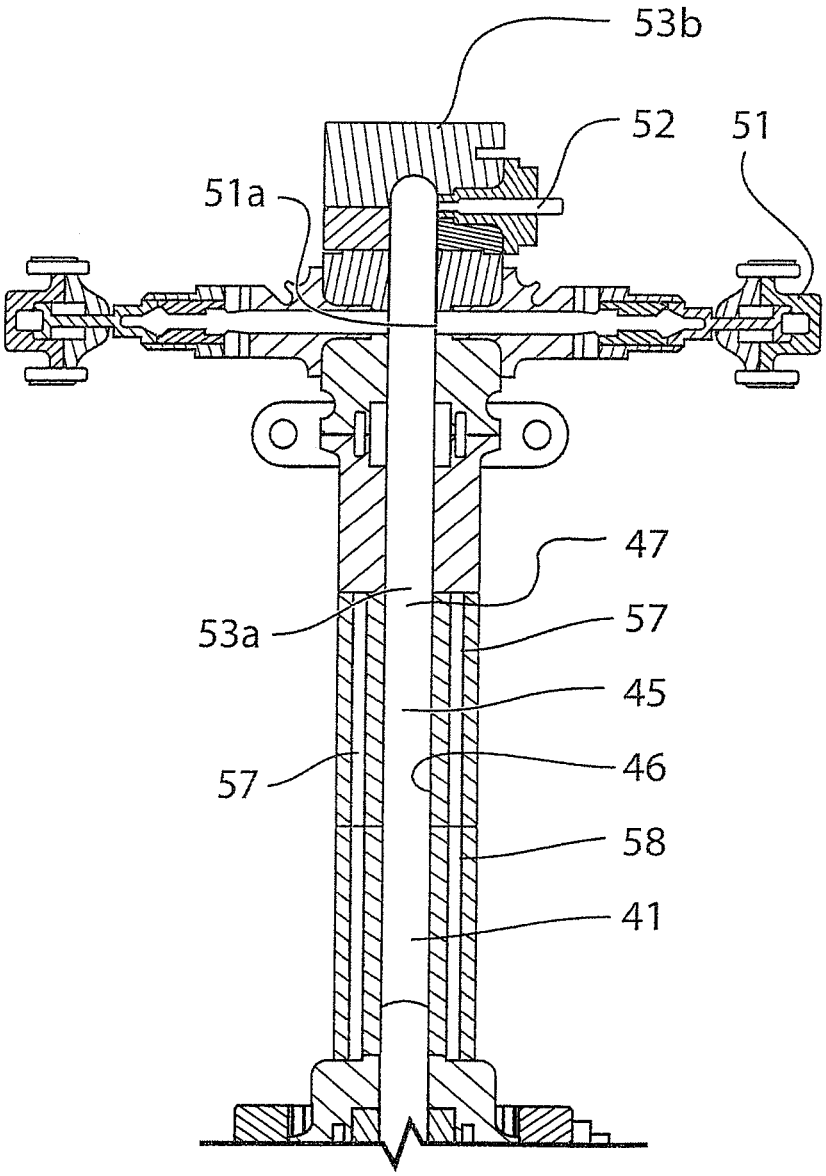
FIG. 4*b* is a sectional view of the ignition chamber shown in FIG. 4*a;*
Figure 4C:
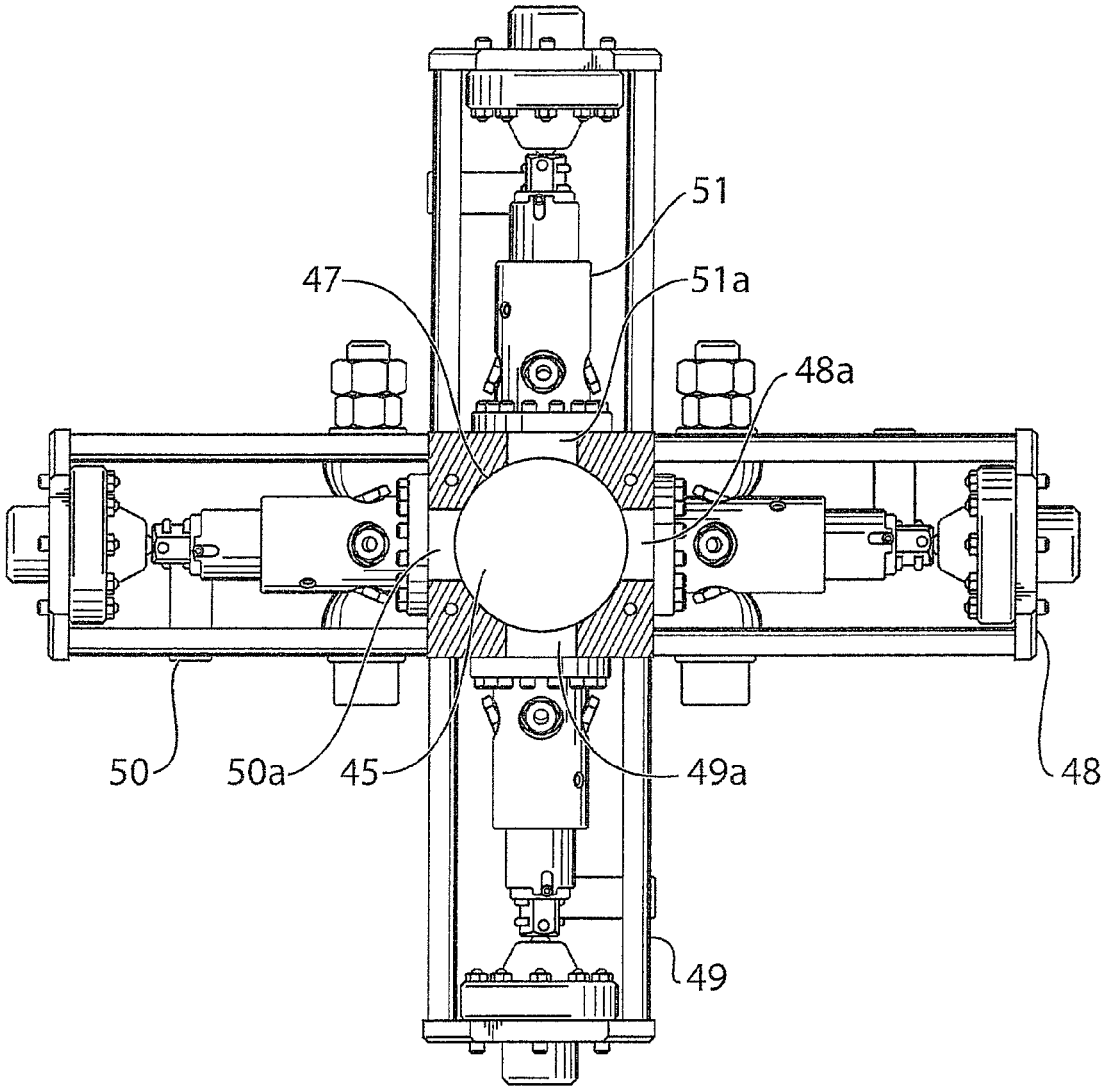
FIG. 4*c* is a top plan sectional view of the ignition chamber shown in FIG. 4*a;*

The ignition chamber 26*a* is shown more clearly in FIGS. 4*a* and 4*b*. It includes an ignition chamber body 53*a* and a head 53*b*. A wall 46 defines an ignition chamber interior 45 (FIG. 4*b*).

The combustibles 47 themselves may be any suitable combustibles, such as, for example, H2 and O2. In embodiments wherein H2 and O2 are the combustibles 47, the H2 and O2 are preferably transferred into the ignition chamber 26*a* in approximately a 2:1 ratio by volume. The ignition chamber 26*a* may be filled with the combustibles to any suitable pressure, such as, for example, a pressure ranging from about 10 to 20 bar to over 160 bar. More preferably, the filling pressure is about 40 bar to about 120 bar. In an exemplary embodiment, for a work piece 12*a* that has a 2.6 mm wall thickness and which is about 1.2 m long, and is made from mild steel, the filling pressure used for forming the work piece 12*a* may be about 30 bar, and the filling pressure used for punching holes in the work piece 12*b* and for trimming portions of the work piece 12*b* off may be about 50 bar.

A plurality of gas inlet valves, shown at 48 and 49 in FIG. 4*a*, control the flow of combustibles 47 through combustible inlets 48*a* and 49*a*, into the ignition chamber interior 45 from sources of combustibles 47 which are not shown. The gas inlet valves 48 and 49 may have any suitable configuration, such as the configuration shown and described in PCT publication no. WO2009/015716 (applicant: Cosma Engineering Europe AG), the contents of which are hereby incorporated by reference. In the illustrated embodiment valves 48 and 49 control the flow of oxygen and hydrogen, respectively. The controller 40 actuates the valves 48, 49 to permit a controlled quantity of oxygen and hydrogen into the ignition chamber interior 45 until it reaches a desired filling pressure.

Referring to FIG. 4*b* the ignition chamber 26*a* preferably includes an incompressible fluid top-off valve 50 that is configured to control the introduction of water 41 through an incompressible fluid inlet 50*a* (which may be referred to as a water inlet 50*a*) into the ignition chamber 26*a* from a source of water 41, which is not shown. The controller 40 controls the top-off valve 50 in order to fill the ignition chamber interior 45 to a selected fill level.

To achieve a precise fill level, a selected volume of water 41 may be stored in a hydraulic cylinder (not shown). Actuation of the cylinder (ie. movement of the cylinder's piston to an advanced position) pushes the water 41 from the cylinder into the ignition chamber 26*a*. The controller 40 preferably loads and actuates the cylinder.

The top-off valve 50 may be configured to have a relatively small opening through which water 41 enters the ignition chamber 26*a* in order to protect the components of the valve 50 that would be exposed to the conditions during ignition in the ignition chamber 26*a*. The small opening, however, makes for a relatively long fill time for filling the ignition chamber 26*a* to the selected fill level with top-off water 41. The valves 48 and 49 may also have small opening, however, the fill time for the combustibles 47 is shorter than that of the water 41, because the combustibles 47 are gases.

The ignition chamber 26*a* preferably includes an exhaust valve 51 (FIG. 4*a*) that controls the flow of exhaust gases out of the ignition chamber 26*a* through an exhaust gas outlet 51*a*. The exhaust valve 51 is preferably controlled by the controller 40.

A selected amount of non-combustible gas, such as Nitrogen, may be transferable into the ignition chamber 26 by any suitable means, such as through the water top-off valve 50. The transfer of Nitrogen into the ignition chamber 26*a* may be used to flush whatever gas is present after the explosion in the ignition chamber 26*a* out of the ignition chamber 26*a* before the die 32 is opened.

The ignition chamber 26*a* further includes an igniter 52 that is configured to ignite the combustibles 47. The igniter 52 may be any suitable type of igniter, such as an igniter that generates an energy beam, as described in PCT publication WO2008/017332 (Applicant: Cosma Engineering Europe AG), the contents of which are hereby incorporated by reference, or an igniter that ignites by induction as described in PCT publication WO2008/017444 (Applicant: Cosma Engineering Europe AG), the contents of which are hereby incorporated by reference. The operation of the igniter 52 may be controlled by the controller 40.

Referring to FIG. 4*a*, the combustible filling valves 48 and 49, the water top-off valve 50 (FIG. 4*a*), the exhaust valve 51, and the igniter 52 may all be positioned in the ignition chamber head 53*b* at the upper end of the ignition chamber 26*a*.

Referring to FIG. 3, to generate the shock wave 42, the ignition chamber interior 45 is preferably configured to be generally cylindrical and has a selected relationship between its diameter, shown at Dic, its length (above the fill level of the water 41), shown at Lic, and the pressure generated by ignition of the combustibles 47. For example, the length Lic of the ignition chamber interior 45 above the fill level of the water 41 is preferably approximately 30 times the diameter Dic of the ignition chamber interior 45 at a filling pressure of about 20 bar. As the filling pressure increases, the length necessary to form a stable shock wave 42 decreases. Tests have been conducted using an ignition chamber 26 having an interior 45 with a diameter Dic of 50 mm diameter, and stable shock waves 42 were achieved in a length of about 50 cm at a filling pressure of 20 bar, and in a length of about 20 cm at a filling pressure of about 120 bar.

There are several considerations that impact the length of the ignition chamber 26*a*. When the shock wave 42 travels from the gas in the ignition chamber 26*a* into the water 41, a small portion of the shock wave 42 is reflected back upwards. It is advantageous to have a relatively long ignition chamber 26 in order to dampen the reflection of the shock wave 42 as much as possible before it encounters the valves 48, 49, 50 and 51 and the igniter 52 in the ignition chamber head 53*b*. Thus, in an effort to protect the valves 48, 49, 50, 51 (FIG. 4*a*) and the igniter 52 (FIG. 4*b*), it is advantageous to have a relatively long ignition chamber 26. However, in an effort to reduce the amount of gas consumed in each combustion cycle, it is advantageous to have a relatively short ignition chamber 26. Reducing the amount of gas consumed reduces the cost associated with the gas, and also reduces the amount of time needed to fill the ignition chamber 26*a* with combustibles 47. Thus, several competing issues may be considered when selecting the length of the ignition chamber 26*a*. Referring to FIG. 3, in the illustrated embodiment, the ignition chamber interior 45 has a length Lic of about 1.5 m above the fill level for the water 41, with a diameter Dic of 50 mm.

Referring to FIG. 4*b*, the ignition chamber interior 45 may be generally smooth-walled so as to be substantially free of surfaces that may generate reflections of the shock wave 42 (FIG. 3), which can reduce the energy associated with the shock wave 42 itself, and which can damage components such as the valves 48, 49, 50 and 51 (FIG. 4*a*) and the igniter 52 (FIG. 4*b*), or otherwise erode the walls of the ignition chamber 26*a* over time.

The ignition chamber wall 46 preferably includes cooling conduits 57 therein which transport cooling fluid (eg. water, or a refrigerant) through the wall 46 to cool the ignition chamber 26*a* as necessary during use of the apparatus 10. The cooling conduits 57 may be connected to a temperature control system (not shown) supervised by the controller 40 in a closed loop manner as known in the art per se.

One of the hallmarks of a production quality explosion forming system is the ability to rapidly produce parts of consistent quality. To do that, the explosion and the pressure generated by the system should be held relatively constant on every run or execution. The temperature control system can play an important role in achieving rapidly repeatable and stable explosions required to maximize part production rates. To achieve consistent results the controller 40 coupled with suitable sensors provides the correct ratio and pre-determined mass of combustibles to generate the explosion. The available volume in the ignition chamber for the combustibles is preferably controlled through the ingress of a consistently repeatable pre-determined volume of water into the ignition chamber as discussed above. And the controller preferably ignites the combustibles, particularly when the preferred stoichiometric mixture of hydrogen and oxygen is employed, as soon as the pre-determined mass of combustibles is transferred into the ignition chamber in order to minimize any propensity of the combustibles to separate. However, the pressure of the combustibles into the ignition chamber is not a well controlled quantity since it depends on the surrounding temperature. As discussed in greater detail below it was discovered that changes in the pressure of the combustibles can have a material effect on the nature of the pressure wave or shock wave produced. Furthermore, it was also discovered that, as an independent variable, the temperature of the combustibles can play a role in the quality of the explosion. For example, for the preferred stoichiometric mixture of hydrogen and oxygen, it was difficult to achieve stable explosions when the temperature was too low, e.g., below 5 degrees C. or more preferably below 20 degrees C., or too high, e.g., above 150 degrees C. or more preferably above 100 C. By controlling the temperature of the ignition chamber, however, many of these problems can be avoided or minimized in order to provide consistent, rapidly repeated explosions and pressure wave or shock wave profiles.

Other benefits provided by cooling the ignition chamber 26*a* are discussed further below.

The ignition chamber 26*a* has an opening 54 at its bottom, shown at 55. The opening 54 may be referred to as a pressure outlet, because it is through this opening 54 that pressure (eg. the shock wave 42) in the ignition chamber 26*a* is transmitted outwards towards the work piece 12*a*.

Figure 4D:
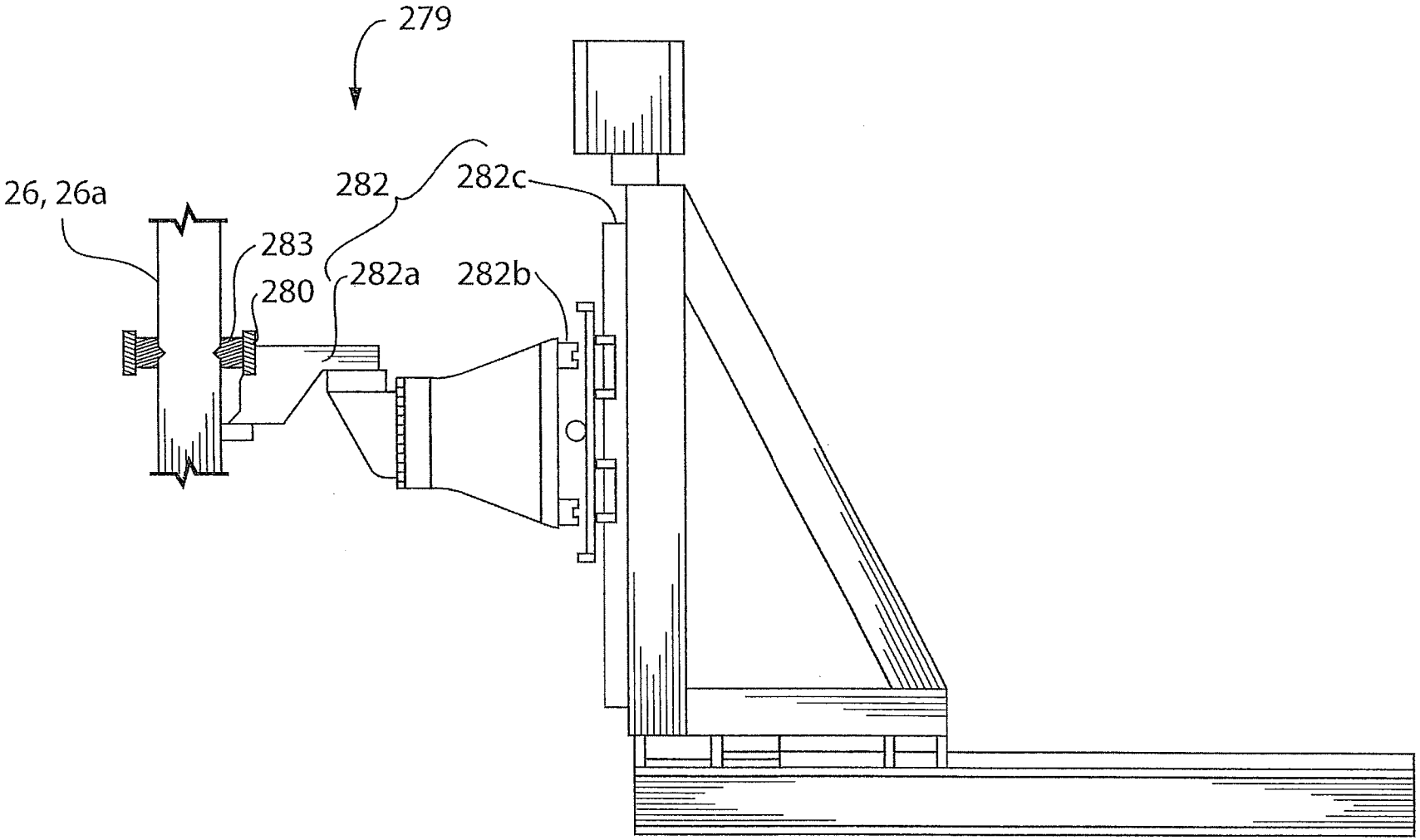
FIG. 4*d* is an elevation view of a portion of the ignition chamber shown in FIG. 4*a*, illustrating the mounting of the ignition chamber.

Referring to FIG. 4*d*, the ignition chamber 26*a* is supported on an ignition chamber support 279 that includes a clamp 280 and a support base 282. The support base 282 is made up of a first base portion 282*a*, a second base portion 282*b* and a third base portion 282*c*. The first, second and third base portions 282*a*, 282*b* and 282*c* cooperate to permit horizontal movement of the ignition chamber 26*a* out of the way so that the die 32 that is beneath the ignition chamber 26*a* can be hoisted out of the apparatus 10 via an overhead crane (not shown) and another die 32 can be lowered into the apparatus 10 in its place. The base portions 282*a*, 282*b* and 282*c* further cooperate to permit vertical adjustment of the ignition chamber 26*a* to accommodate dies 32 of different heights, so as to permit operation with work pieces 12*a* having different lengths. The base portions 282*a*, 282*b* and 282*c* further cooperate to permit rotation of the ignition chamber 26*a* about a horizontal axis.

The clamp 280 clamps the ignition chamber 26*a* through a resilient gasket 283. The gasket 283 may engage a notch in the ignition chamber 26*a* to prevent the ignition chamber 26*a* from slipping vertically in the clamp 280. The presence of the gasket 283 inhibits the transfer of explosion energy from the ignition chamber 26*a* to the rest of the apparatus 10, and also permits the ignition chamber 26*a* to reciprocate during insertion and withdrawal of the transfer structure 30*a* into and out of the work piece 12*a* as described further below.

Referring to FIG. 1, the transfer structure 30*a* fluidly connects the ignition chamber 26*a* to the work piece 12*a* in the die 32. The transfer structure 30*a* includes an isolation valve 58 and a transfer conduit 59.

Figure 5A:
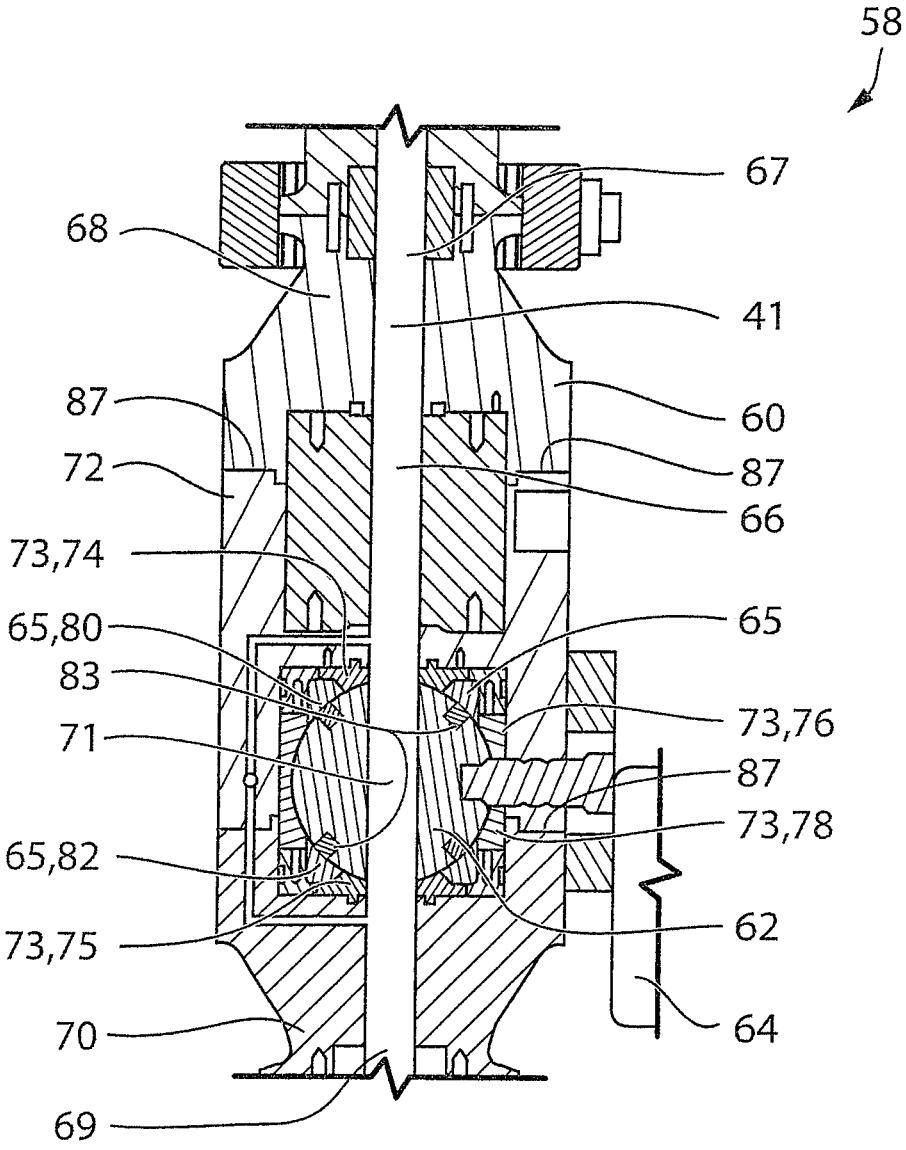
FIG. 5*a* is a sectional elevation view of an isolation valve shown in FIG. 1, for isolating the ignition chamber shown in FIG. 4*a*, in an open position.

The isolation valve 58 preferably isolates the ignition chamber 26*a* as discussed above. The isolation valve 58 may be positionable in an open position (shown in FIGS. 1 and 5*a*) where the ignition chamber 26*a* is fluidly connected to the work piece 12*a*, and a closed position (FIG. 5*b*) where the ignition chamber 26*a* (FIG. 1) is isolated from the die 32. Referring to FIG. 5*a*, the isolation valve 58 may have any suitable structure. For example, the isolation valve 58 may include a valve body 60, a flow control member, such as a ball 62 that is rotatable within the body 60, an actuator 64 connected to the ball 62, and a seal structure 65 for sealing between the ball 62 and the valve body 60. The isolation valve 58 has a fluid passage 66 extending between a first valve opening 67 (which may be referred to as a pressure inlet) at a first end 68, and a second valve opening 69 (which may be referred to as a pressure outlet) at a second end 70.

The ball 62 has a pass-through aperture 71 therethrough which may be referred to as a ball aperture. The ball 62 is rotatable by the actuator 64 between an open position (FIG. 5*a*) wherein the ball aperture 71 is fluidly connected to the first and second valve openings 67 and 69, and a closed position (FIG. 5*b*) wherein the ball aperture 71 is fluidly disconnected from the first and second openings 67 and 69. The ball 62 may be made from any suitable material, such as stainless steel.

The valve body 60 preferably comprises a main body portion 72 and a plurality of replaceable valve body members 73 mounted on the main body portion 72. The replaceable valve body members 73 include top and bottom spacer rings 74 and 75, circumferential seating elements 76 and 78 and corner members 79*a* and 79*b*. There may be a gap of about 0.1 mm between each of the top and bottom spacer rings 74 and 75 and the ball 62. The replaceable valve body members 73 may be made from any suitable material such as stainless steel.

The seal structure 65 seals between the valve body 60 and the ball 62, and may have any suitable structure. In the illustrated embodiment the seal structure 65 includes top and bottom ring-shaped seal members 80 and 82, which may be referred to as seal rings, mounted to the valve body 60, and a plurality of seal members 83 on the ball 62. The seal rings 80 and 82 are preferably made from a relatively softer material than the ball 62, such as bronze in order to avoid scoring the ball 62.

The seal rings 80 and 82 are largely blocked from exposure to the fluid passage 66 by the top and bottom spacer rings 74 and 75. As a result, the holding members 74 and 75 protect the relatively soft seal rings 80 and 82 from damage by the shock wave 42 passing through the valve fluid passage 66. If some portion of the shock wave 42 enters the gap between one of the spacer rings 74 and 75 and the ball 62 and travels towards a seal ring 80 or 82, its capacity to damage the seal ring 80 or 82 would be significantly diminished as it traveled because of the small size of the gap.

The seal members 83 preferably include one or more o-rings, and one or more C-shaped seal members in grooves on the surface of the ball 62. These seal members 83 engage the spacer rings 74 and 75 and the seal rings 80 and 82 when the valve 58 is in the open position, so as to provide additional sealing performance against leakage at the pressures incurred when pressure from an explosion in the ignition chamber 26*a* is transmitted to the work piece 12*a*.

Figure 5B:
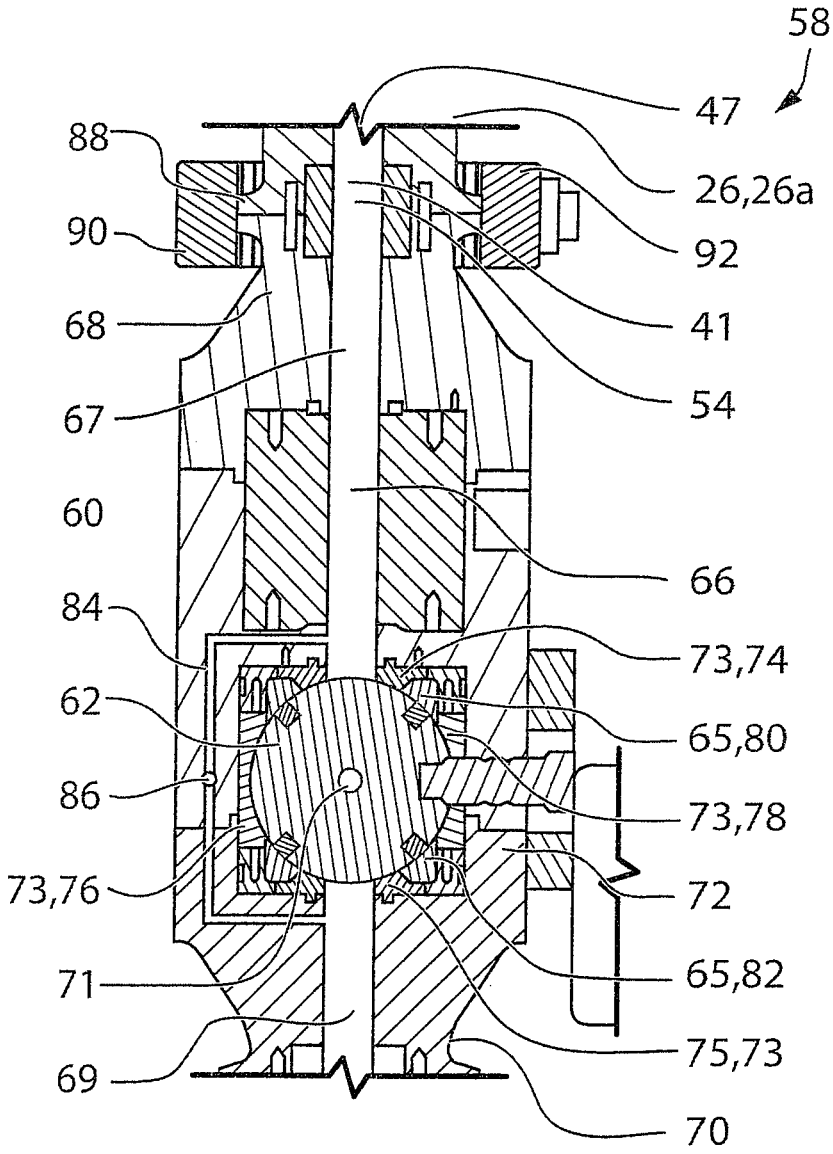
FIG. 5*b* is a sectional elevation view of the isolation valve shown in FIG. 5*a*, in a closed position.

Referring to FIG. 5*b*, when the isolation valve 58 is in the closed position and the ignition chamber 26*a* is being filled with water 41 and with combustibles 47, the pressure in the ignition chamber 26*a* pushes the ball 62 down against the bottom seal ring 82, providing a greater degree of engagement between them. This increases the sealing performance provided by the isolation valve 58. Additionally, it will be noted that water 41 may be transferred into the ignition chamber 26*a* prior to filling with combustibles 47. In this way, the water 41 acts as a barrier preventing contact between the combustibles 47 and the isolation valve 58. As a result, the seal rings 80 and 82 in the isolation valve 58 act against the leakage of liquid (ie. the water 41), which is easier than acting against the leakage of gas.

When the ignition chamber 26*a* has been filled to the desired pressure and the ball 62 is pushed downwards by the pressure, the force required to rotate the ball 62 to its open position is relatively high. To reduce the force required to rotate the ball 62 after the ignition chamber 26*a* has been filled to the desired pressure, a bypass conduit shown at 84 and a bypass valve 86, which can be used to equalize the pressure upstream and downstream from the ball 62. The bypass conduit 84 is connected at one end to a point 84*a* upstream from the ball 62 (eg. to a point fluidly between the ball 62 and the pressure inlet 67), and at another end to a point 84*b* downstream from the ball 62 (eg. to a point fluidly between the ball 62 and the pressure outlet 69).

The cross-sectional area of the bypass conduit 84 is smaller than the cross-sectional area of the valve fluid conduit 66 at the pressure inlet 67, and as a result, the bypass valve 86 is smaller than the isolation valve 58 and thus requires less energy to move while experiencing a high differential pressure. The bypass valve may be any suitable type of valve, such as, for example, a needle valve.

The bypass valve 86 is movable to selectively permit fluid communication between the upstream point 84*a* and the downstream point 84*b* so that the pressures upstream and downstream from the ball 62 equalize. Once the pressures have equalized, the ball 62 is no longer pushed downwards against the holding member 75 and the second seal member 82 and is thus easier to rotate to the open position.

It is optionally possible to provide a mechanism for selectively moving one or both the sealing members 80 and/or 82 into greater or lesser engagement with the ball 62, thereby controlling the degree of force that is required to rotate the ball 62. Such a mechanism could optionally be used instead of the bypass conduit 84 and needle valve 86.

Additional sealing takes place at other places in the isolation valve 58 through the use of sealing members 87 such as o-rings, between valve body elements.

The isolation valve 58 is connected to the ignition chamber 26*a* such that the top valve opening 67 is fluidly connected to the ignition chamber opening 54 (FIG. 5*a*). The connection between the isolation valve 58 and the ignition chamber 26*a* may be by any suitable means. For example, flanges 88 and 90 may be provided at the ignition chamber opening 54 and at the top valve opening 67 respectively, and a flange clamp 92 may be provided to hold the flanges 88 and 90 together. A gasket (not shown) may be provided between the flanges 88 and 90. The flange clamp 92 permits the isolation valve 58 and the ignition chamber 26*a* to be separated as desired for maintenance or component replacement purposes.

Another purpose of the isolation valve 58 is that it can be used as part of a system to quickly fill the apparatus 10 to a selected level with water 41. It is beneficial to have a consistent, predictable water fill level in the apparatus 10, since the water fill level directly impacts such parameters as the amount of space in the apparatus for the combustibles, the amount of travel of the shock wave in gas prior to the gas/water interface. When the valve 58 is closed, water 41 can be introduced at a high flow rate into the apparatus 10 and can fill the apparatus 10 fully up to the ball 62 in the valve 58. A drain conduit shown at 93 may be provided at the level of the ball 62. The drain conduit 93 permits air to exhaust from the apparatus 10 during the filling of the apparatus 10 with water 41. A suitable sensor shown at 93*a* on the drain conduit 93 can be provided to sense the presence of water 41, which indicates to the controller 40 that the apparatus 10 has been filled with water 41 up to the ball 62. A drain valve 93*b* on the drain conduit 93 is movable from an open position that permits air and water flow out of the apparatus 10 during the filling of the apparatus 10 with water 41, to a closed position wherein air and water flow out of the apparatus is prevented when the sensor 93*a* senses the presence of water 41. By providing the isolation valve 58, the drain conduit 93, the sensor 93*a* and the drain valve 93*b*, the apparatus 10 can be filled at a high flow rate through the water valve 39*a*, thereby providing a consistent water fill level in a relatively short fill time.

Another advantage of providing the isolation valve 58 is that it permits the ignition chamber 26 to be filled with combustibles 47 independent of other actions that are carried out by the apparatus 10 prior to generating an explosion. As a result, there can be overlap between the filling of the ignition chamber 26*a* with combustibles 47 and other actions carried out by the apparatus 10, such as, for example, movement of the transfer mechanism 39 (FIG. 8*a*), closing of the die 32, and filling the work piece 12*a* and the transfer conduit 59 with water 41. Filling the ignition chamber 26*a* with combustibles 47 can take a relatively long time. Permitting overlap between the filling of the ignition chamber 26*a* and other actions that would otherwise be carried out prior to filling of the ignition chamber 26*a* with combustibles 47 provides a reduction in the overall cycle time taken by the apparatus 10 to modify the first and second work pieces 12.

Figure 6A:
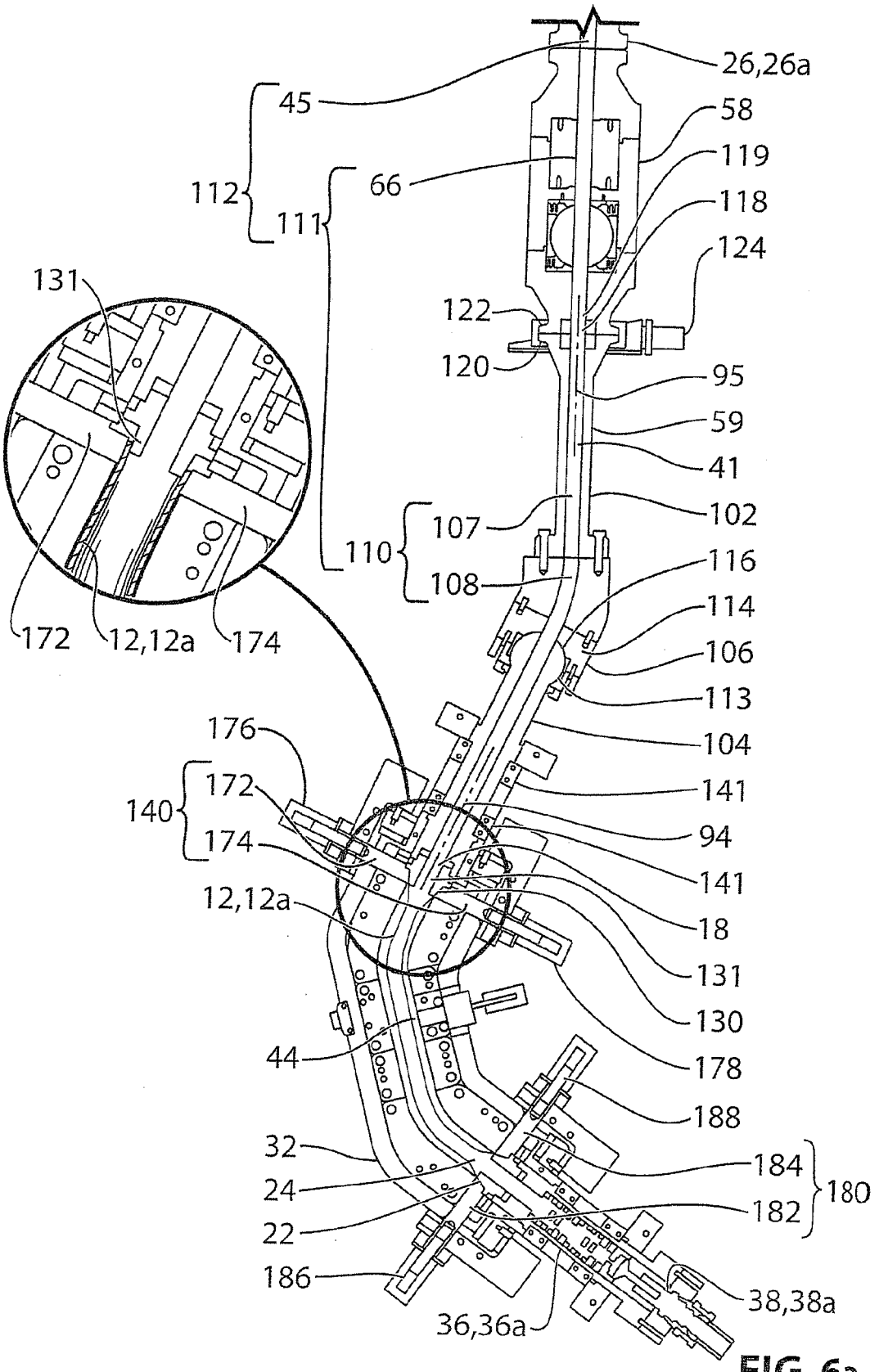
FIG. 6*a* is a sectional elevation view of a portion of the apparatus shown in FIG. 1, showing a transfer conduit and a pressure reducer inserted into a work piece.

The transfer conduit 59 fluidly connects the isolation valve 58 and the work piece 12*a*. Referring to FIG. 6*a*, as a result of the shape of the work piece 12*a*, the orientation of the work piece 12*a* when held in the die 32 may be selected to ensure that all the water 41 (FIG. 1) that is in the work piece 12*a* drains out of the work piece 12*a* under gravity when the work piece 12*a* is ready to be ejected from the die 32. Depending on the selected orientation of the work piece 12*a* the first opening 20 of the work piece 12*a* may be oriented about a first opening axis 94 that is aparallel with respect to the axis shown at 95 about which the second opening 69 of the isolation valve 58 is oriented.

In order to deal with the non-parallel axes the transfer conduit 59 preferably includes a first, or upstream transfer conduit portion 102 that is oriented about the axis 95, a second, or downstream transfer conduit portion 104 that is oriented about the axis 94, and a flex joint 106 therebetween.

The first transfer conduit portion 102 has a fluid passage 107 therein. The second transfer conduit portion 104 has a fluid passage 108 therein. The fluid passages 107 and 108 make up a transfer conduit fluid passage 110. The transfer conduit fluid passage 110 combined with the valve fluid passage 66 together make up a transfer structure fluid passage 111. Referring to FIG. 1, in embodiments wherein the ignition chamber 26 is configured to generate a shock wave 42, the ignition chamber interior 45 and the transfer structure fluid passage 111 make up a pre-work piece shock wave flow path 112 that is substantially free of reflection elements. The pre-work piece shock wave flow path 112 preferably has a substantially constant cross-sectional size and a substantially constant cross-sectional shape. The pre-work piece shock wave flow path 112 is preferably generally circular in cross-section. These features of the pre-work piece shock wave flow path 112 inhibit degradation of the shock wave 42 as it travels to the work piece 12*a*.

On the first transfer conduit portion 102, the transfer conduit 59 has a first end 118 at which there is a first opening 119 into the transfer conduit fluid passage 110. The transfer conduit 59 may have a flange 120 on its first end 118, which mates with a flange 122 on the second end 70 of the isolation valve 58. A flange clamp 124 may be used to hold the flanges 120 and 122 together. As a result of being fixedly connected to the isolation valve, which is itself fixedly connected to the ignition chamber 26*a*, the first transfer conduit portion 102 is thus considered to be fixedly connected with respect to the ignition chamber 26*a*.

On the second transfer conduit portion 104, the transfer conduit 59 has a second or downstream end 130 at which there is a second opening 131 into the transfer conduit fluid passage 110. The downstream end 130 of the transfer conduit 59 may be generally conical.

Figure 6B:
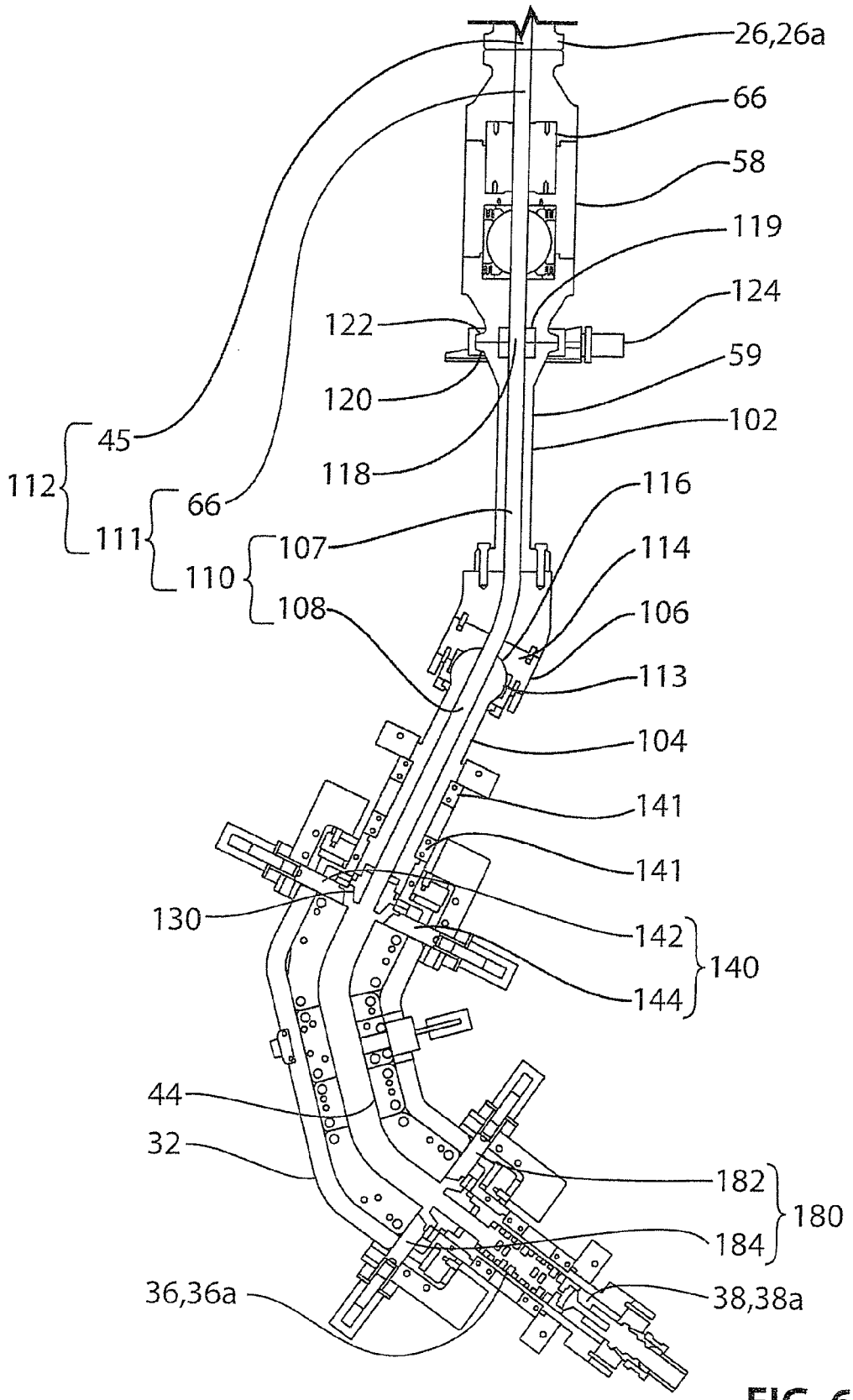
FIG. 6*b* is a sectional elevation view of the portion of the apparatus shown in FIG. 5*a*, showing the transfer conduit and the pressure reducer withdrawn from the work piece.

Referring to FIGS. 6*a* and 6*b*, the second transfer conduit portion 104 is movable between an advanced position (FIG. 6*a*) wherein the second transfer conduit portion 104 is inserted into the first opening 20 of the first work piece 12 to form a sealed fluid connection therebetween, and a retracted position wherein the downstream end 130 of the transfer conduit 59 is retracted from the work piece 12*a* to permit ejection of the work piece 12*a* from the die cavity 44.

The flex joint 106 permits rotation of the second conduit portion 104 relative to the first conduit portion 102 so that the angle therebetween can be adjusted. The flex joint 106 may be any suitable type of joint, such as, for example, a ball-and-socket joint, made up of a spherical member 113 (ie. the 'ball') on the second transfer conduit portion 104, and a sphere-receiving member 114 (ie. the 'socket') on the first transfer conduit portion 102. The spherical member 113 may have thereon a plurality of seal members 116, such as o-rings and C-shaped seal members which cooperate with the sphere-receiving member 114 to form a seal to inhibit leakage of inhibit leakage of water 41 therepast.

The second transfer conduit portion 104 is slidable within the guide members shown at 141, and is thus slidably connected to the die 32, for movement along a linear path between the advanced and retracted positions. As noted above, however, the first transfer conduit portion 102 may be fixedly connected with respect to the ignition chamber 26*a*, and the ignition chamber 26*a* is mounted on the ignition chamber support 279 (FIG. 4*d*). To accommodate the linear movement of the second transfer conduit portion 104, the flex joint 106 permits the first and second transfer conduit portions 102 and 104 to rotate relative to each other as needed, and the ignition chamber support 279 shown in FIG. 4*d* (in particular the resilient bushing 280) permits whatever translation and rotation are needed by the ignition chamber 26*a* to accommodate the linear movement of the second transfer conduit portion 104.

In embodiments wherein the work piece 12 has a first opening 20 that is oriented about a vertical axis (not shown in FIG. 6*a*), it is optionally possible for the transfer conduit 59 to omit the flex joint 106 (and to extend directly vertically along its entire length), and for the movement of the transfer conduit 59 to take place along a vertical axis, which would, in turn, drive the ignition chamber 26*a* to move upwards and downwards in the resilient bushing 280 (FIG. 4*d*) on the ignition chamber support 279. However, providing the flex joint 106 permits the apparatus 10 to accommodate work pieces 12 that have a first opening 20 that is oriented about a non-vertical axis, or about an axis that is a parallel to the axis about which the opening 54 of the ignition chamber 26*a*.

Referring to FIG. 4*a*, the fluid-carrying conduits (not shown) that lead to the valves 48, 49, 50 and 51 and to any other component of the ignition chamber 26*a* are configured to accommodate the movement of the ignition chamber 26*a* when the second transfer conduit portion 104 moves between the advanced and retracted positions.

Referring to FIG. 6*a*, when the downstream end 130 of the transfer conduit 59 is inserted into the first opening 20 of the work piece 12*a*, the downstream end 130 pinches the first end 18 of the work piece 12*a* against a collar 140, thereby flaring the first end 18 of the work piece 12*a* and providing it with a generally conical shape. (The flaring of the work piece is exaggerated in FIG. 6*a*.) As the downstream end 130 of the transfer conduit 59 continues to be urged into the first end 18 of the work piece 12*a* the mating conical ends 130 and 18 sealingly engage each other sufficiently well that they will not leak when the work piece 12*a* and the transfer conduit 59 are filled with water 41 and the combustibles 47 (FIG. 1) in the ignition chamber 26*a* are ignited.

It will be noted that the flow passages 107 and 108 in the first and second transfer conduit portions 102 and 104 need not be aligned with each other when the second transfer conduit portion 104 is in the retracted position (FIG. 6*b*). However, the flow passages 107 and 108 in the first and second transfer conduit portions 102 and 104 are aligned with each other when the second transfer conduit portion 104 is in the advanced position (FIG. 6*a*).

It will be noted that the isolation valve 58 may optionally be omitted from the transfer structure 30*a*. In such an embodiment, the first transfer conduit 59 may make up the transfer structure 30*a* and may be directly connected to the ignition chamber 26*a*. While the omission of the isolation valve 58 may mean that the filling of the ignition chamber 26*a* with combustibles would not begin until the die 32 is closed and in some embodiments might not begin until water 41 is filled to its selected fill level if certain components are configured to seal against liquid leakage but would not seal against gas leakage.

When it is desired to change out the die 32 on the apparatus 10 for a different die 32, (eg. to make a different product) it may be advantageous to disconnect the transfer conduit 59 from the isolation valve 58 and to leave the transfer conduit 59 connected to the die 32. One reason is that it may be relatively easier to separate the transfer conduit 59 from the isolation valve 58 (eg. by opening the flange clamp 124), than to remove the transfer conduit 59 from the guide members 141 in the die 32. To further facilitate the changeover from one die 32 to another, the flange clamp 124 may be remotely openable and closable.

Figure 7:
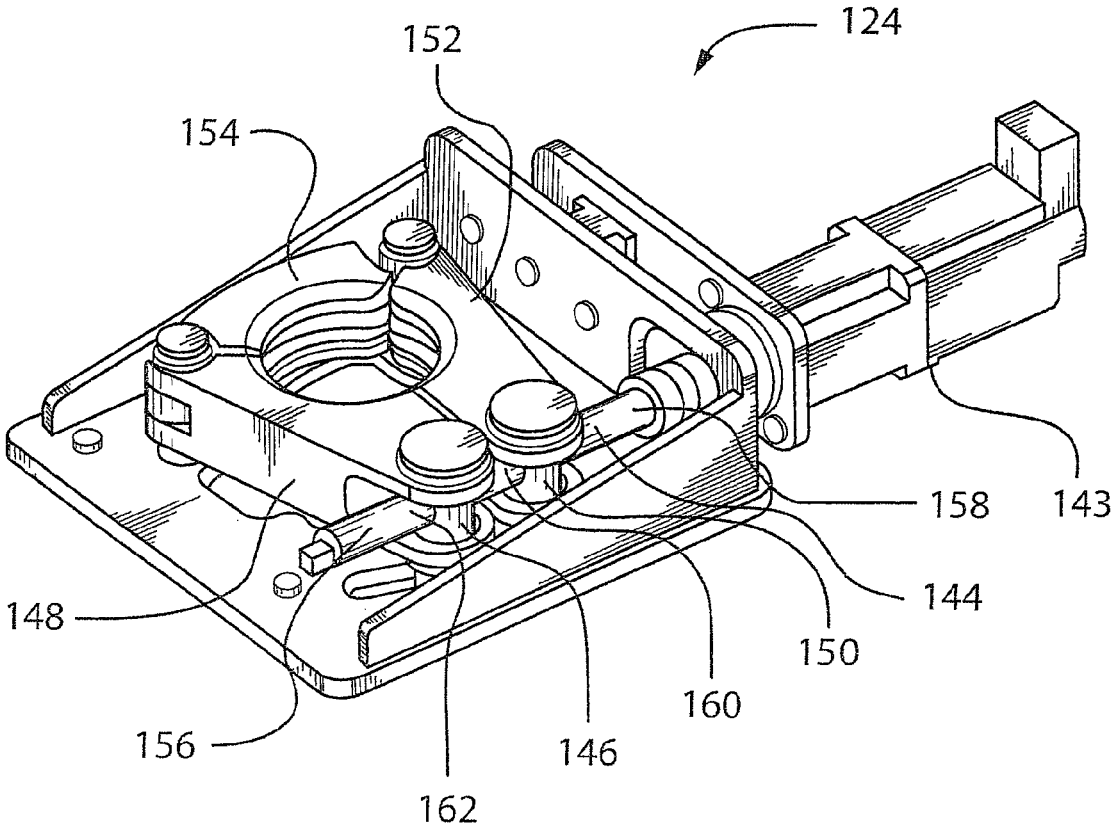
FIG. 7 is a perspective view of a flange clamp shown in FIG. 1 and used to clamp the valve shown in FIG. 5*a* with the transfer conduit shown in FIG. 6*a;*

Referring to FIG. 7, the flange clamp 124 may include a motor 143, such as a servomotor, a threaded output member 144, a first follower 146 rotatably mounted on a first clamp arm 148, a second follower 150 rotatably mounted on a second clamp arm 152, and optionally a clamp base portion 154 which is pivotably mounted to both the first and second clamp arms 148 and 152. The threaded output member 144 may have thereon a first threaded section 156 that has a first thread orientation, and a second threaded section 158 that has a second, opposing thread orientation. The first follower 146 has a first threaded aperture 160 through which the first threaded section 156 passes. The second follower 150 has a second threaded aperture 162 through which the second threaded section passes. As a result, when the threaded output member 144 is rotated in a first rotational direction by the motor 143, the first and second followers 146 and 150 travel towards each other to a closed position for clamping the flanges 116 and 118 (FIG. 1). When the threaded output member 144 is rotated in a second rotational direction by the motor 143, the first and second followers 146 and 150 travel away from each other to an open position to permit the separation of the isolation valve 58 from the transfer conduit 59. During the movement of the first and second followers 146 and 150 towards and away from each other, the first and second followers 146 and 150 swivel relative to the clamp arms 148 and 152.

As the first and second followers 146 and 150 drive the clamp arms 148 and 152 open and closed, the pivoting movement of the clamp arms 148 and 152 in turn drives the followers 146 and 150 along an arcuate path relative to the flange clamp base, shown at 153. Thus, the movement of the followers 146 and 150 includes some lateral shifting in addition to the longitudinal movement along the axis of the output member 144. To accommodate the lateral shifting of the followers 146 and 150, the motor 143 may be slidably mounted relative to the flange clamp base 153 so that the motor 143 and the output member 144 shift laterally along with the followers 146 and 150. Operation of the motor 143 may be controlled by the controller 40.

Figure 8A:
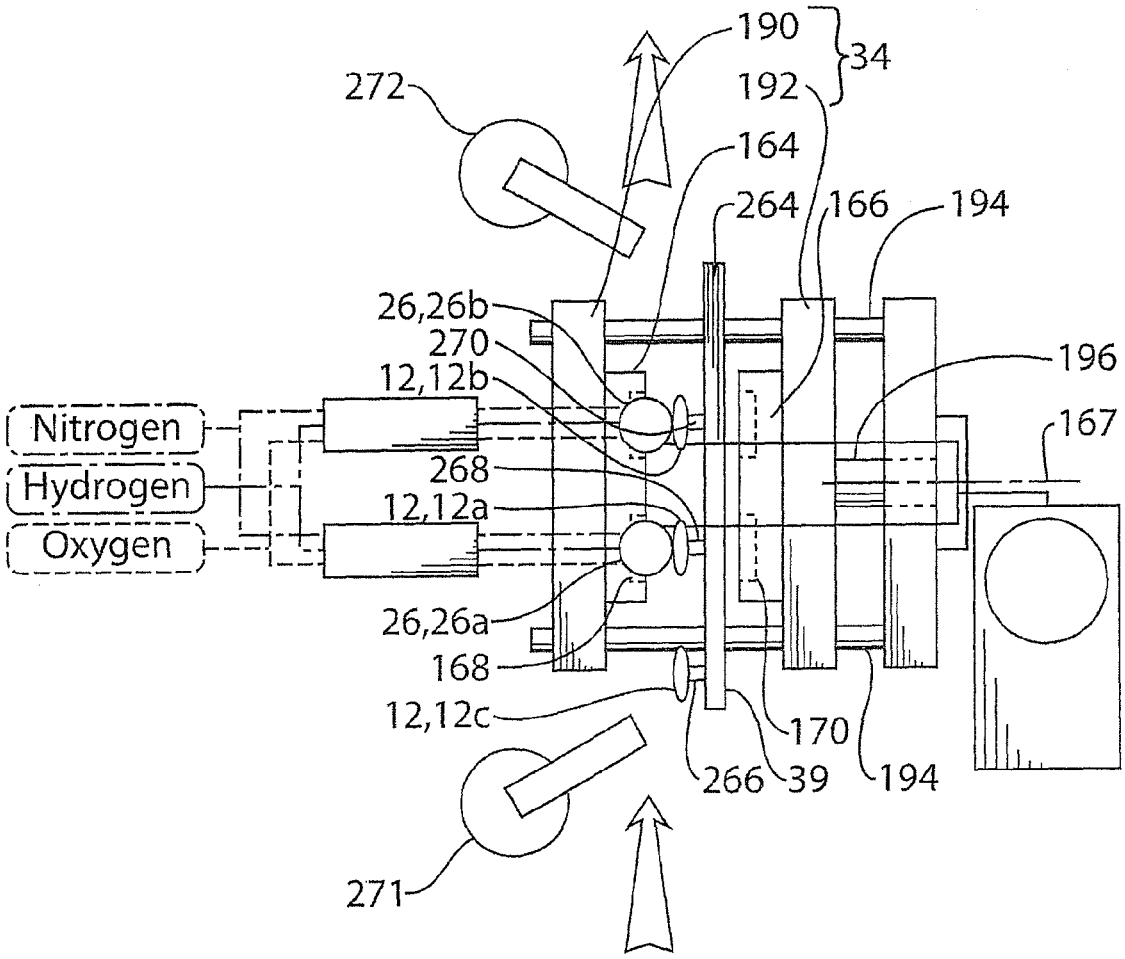
FIG. 8*a* is a top plan view of the apparatus shown in FIG. 1, showing a work piece transfer mechanism in a receiving position.

Referring to FIG. 8*a*, the die 32 includes a first die plate 164 and a second die plate 166. The first die plate 164 has therein a first die cavity portion 168, and the second die plate 166 has therein a second die cavity portion 170.

Figure 8B:
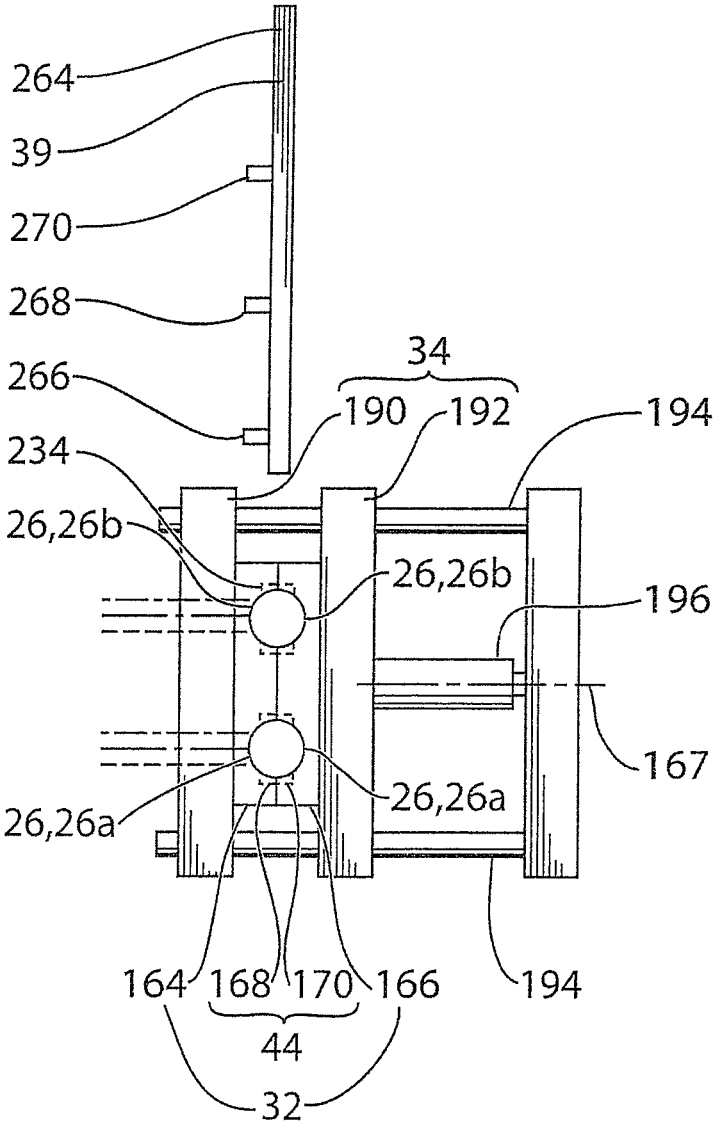
FIG. 8*b* is a top plan view of the apparatus shown in FIG. 1, showing the work piece transfer mechanism in a retracted position.

The first and second die plates 164 and 166 are positionable in an open position (FIG. 8*a*) and in a closed position (FIG. 8*b*). In the embodiment shown in FIGS. 8*a* and 8*b* the first die plate 164 is stationary, and the second die plate 166 is movable by the die press 34 to provide the open and closed positions for the die 32. The axis along which the second die plate 166 moves may be referred to as a die plate movement axis and is shown at 167.

The first die plate 164 has therein a first die cavity portion 168 therein, and the second die plate 166 has therein a second die cavity portion 170. Together the die cavity portions 168 and 170 define the die cavity 44 (FIG. 8*b*).

Referring to FIG. 6*a*, the first die plate 164 further includes the collar 140 that holds the first end 18 of the work piece 12*a*. The collar 140 may be referred to as the first end collar. The first end collar 140 is made up of a first collar portion 172 and a second collar portion 174. The first and second collar portions 172 and 174 are movable between a closed position (FIG. 6*a*) and an open position (FIG. 6*b*) by first and second cylinders 176 and 178 (which may be either pneumatically or hydraulically actuated).

The first die plate 164 further includes a second end collar 180 which is positioned to hold the second end 22 of the work piece 12*a*. The second collar 180 may be similar in structure to the first collar 140 and may be made up of a first collar portion 182 and a second collar portion 184 which are movable between a closed position (FIG. 6*a*) and an open position (FIG. 6*b*) by first and second cylinders 186 and 188 (which may be either pneumatically or hydraulically actuated).

Referring to FIG. 8*a*, the die press 34 may have any suitable structure. For example, the die press 34 may include a first die press plate 190 on which the first die plate 164 is removably mounted, a second die press plate 192 on which the second die plate is removably mounted, a plurality of guide tubes 194 on which the second die press plate 192 slides towards and away from the first die press plate 190 along the die plate movement axis 167, and a hydraulic cylinder 196 which is connected between a stationary member and the second die press plate 192 to move the second die press plate 192 along the die plate movement axis 167.

When the first and second die plates 164 and 166 are in the closed position (FIG. 9) the first and second die cavity portions 168 and 170 mate together to form the first die cavity 44, and the first and second collars 140 and 180 are closed around the first and second ends 18 and 22 of the work piece 12*a* to hold the work piece 12*a* in position in the die cavity 44. Additionally, the second transfer conduit portion 104 is driven into the work piece 12*a* optionally by way of a mechanical connection to the die press 34, (eg. by means of cams, gears, and other mechanical elements). In the embodiment shown in FIG. 9, the die cavity 44 is a forming cavity, and is configured to be larger than the work piece 12*a* so that when combustibles 47 are ignited in the ignition chamber 26*a*, the work piece 12*a* is pressurized (eg. by the shock wave 42) and expands to conform to the shape of the die cavity 44.

Figure 11:
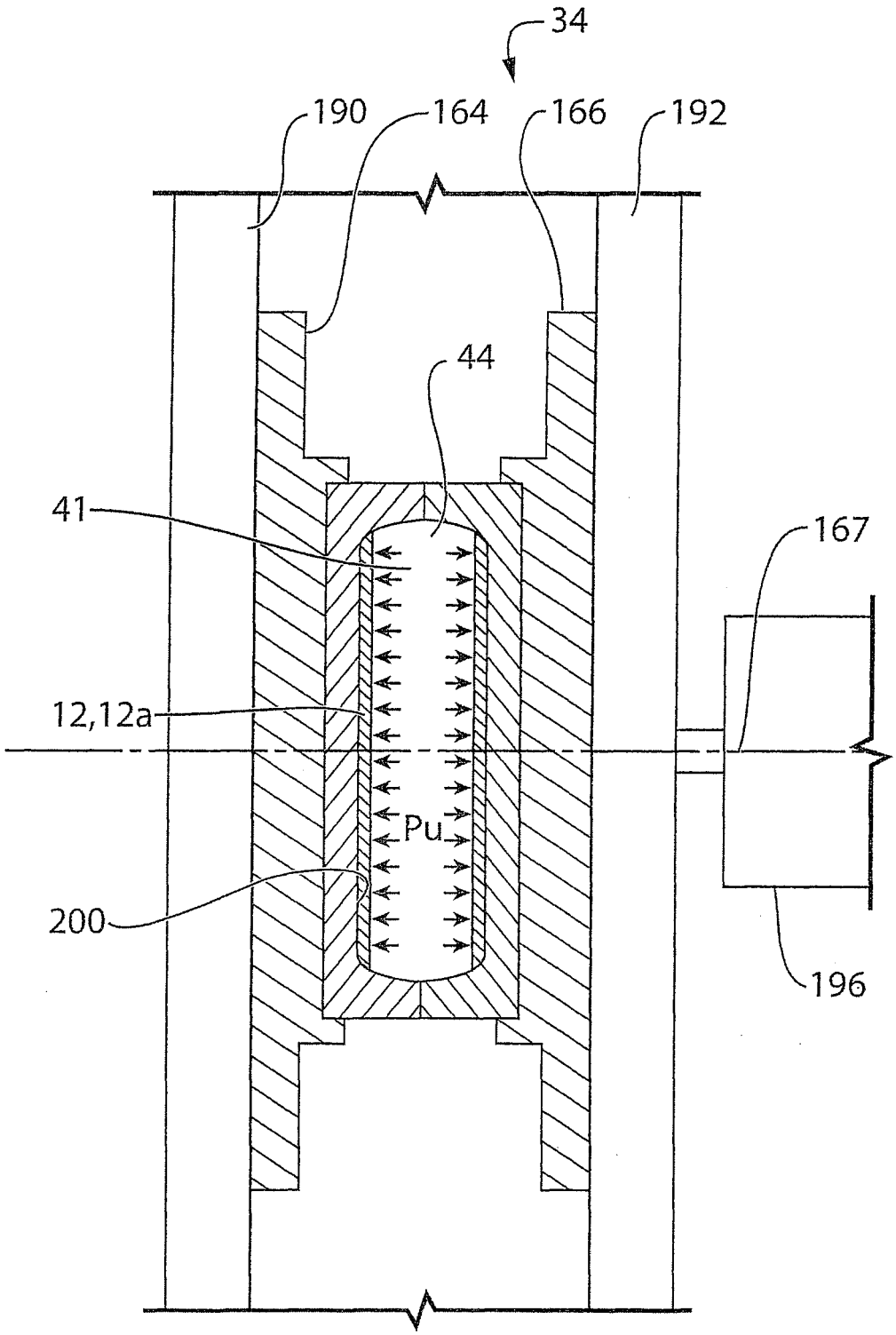
FIG. 11 is a sectional elevation view of the first and second die plates shown in FIGS. 9 and 10 wherein pressure is used to modify a work piece without forming a shock wave.

Referring to FIG. 11, as the work piece 12*a* expands and contacts the die cavity wall, shown at 200, the pressure in the work piece 12*a* is transferred to the die plates 164 and 166 urging them apart. In embodiments wherein the explosion pressure in the ignition chamber 26*a* is not transferred into the water 41 as a shock wave, the pressure in the water 41 along the entire length of the work piece 12*a* is uniform. Thus, the entire work piece 12 expands at the same time and applies a uniform pressure Pu to the die plates 164 and 166. The pressure Pu is related to the explosion pressure in the ignition chamber 26*a* along the entire length of the work piece 12*a*. The force F (not shown in the figures) applied by the work piece 12*a* on the die plates 164 and 166 along the die plate movement axis 167 is derived from the pressure in the work piece 12*a* and the projected area A (not shown in the figures) of the work piece 12*a* along the die plate movement axis 167. The force F is resisted by the die press 34. Thus, the hydraulic cylinder 196 that drives the second die press plate 192 is sized to resist the force that results from the uniform pressure in the work piece 12*a* from the explosion resulting from the ignition of the combustibles 47 in the ignition chamber 26*a*.

Figure 12:
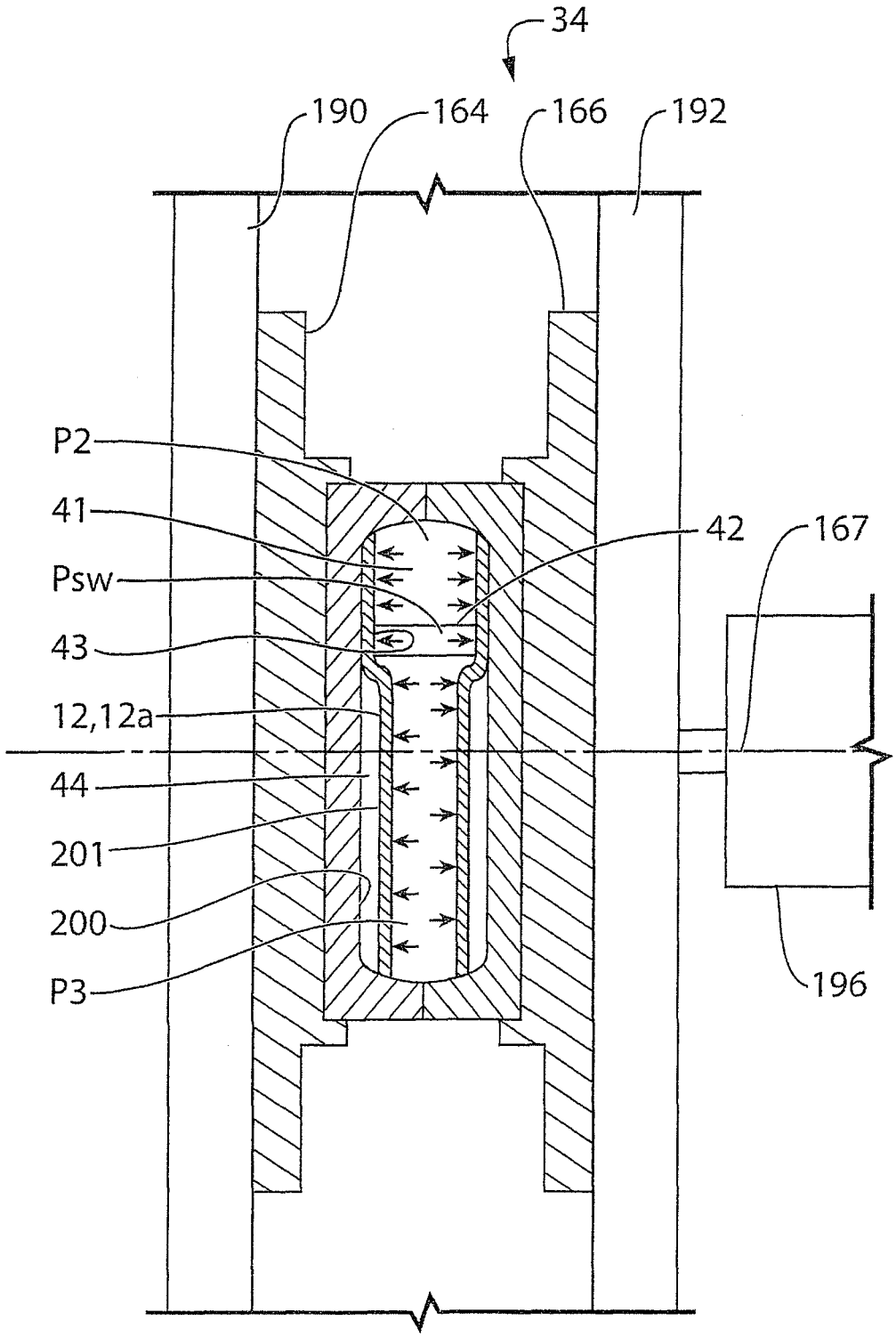
FIG. 12 is a sectional elevation view of the first and second die plates shown in FIGS. 9 and 10 wherein a shock wave is used to modify a work piece.

With reference to FIG. 12, in embodiments wherein the explosion pressure in the ignition chamber 26*a* is transferred into the water 41 as a shock wave 42, the pressure in the water 41 in the work piece 12*a* is not uniform. The shock wave 42 travels along the length of a work piece shock wave path 201 defined by the work piece interior 14 from the first opening 20 to the second opening 24 causing the progressive expansion of the work piece 12*a* along the shock wave path length. At any point in time while the shock wave 42 is in the work piece 12*a*, the pressure distribution along the length of the work piece 12*a* is as follows: The portion of the work piece 12*a* that is directly laterally engaged by the shock wave 42 incurs the shock wave pressure Psw which is related to the explosion pressure. The portion of the work piece 12*a* engaged by the shock wave 42 expands and contacts the die cavity wall 200 and thereby exerts a first force F1 on the die plates 164 and 166. The force F1 is derived from the shock wave pressure Psw and the projected area A1 of the portion of the work piece 12*a* on which the shock wave 42 acts, which may be a few millimeters long. While the shock wave pressure Psw itself may be comparable to the explosion pressure Pu (FIG. 11), the force F1 exerted on the die plates 164 and 166 may be relatively small compared to the force F described above, because the projected area A1 is relatively small compared to the projected area of the entire work piece 12*a*, which may optionally be a meter or more in length.

The water 41 in the portion of the work piece 12*a* that is behind the shock wave 42 has a pressure P2 therein that may be comparable to the filling pressure of the ignition chamber 26*a*. The pressure P2 depends at least partially on the effectiveness of the cooling conduits 57 (FIG. 4*b*) at cooling the gas in the ignition chamber 26*a*. Cooling the gas reduces the pressure of the gas in at least two ways. One way that the pressure is reduced is the result of Gay-Lussac's law of gases which states that for a given volume, the pressure of a gas and the temperature of the gas are directly proportional to each other. Thus, as the temperature of the gas is reduced, its pressure in a fixed volume is also reduced. The second way that pressure is reduced is that the cooled wall 46 of the ignition chamber 26*a* causes at least some water vapour in the gas to condense, which will reduce the quantity of remaining gas in the ignition chamber 26*a*, which in turn reduces the pressure of the remaining gas therein. The water vapour may be present in the gas (and may make up most of the gas) as a reaction product from ignition of the combustibles 47, and also as a result of evaporation of the water 41 in the ignition chamber 26*a* from exposure to the temperatures after ignition of the combustibles 47, which can reach, for example, 3000 degrees Celsius.

In the most preferred embodiment where the combustibles 47 are H2 and O2, the reaction product of combustion is substantially solely water vapour. Thus, substantially all of the gas in the ignition chamber 26*a* after ignition occurs, is water vapour. As a result, a relatively large quantity of gas (ie. water vapour) can be condensed out by the cooled chamber wall 46, thereby significantly reducing the pressure in the ignition chamber 26*a*. In some embodiments, it may be possible to have the pressure P2 approach the filling pressure of the ignition chamber 26*a*. The use of H2 and O2 as the combustibles 47 is particularly advantageous for this reason. Additionally, in embodiments using H2 and O2 as the combustibles, the reaction product (ie. water) is clean and does not pose an environmental problem. Furthermore, using H2 and O2 as the combustibles 47 avoids the generation of acids in the reaction product, which can be handful to selected components of the apparatus 10. Still further, using H2 and O2 avoids the generation of soot in the ignition chamber 26*a*. By contrast, using other combustibles, such as natural gas, or methane, or propane creates gases other than water as a reaction product. These other reaction product gases may have boiling points that are lower than that of water, and as a result, the cooling of the ignition chamber wall 46 will cause less condensation and therefore less of a reduction in the gas pressure behind the shock wave 42.

The portion of the work piece 12*a* that has incurred the shock wave 42 has been expanded by it and therefore contacts the die cavity wall 200, and therefore exerts a force F2 (not shown) on the die plates 164 and 166. The force F2 exerted on the die plates 164 and 166 is derived from the pressure P2 and the projected area A2 (not shown) of the portion of the work piece 12*a* behind the shock wave 42. It will be understood that this projected area A2 will increase as the shock wave 42 travels along the length of the work piece 12*a*. Thus, when the shock wave 42 is proximate the second end 22 of the work piece 12*a*, the projected area A2 approaches the projected area A of the entire work piece 12. However, even when the projected area A2 is nearly the same as the projected area A (FIG. 11) of the entire work piece 12*a*, the force F2 exerted by the work piece 12*a* behind the shock wave 42 on the die plates 164 and 166 is small compared to the force F, because the pressure P2 is relatively small compared to the explosion pressure.

The water 41 in the portion of the work piece 12*a* that is ahead of the shock wave 42 has a pressure P3 therein that is the filling pressure. This portion of the work piece 12*a* however, has not been expanded by the shock wave 42 and so it does not exert any force on the die cavity wall 200 (other than typically a relatively minor contribution due to the combustible filling pressure, which can be ignored for the present discussion).

The total force Ft of the work piece 12*a* on the die plates 164 and 166 is the sum of the forces F1 and F2, which may be small compared to the force F in embodiments wherein the length of the work piece 12*a* is more than a few millimeters long. As a result, the size and cost of the hydraulic cylinder 196 used to provide a selected die holding force to resist the force Ft, and the power required to do so may be small compared to a hydraulic cylinder 196 that is sized to provide a selected die holding force to resist the force F. It will be noted that as the ratio between the length of the work piece 12*a* and the length of the shock wave 42 increases, a greater reduction will be provided between the force Ft and the force F that would be applied if the pressure were uniform inside the work piece 12*a*. It will farther be noted that as the pressure P2 behind (ie. upstream from) the shock wave 42 decreases, a greater reduction will be provided between the force Ft and the force F that would be applied if the pressure were uniform inside the work piece 12*a*. Nonetheless, for some embodiments of the invention, advantages are provided even if the ignition of the combustibles 47 does not result in a shock wave 42 that travels through the work piece 12*a*. For greater clarity, in some embodiments, a pressure wave that is not a shock wave may be generated and may travel through the part. Such a pressure wave may travel at sub-sonic speeds and as a result, there would be a pressure increase that occurs in fluid that is ahead of (ie. downstream from) the pressure wave. However, in some embodiments, benefits are provided regardless of whether the pressure in the work piece 12 is in the form of a shock wave, a non-shock wave type of pressure wave, or in the form of pressure that is not in a wave.

When the first and second die plates 164 and 166 are in the open position, the first and second die cavity portions 168 and 170 are separated to permit ejection of the work piece 12*a* therefrom. The die press 34 may be operated by the controller 40 to open the first and second die plates 164 and 166 after an explosion has occurred and the work piece 12*a* has been modified by the resulting pressure.

Figure 9:
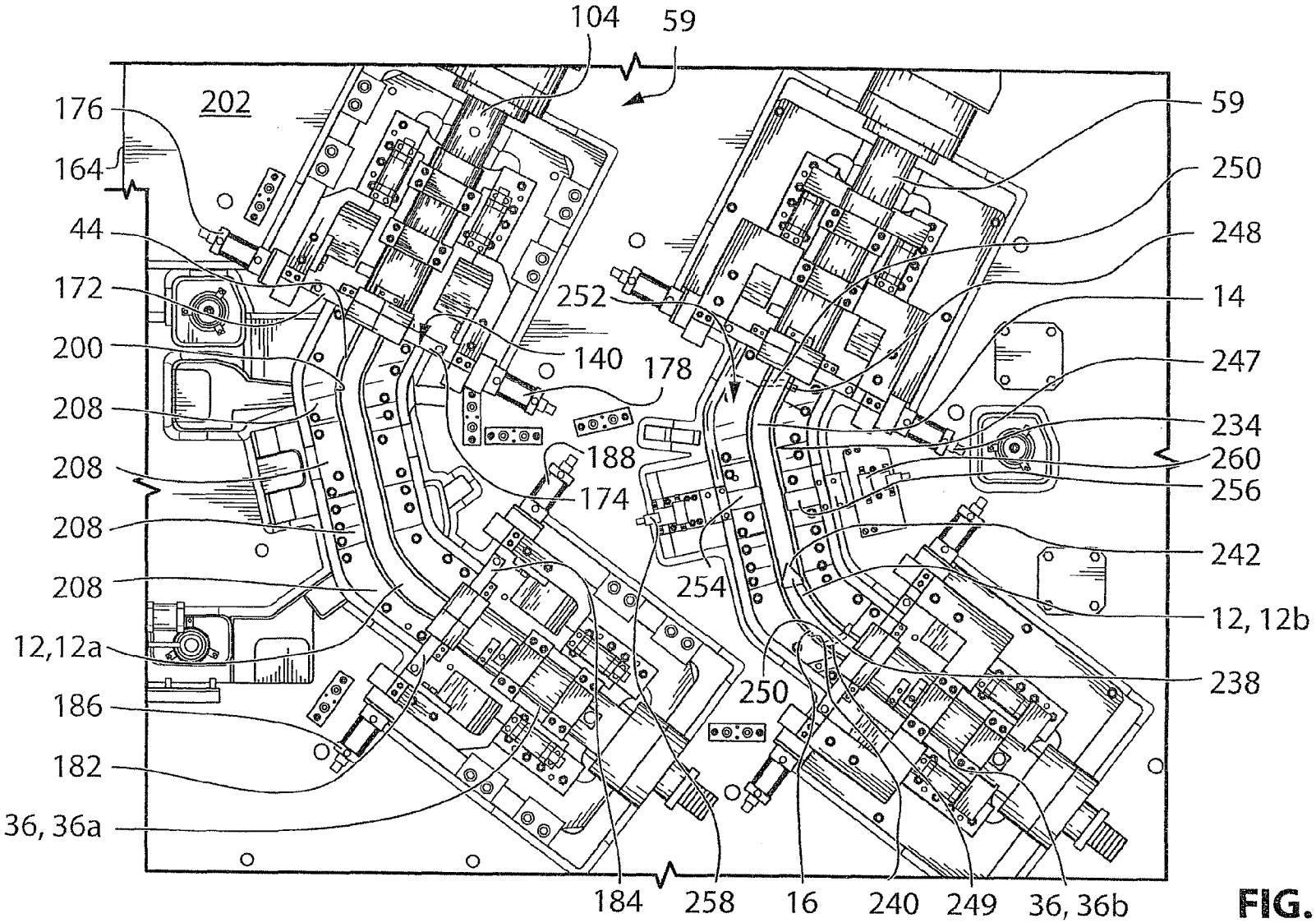
FIG. 9 is a perspective view of a first die plate that is part of the apparatus shown in FIG. 1.
Figure 10:
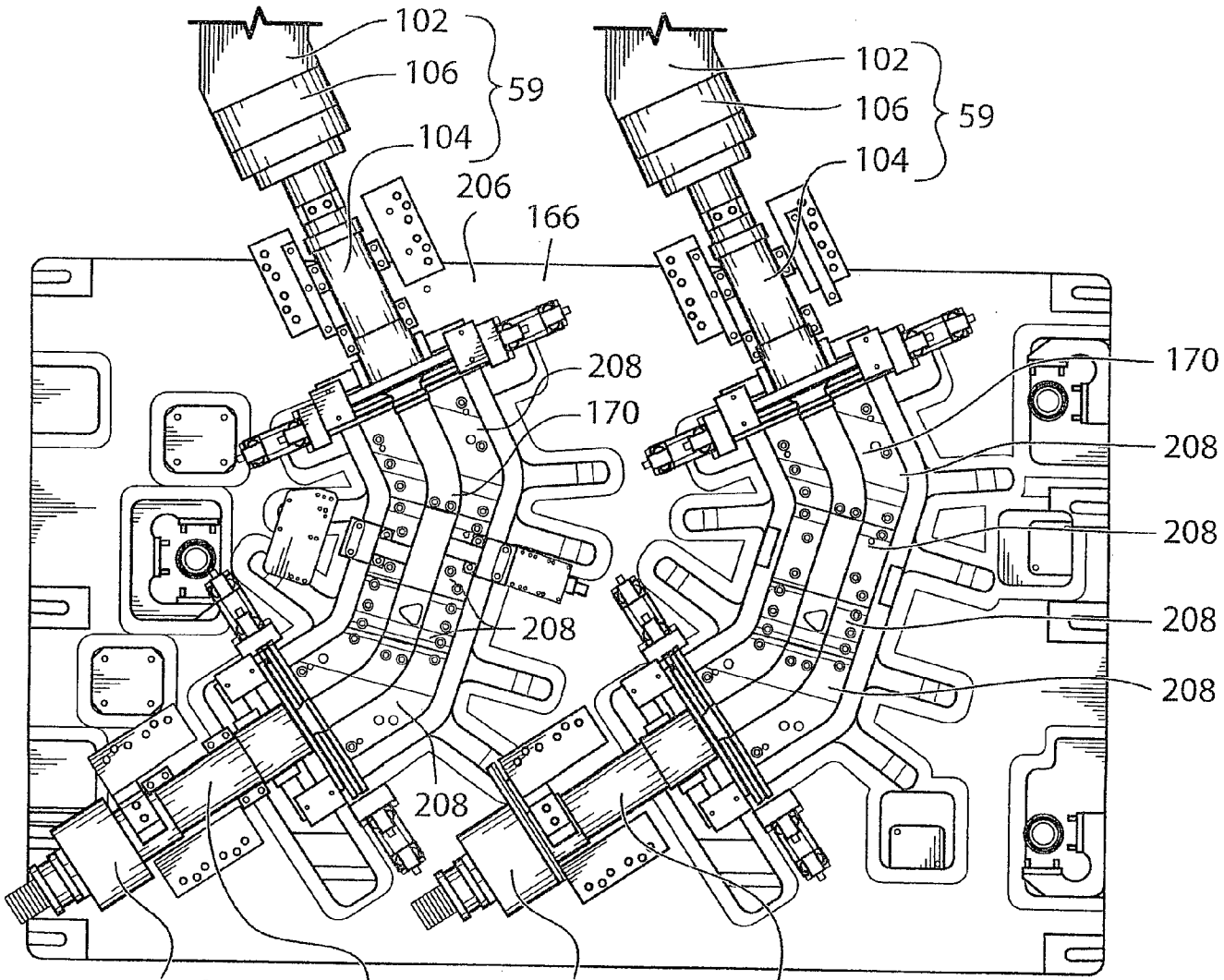
FIG. 10 is a perspective view of a second die plate that is part of the apparatus shown in FIG. 1.

The first and second die plates 164 and 166 may be configured to permit reuse of portions thereof. Referring to FIG. 9, for example, the die plate 164 may include a first die plate base 202 and a plurality of first die cavity portion segments 204, which together form the first die cavity portion 168 and which are removably connectable to the die plate base 202. Similarly, referring to FIG. 10, the second die plate 166 may include a second die plate base 206 and a plurality of second die cavity portion segments 208, which together form the second die cavity portion 170. As a result, the first and second die cavity portion segments 204 (FIG. 9) and 208 (FIG. 10) can be replaced with other die cavity portion segments to form a die cavity that has a different shape than the die cavity 44 (FIG. 8*b*). Another advantage to forming the die cavity portions 168 (FIG. 9) and 170 (FIG. 10) from segments 204 (FIG. 9) and 208 (FIG. 10) is that one or more of the segments 204 (FIG. 9) and 208 (FIG. 10) can be replaced if they are worn or damaged. It will be noted that the die plate bases 202 (FIG. 9) and 206 (FIG. 10) can be reused even if the first and second die cavity portions 168 (FIG. 9) and 170 (FIG. 10) are each made up of a single die cavity portion segment instead of each being made up of a plurality of die cavity portion segments.

Referring to FIG. 9, after the shock wave 42 passes through the work piece 12*a*, it is at least partially destroyed in the pressure reducer 36*a*. The pressure reducer 36*a* may have any suitable structure. For example, referring to FIG. 13, the pressure reducer 36*a* has a first end 210 and a second end 212. The pressure reducer 36*a* has a pressure reducer fluid passage 214 therein. At the first end 210 is an opening 216 into the pressure reducer fluid passage 214. At the second end 212 is the primary incompressible fluid valve 38*a*, which controls the flow of water 41 into the apparatus 10 through a primary incompressible fluid inlet 218. The first primary incompressible fluid valve 38*a* may be referred to as the water valve 38*a*, and the primary incompressible fluid inlet 218 may be referred to as the water inlet 218. Referring to FIG. 1, the water valve 38*a* may be used to fill the entirety of the apparatus 10 up to the isolation valve 58 (ie. the work piece 12*a* and the transfer conduit 59), as distinguished from the water top-off valve 50 (FIG. 4*a*) in the ignition chamber 26*a* which is used to add a relatively smaller amount of water 41 above the isolation valve 58. In embodiments wherein the isolation valve 58 is omitted, one of the water valves 38*a* (FIG. 1) or 50 (FIG. 4*a*) may be used for filling the apparatus 10 up to a selected fill level (which may be a fill level in the ignition chamber 26*a*) and the other of the water valves 38*a* or 50 may be omitted.

Figure 13:
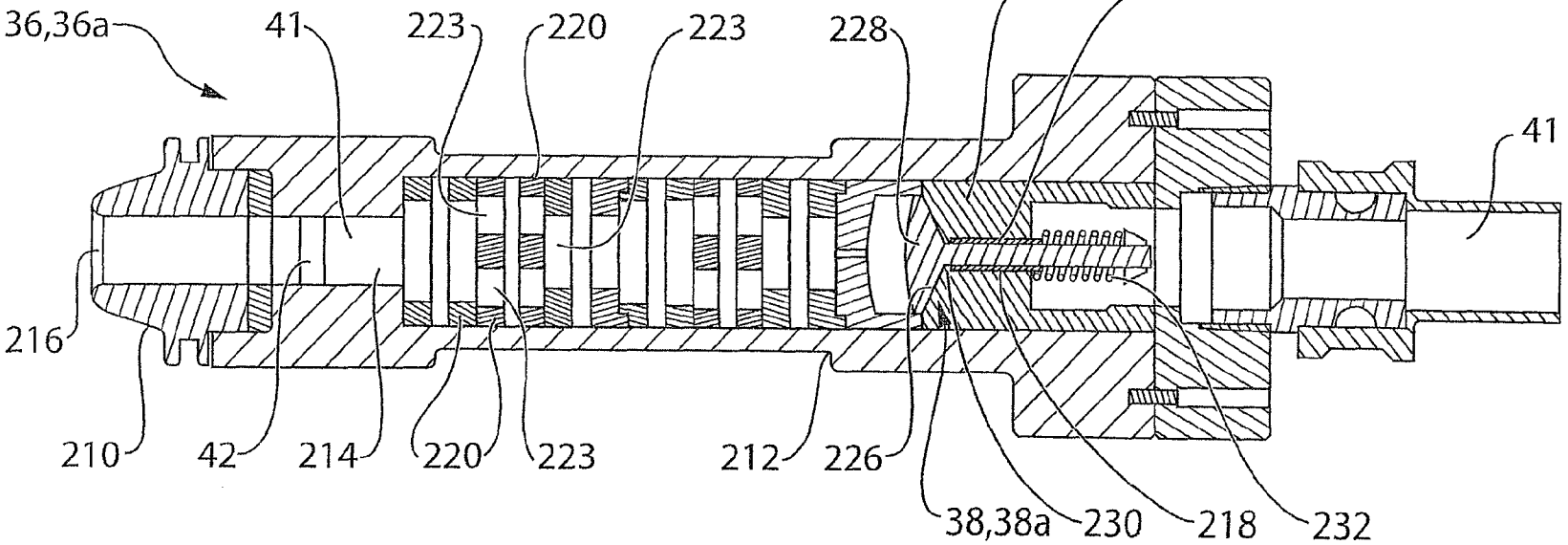
FIG. 13 is a sectional plan view of a pressure reducer and incompressible water inlet valve that are part of the apparatus shown in FIG. 1.

Referring to FIG. 13, in the pressure reducer fluid passage 214, the pressure reducer 36*a* includes a plurality of shock wave reduction elements 220, which impinge on a shock wave 42 traveling therepast and thereby disrupt the flow of the shock wave 42. As a result, the pressure of the shock wave 42 is reduced. It is possible for the wave reduction elements 220 to disrupt the shock wave 42 sufficiently to destroy the shock wave 42 completely. By disrupting the shock wave 42 in the pressure reducer 36*a*, whatever portion of the shock wave 42 reaches the water valve 38*a* causes less wear or damage to the water valve 38*a* than would be caused if the pressure reducer 36*a* were omitted. Additionally, it will be noted that when the shock wave 42 reaches the water valve 38*a*, a reflection of the shock wave 42 will travel back towards the work piece 12*a*, the transfer structure 30*a* and the ignition chamber 26*a*. The reflection of the shock wave 42 must first pass back through the pressure reducer 36*a*. Thus, the pressure of the reflection of the shock wave 42 will be reduced. As a result of the pressure reducer 36*a*, any reflections that do reach the work piece 12*a*, the transfer structure 30*a* and the ignition chamber 26*a* are reduced in pressure so as to inhibit wear or damage to components such as the valves 48, 49, 50 and 51 (FIG. 4*a*) and the igniter 52 (FIG. 4*b*).

The shock wave reduction elements 220 may have any suitable structure. For example, each element 220 may be a disk with one or more apertures 223 that are smaller than the fluid passage 214 so as to disrupt the flow of the shock wave 42. Preferably, elements with different sizes and/or positions of apertures 223 are positioned adjacent one another, so as to provide a labyrinthine flow path through the pressure reducer 36*a*. An example of a pressure reducer that is suitable as the pressure reducer 36*a* is described in PCT application PCT/EP2008/007901 (Applicant: Cosma Engineering Europe AG), the contents of which are hereby incorporated by reference.

The shock wave reduction elements 220 may be removable and replaceable so that worn or damaged elements 220 can be replaced as desired to maintain the performance of the pressure reducer 36*a*.

The water valve 38*a* includes a valve body 222 defining a fluid passage 224. At a first end of the fluid passage 224 is a seat 226 which may be generally conical. A flow control member 228 has a generally conical sealing surface 230 that seals against the seat 226 when the valve 38*a* is in the closed position. A biasing member 232, such as a tension spring, is connected to the flow control member 228 and biases the flow control member 228 towards the seat 226. When the flow control member 228 is closed, the pressure of the water 41 in the apparatus 10 pushes on the flow control member 228 thereby assisting the flow control member 228 in sealing against the seat 226 to prevent leakage of water 41 therebetween.

When the apparatus 10 is to be filled, the water 41 in the primary water inlet 218 is increased in pressure to an incompressible fluid filling pressure that overcomes the biasing force of the biasing member 232. In embodiments wherein the apparatus 10 is filled up to the isolation valve 58 (FIG. 1), the pressure in the water 41 will equalize on both sides of the water valve 38*a*, and as it approaches equalization, the biasing member 232 will overcome the pressure of the water 41 and will close the water valve 38*a* automatically. At some point thereafter, the pressure at the primary water inlet 218 may be reduced.

Referring to FIG. 6*a*, the pressure reducer 36*a* and the water valve 38*a* may be movable together as an assembly between an advanced position wherein the first end 210 of the pressure reducer 36*a* is inserted into the second end 22 of the work piece 12*a* and seals against the second end 22 of the work piece 12*a*, and a retracted position wherein the first end 210 of the pressure reducer 36*a* is withdrawn from the second opening 22 of the work piece 12*a*, to permit the ejection of the work piece 12*a* from the first die cavity 44. The movement of the assembly between the advanced and retracted positions may be mechanically generated by the movement of the die press 34 between the open and closed positions, eg. through cams, gears and the like, or may alternatively be achieved by some other means, such as by hydraulic or pneumatic cylinders. The first end 210 of the pressure reducer 36*a* may be shaped similarly to the downstream end 130 of the transfer conduit 59 to pinch the second end 22 of the work piece 12*a* against the collar 180 thus forming a seal therewith. The first end 210 of the pressure reducer 36*a* constitutes a second opening sealing member for sealing against the end opening 22 of the work piece 12*a*. Such a second opening sealing member may still be provided and may be movable between advanced and retracted positions for sealing against the second opening 22 of the work piece and for permitting ejection of the work piece 12*a* from the die cavity 44, even in embodiments wherein the pressure reducer 36*a* is not provided.

Referring to FIG. 1, the ignition chamber 26*b*, the transfer structure 30*b*, the pressure reducer 36*b* and the water valve 38*b* may all be similar to the ignition chamber 26*a*, the transfer structure 30*a*, the pressure reducer 36*a* and the water valve 38*a*. Referring to FIG. 9, the die 32 includes a second die cavity 234 that may be similar to the first die cavity 44 with the following differences. In the illustrated embodiment, the second die cavity 234 is configured to punch holes in the work piece 12*b* and to trim end portions off the work piece 12*b*. The work piece 12*b* in FIG. 9 is shown as transparent to facilitate illustration of the structure (ie. the die cavity 234) that would otherwise be obscured by it.

Because the second die cavity 234 is not intended to permit expansion of the work piece 12*b*, the second die cavity 234 may be sized to snugly receive the work piece 12*b*. In the area where a hole is to be punched in the work piece 12*b*, the second die cavity 234 may have a hole-punch aperture 238 in the die cavity wall, shown at 240. The hole-punch aperture 238 may have a corner edge shown at 242 that is relatively sharp and which acts as a cutting edge to assist in punching a hole in the work piece 12*b*. After ignition of combustibles 47 (FIG. 1) in the ignition chamber 26*b*, the pressure (eg. the shock wave 42 shown in FIG. 14 or alternatively a pressure that is not in the form of a shock wave) of the water 41 in the work piece interior 14 of the work piece 12*b* pushing on the wall 16 of the work piece 12*b* punches a hole, shown at 243, (FIG. 14) therethrough into the die cavity hole-punch aperture 238 (FIG. 9).

Figure 14:
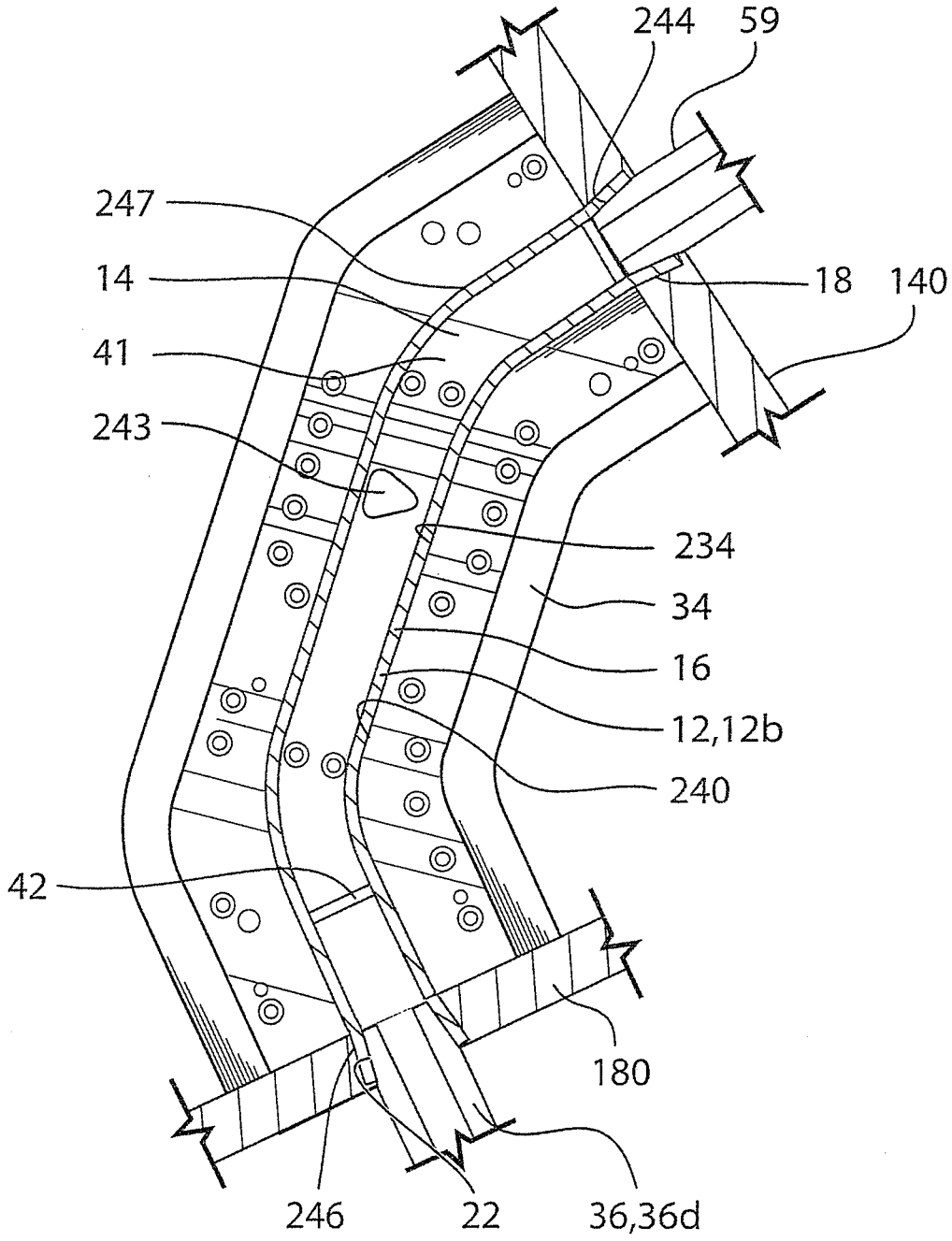
FIG. 14 is a sectional elevation view of a work piece having a hole punched therein using a shock wave.

Referring to FIG. 14, the second die cavity 234 has the first collar 140 and the second collar 180 associated therewith for holding first and second ends 18 and 22 of the work piece 12*b*. The end portions of the work piece 12*a*, shown at 244 and 246 respectively (FIG. 14), which are held in the first and second collars 140 and 180, may not be intended to be present in the final part being made from the work piece 12*b*. Between the end portions 244 and 246 is a work piece body 247. To trim the end portions 244 and 246 of the work piece 12*b*, the second die cavity 234 has suitably positioned first and second trim apertures 248 and 249 (FIG. 9) each of which extends all the way around the second die cavity 234 proximate the first and second end portions 244 and 246 (FIG. 14) respectively. Each of the trim apertures 248 and 249 has a sharp corner edge 250 which act as a cutting edge to assist in the trimming operation.

To deal with the fact that the first end portion 244 is first trimmed from the work piece 12*b*, the second die cavity 234 is preferably sufficiently snug enough to reliably hold the work piece 12*b* sufficiently precisely to punch holes in the work piece 12*b* with a desired degree of positional accuracy. However, once the die opens, to assist in holding the work piece 12*b* in position in the second die cavity 234 once the first and second end portions 244 and 246 have been trimmed off, the second die cavity 234 preferably has associated therewith an intermediate work piece holder 252. The intermediate work piece holder 252 may be made up of a first and second fingers 254 and 256 both of which are part of the first die plate 164, and which are moveable between a closed position wherein the first and second fingers 254 and 256 hold the work piece 12*b*, and an open position wherein the first and second fingers 254 and 256 are separated to permit ejection of the work piece 12*b* from the second die cavity 234. The first and second fingers 254 and 256 may be moved between the closed and open positions by any suitable means, such as by first and second cylinders 258 and 260 (which may be either pneumatically or hydraulically operated).

The work piece transfer mechanism 39 is shown in FIG. 8*a* and is used to place the work piece 12*a* into the first die cavity portion 168 of the first die cavity 44 and to place the work piece 12*b* into the first die cavity portion of the second die cavity 234 when the die plates 164 and 166 are spaced apart.

Figure 8C:
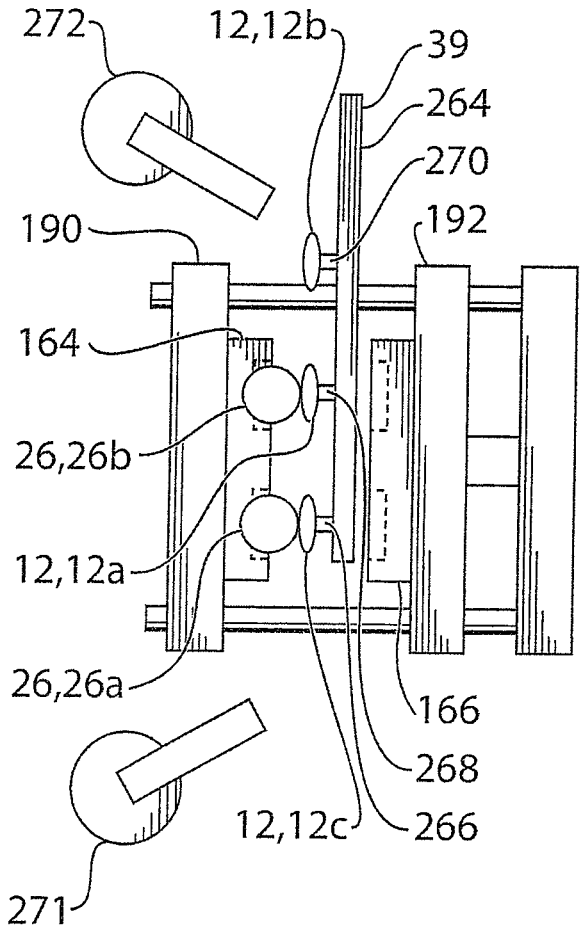
FIG. 8*c* is a top plan view of the apparatus shown in FIG. 1, showing the work piece transfer mechanism in a deposit position.
Figure 15:
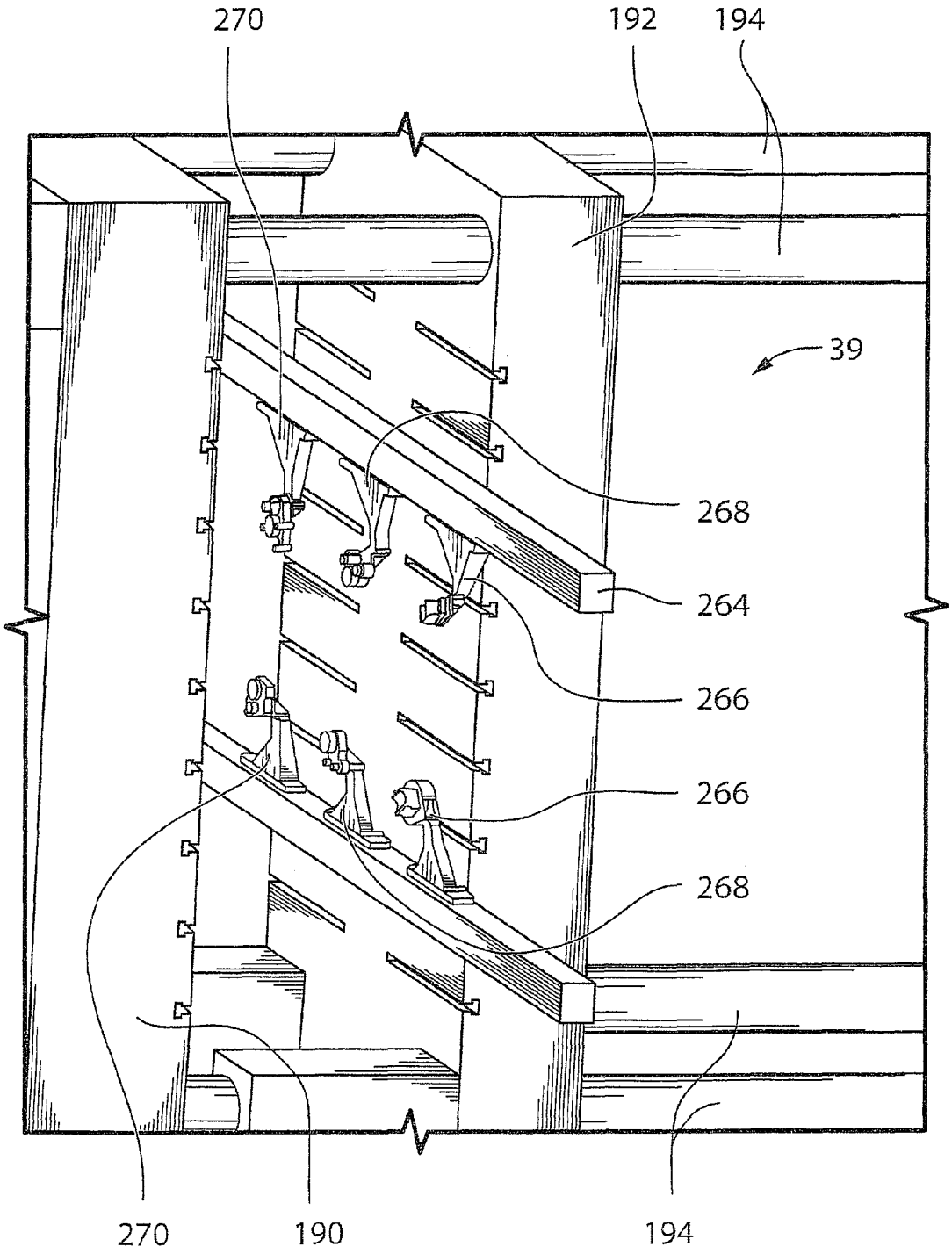
FIG. 15 is a perspective view of a die press and a work piece transfer mechanism from the apparatus shown in FIG. 1.

Referring to FIG. 15, the transfer mechanism 39 includes a carriage 264, a first pair of grippers 266, a second pair of grippers 268 and a third pair of grippers 270. The transfer mechanism 39 is movable between a retracted position (FIG. 8*b*), a receiving position (FIG. 8*a*) and a deposit position (FIG. 8*c*). In the retracted position, the transfer mechanism 39 is out of the path of the die plates 164 and 166, to permit the die plates 164 and 166 to be opened or closed. In the receiving position, the first pair of grippers 266 is positioned to receive a work piece 12*c* (which may be referred to as a third work piece) from a blank work piece storage area, (optionally from a blank work piece transfer robot 271), the second pair of grippers 268 is positioned to receive the work piece 12*a* from the first die cavity 44, and the third pair of grippers 270 is positioned to receive the work piece 12*b* from the second die cavity 234. When the transfer mechanism 39 is in the deposit position, the first pair of grippers 266 is positioned to deposit the work piece 12*c* into the first die cavity portion 168 of the first die cavity 44, the second pair of grippers 268 is positioned to deposit the work piece 12*a* into the first die cavity portion of the second die cavity 234, and the third pair of grippers 270 is positioned to transfer the work piece 12*b* to a finished work piece handling system. The finished work piece handling system may include any suitable structure for handling finished work pieces 12. For example, the finished work piece handling system may include a finished work piece transfer robot shown at 272, which receives the work piece 12*b* from the third pair of grippers 270 and transfers it to a storage area or to some other handling means, such as a chute or a conveyor.

Figure 16:
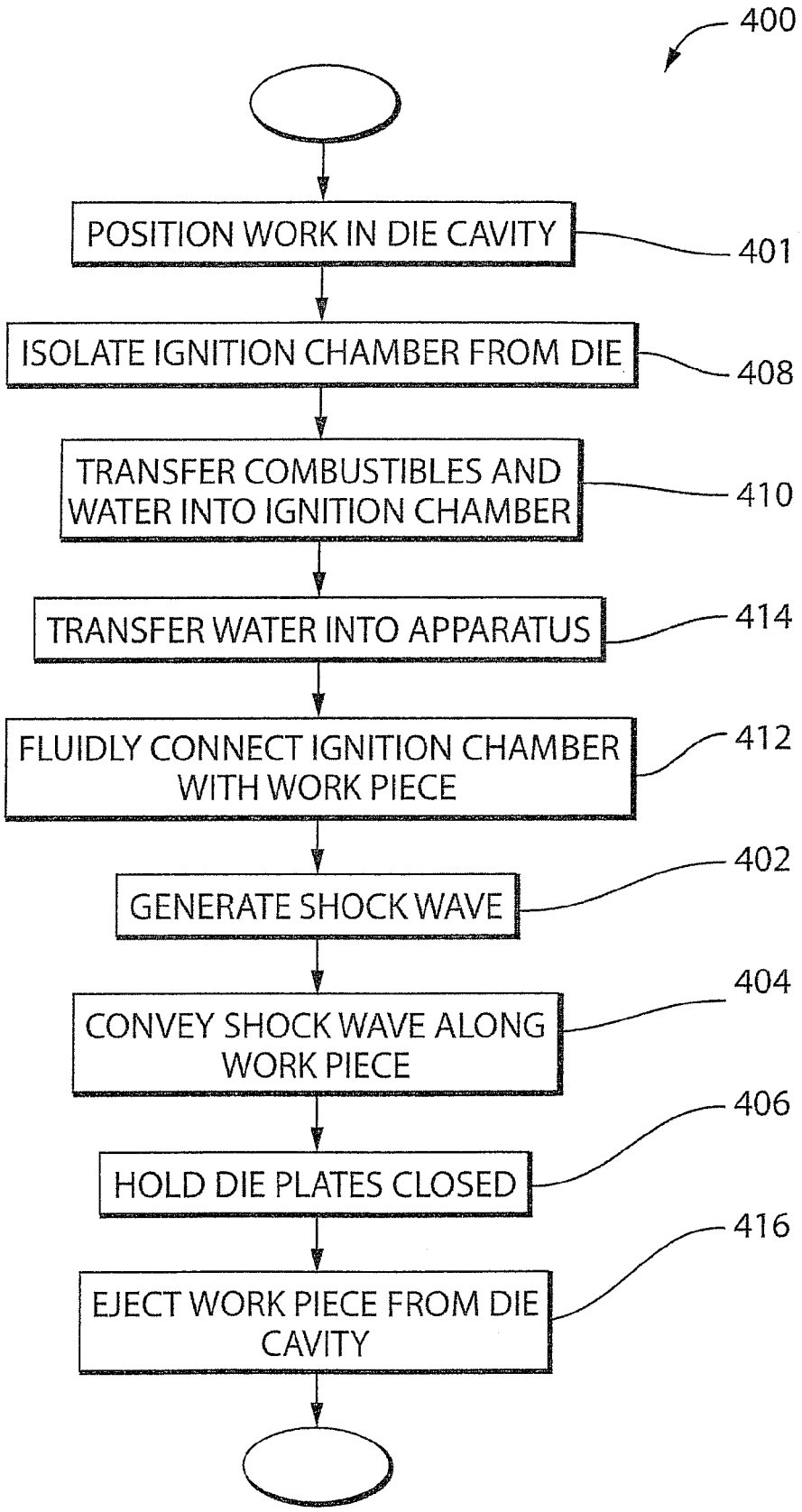
FIG. 16 is a flow diagram of a method for modifying a work piece in accordance with another embodiment of the present invention.

The controller 40 is configured to control the operation of the apparatus 10 according to an operation cycle (ie. a set of method steps that are repeated as desired) shown at 400 in FIG. 16. In the description of the method 400, components are referenced which are shown in other figures, such as FIGS. 1, 3 and 9. With reference to FIG. 16 the operation cycle 400, which may be referred to as the method 400 is described starting from a state wherein an explosion has taken place in each of the first and second ignition chambers 26*a* and 26*b* and the first and second work pieces 12*a* and 12*b* have been modified as desired in the first and second die cavities 44 and 234. In embodiments wherein a shock wave 42 is used to modify the work pieces 12, the method 400 is described as follows: At step 401, a work piece 12 is positioned in a die cavity 44 or 234. It will be understood that this step is intended to encompasses the option of positioning a plurality of work pieces, such as the work piece 12*a* and the work piece 12*b*, in a plurality of die cavities (eg. the die cavities 44 and 234). At step 402 the shock wave 42 is generated, that has a length Lsw that is less than the work piece shock wave path length. At step 404 the shock wave 42 is conveyed along the work piece shock wave path to modify the work piece 12. In parallel, at step 406 the die press 34 holds the first and second die plates 164 and 166 in the closed position with a selected die holding force against pressure in the work piece 12, including pressure from the shock wave 42 in a direction that is transverse to the work piece shock wave path throughout step 404. It will be understood that at step 402, the shock wave 42 may be generated by first generating an explosion, which in turn generates the shock wave 42. The explosion may be generated by igniting H2 and O2. In embodiments wherein the isolation valve 58 is provided, the method 400 may further include step 408 wherein the ignition chamber 26 is isolated from the die 32 (eg. by closing the isolation valve 58) before step 402, and a step 410 wherein combustibles 47 and water 41 are transferred into the ignition chamber 26 after step 408. At step 412, the ignition chamber 26 is fluidly connected with the work piece 12 after step 410 but prior to generating the explosion. In embodiments wherein incompressible fluid 41 (eg. water) is provided, at step 414 water 41 is transferred into the apparatus 10 to fill the work piece 12 and the transfer structure 30 up to the ball 62 of the valve 58. In embodiments wherein water 41 is provided, the method further includes transferring the shock wave 42 from a gas into the incompressible fluid 41. After step 404, the work piece 12 can be ejected from the die cavity 44 or 234 at step 416.

Figure 17:
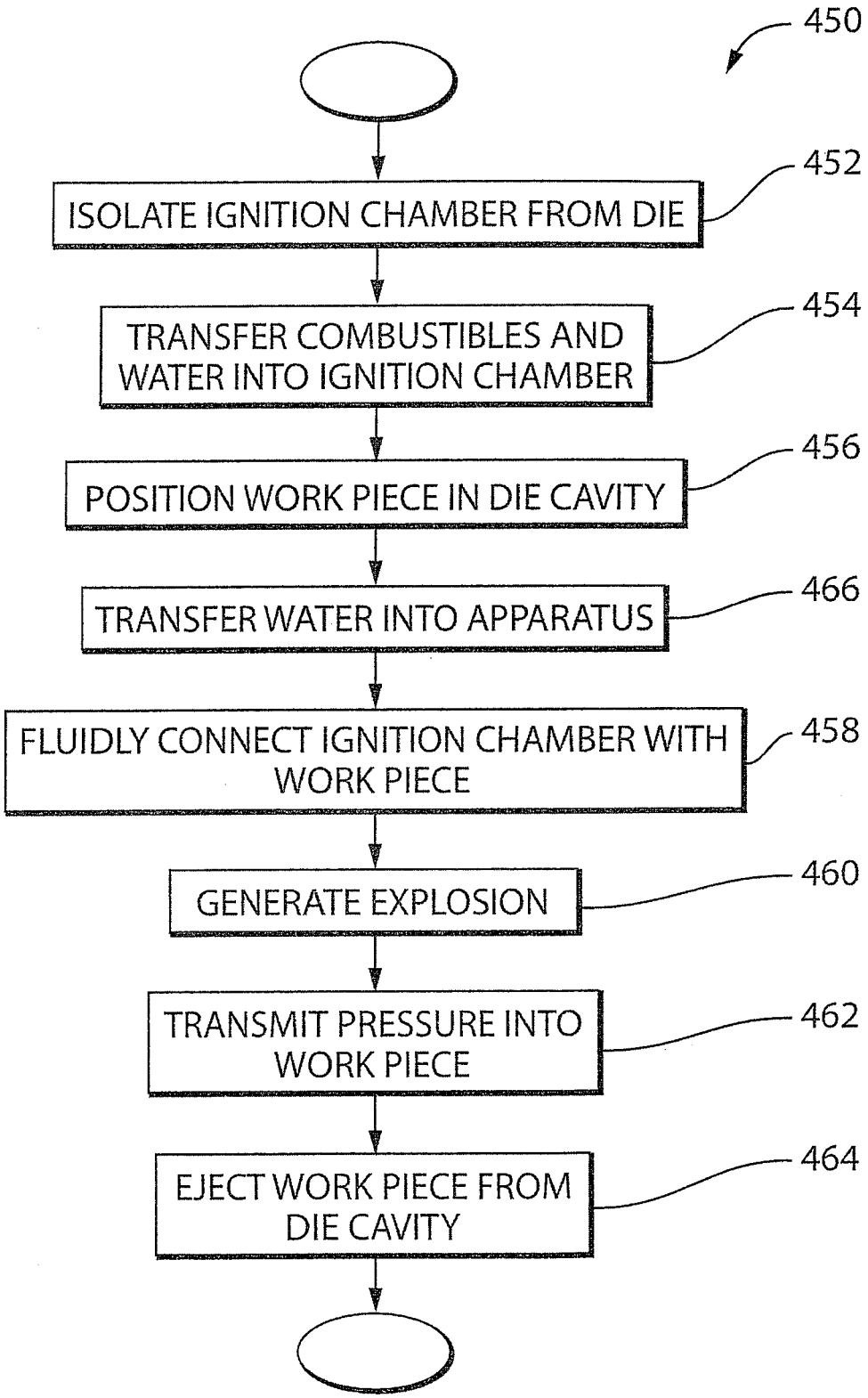
FIG. 17 is a flow diagram of another method for modifying a work piece in accordance with another embodiment of the present invention.

In another embodiment, a method 450 (FIG. 17) for modifying a work piece 12 (FIG. 1) in a die 32 using pressure (but not necessarily in the form of a shock wave 42) wherein the pressure is generated from an explosion in an ignition chamber 26. In the description of the method 450, components are referenced which are shown in other figures, such as FIGS. 1, 3 and 9. The method 450 includes a step 452 wherein the ignition chamber 26 is isolated from the die 32 (eg. the isolation valve 58 is closed). At step 454, combustibles 47 and water 41 are transferred into the ignition chamber 26 after step 452. At step 456, the work piece 12 is transferred into the die cavity 44 or 234. At step 458, the ignition chamber 26 is fluidly connected to the work piece 12 (eg. the isolation valve 58 is opened) after step 454. At step 460, an explosion is generated with the combustibles 47 in the ignition chamber 26 after step 458. At step 462, pressure from the explosion is transmitted to the work piece 12 in the die cavity 44 or 234 to modify the work piece 12. It will be understood that the pressure need not be in the form of a shock wave 42. At step 464, the work piece 12 is ejected from the die cavity 44 or 234 after step 462.

By isolating the ignition chamber 26 prior to carrying out step 454 (transferring combustibles 47 into the ignition chamber 26), step 454 can begin independent of the state of the other components of the apparatus 10. For example, once the ignition chamber is isolated, step 454 can begin whether or not the work piece 12 has been positioned in the die cavity 44 or 234. In embodiments wherein the die 32 is made up of a plurality of die plates, such as a first die plate 164 and a second die plate 166, step 454 can begin prior to closure of the die 32. In embodiments wherein the apparatus 10 is filled with water 41 (eg. at step 466), step 454 can begin prior to completion of the filling of the work piece 12 with the water 41. In embodiments wherein a transfer conduit is inserted into the work piece 12, step 454 can begin prior to the insertion of the transfer conduit into the work piece 12. It is advantageous to permit step 454 to begin prior to the aforementioned steps, since step 454 may take a relatively long time.

Figure 18:
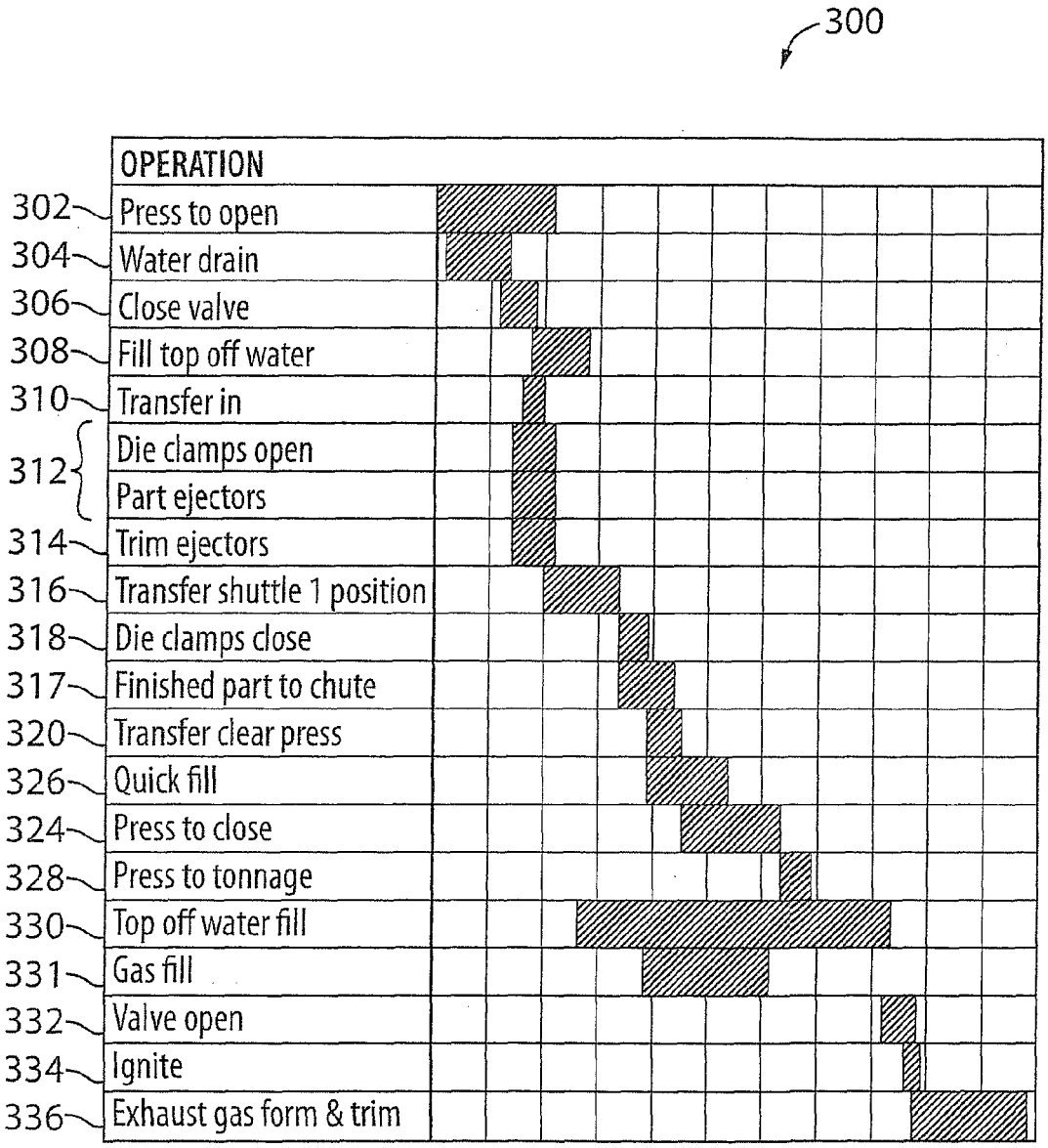
FIG. 18 is a time chart illustrating another method for modifying a work piece in accordance with another embodiment of the present invention.

In the most preferred embodiment, the apparatus 10 is operated using a method 300, schematically illustrated in FIG. 18. In the description of the method 300, components are referenced which are shown in other figures, such as FIGS. 1, 3 and 9. At step 302, the controller 40 opens the die press 34, thereby moving the first and second die plates 164 and 166 to their open position and the first and second transfer structures 30*a* and 30*b* and the first and second pressure reducers 36*a* and 36*b* are withdrawn from the work pieces 12*a* and 12*b*. During step 302, a step 304 takes place, wherein water 41 drains from the apparatus 10. After the water 41 has drained, the isolation valve 58 under each of the first and second ignition chambers 26*a* and 26*b* is closed at step 306, thereby isolating the first and second ignition chambers 26*a* and 26*b*. Step 306 may occur entirely during step 302. After the isolation valves 58 are closed, the water top-off valve 50 in each ignition chamber 26 and 28 is opened to permit water 41 to be transferred into the first and second ignition chambers 26*a* and 26*b* to a selected fill level, at step 308.

At some suitable point during the opening of the die press 34, the transfer mechanism 39 is moved from the retracted position to the receiving position, at step 310. When the transfer mechanism 39 is in the receiving position, the first and second collars 140 and 180 associated with each of the first and second die cavities 44 and 234 are opened at step 312. Also in step 312, the intermediate work piece holder 252 is opened. During step 312, the work pieces 12*a* and 12*b* may be ejected from the first die cavity portion of each of the first and second die cavities 44 and 234 into the second and third pairs of grippers 268 and 270 of the transfer mechanism 39. Additionally in step 312, the first pair of grippers 266 receives a work piece 12 from the blank work piece transfer robot 271 for placement in the first die cavity 44. At step 314, the first and second end portions 244 and 246, which were cut off from the second work piece 12 in the trimming operation in the second die cavity 234, are ejected from the die 32 to a conveyor (not shown) that will convey them to a suitable location (eg. optionally, for melting down and reuse in a suitable way, such as in the casting process for another work piece 12). Step 314 may be carried out simultaneously with step 312.

After the pairs of grippers 266, 268 and 270 receive the work pieces 12, at step 316 the transfer mechanism 39 is moved to the deposit position and the work pieces 12 held thereby are transferred to the first die cavity portions of the first and second die cavities 44 and 234, and to the finished work piece transfer robot 272, which transfers the finished work piece 12*b* to another area at step 317.

After the work pieces 12 have been transferred into the first and second die cavity portions of the first and second die cavities 44 and 234 by the work piece transfer system 39, the first and second collars 140 and 180 associated with the first and second die cavities 44 and 234 are closed and the intermediate work piece holder 252 is closed, at step 318.

At step 320, after the work pieces 12 have been transferred out of the transfer mechanism 39, the transfer mechanism 39 is returned to its retracted position to permit closure of the die plates 164 and 166.

At step 324, after the transfer mechanism 39 has cleared the die press 34 while moving to its retracted position, the die press 34 moves the die plates 164 and 166 to the closed position. During movement of the die plates 164 and 166 to the closed position, the first and second ignition chambers 26*a* and 26*b* are moved downwards to urge the transfer structures 30*a* and 30*b* into sealed fluid communication with the first ends 18 of the work pieces 12*a* and 12*b* respectively. Also at step 324, the pressure reducers 36*a* and 36*b* are moved upwards into sealed fluid communication with the second ends 22 of the work pieces 12*a* and 12*b*.

At step 326 water 41 is transferred into the pressure reducers 36*a* and 36*b*, the work pieces 12*a* and 12*b* and the transfer structures 30*a* and 30*b*, up to the isolation valves 58 by means of the first and second primary water inlet valves 38*a* and 38*b*. To reduce the overall cycle time, it is possible for the water 41 to be pressurized to overcome the biasing member 232 before the die 32 has closed or has begun to close.

After step 322, the hydraulic pressure in the hydraulic cylinder 196 of the die press 34 is increased to the pressure used for resisting opening of the die 32 during and after an explosion, at step 328.

At step 330, after step 306 wherein the isolation valves 58 are closed, water 41 is transferred into the ignition chambers 26*a* and 26*b*. As shown in FIG. 18, this step can take a relatively long period of time. After at least some water 41 is transferred into the first and second ignition chambers 26*a* and 26*b*, the combustibles 47 are transferred into the ignition chambers 26*a* and 26*b*. During the filling of the ignition chamber with combustibles 47 may take relative long. It will be noted that one or more other actions can be carried out during step 331, and during step 330, such as closing of the die plates 164 and 166 (step 322), and filling of the pressure reducers 36*a* and 36*b*, the work pieces 12*a* and 12*b* and the transfer conduits 59 with water 41 (step 326).

At a suitable point in time, such as after the first and second ignition chambers 26*a* and 26*b* have been filled to a desired pressure with combustibles 47, the isolation valves 58 are opened, at step 332. When the isolation valves 58 are opened, the fill level of water 41 in the first and second ignition chambers 26*a* and 26*b* will drop as water 41 fills the ball aperture 71 of the ball 62 in each of the isolation valves 59. It is beneficial for the fill level of the water 41 after the isolation valves 58 are opened to remain above the valves 58 so that the fill level remains in the first and second ignition chambers 26*a* and 26*b*.

At step 334, after the isolation valves 58 are opened, the combustibles 47 are ignited, thereby generating the explosion pressure in the first and second ignition chambers 26*a* and 26*b*, optionally resulting in the shock wave 42. At step 336, the pressure generated by the ignition of the combustibles 47 modifies the work pieces 12*a* and 12*b*.

After the work piece 12 has been modified in step 336, the gas in the first and second ignition chambers 26*a* and 26*b* is exhausted from the first and second ignition chambers 26*a* and 26*b*.

After the gas is exhausted from the first and second ignition chambers 26*a* and 26*b*, the cycle 300 may return to step 302.

Each of the steps of the cycle 300, may be carried out by the controller 40, which may be connected, by electrical conduit or by wireless means, to each of the movable components of the apparatus 10, such as the valves 48, 49, 50 and 51 and the igniter 52, the isolation valves 58, the flange clamps 124, the die press 34, several elements that are controlled by cylinders in the die 32 and the first and second incompressible fluid inlet valves 38*a* and 38*b*.

It is possible for the certain embodiments of the invention to omit selected elements. For example, in embodiments wherein the pressure used to modify the work piece 12 is not in the form of a shock wave 42, it may be possible to omit the pressure reducers 36*a* and 36*b* with little impact on the operating life of the components of the apparatus 10. It may be possible to omit the pressure reducers 36*a* and 36*b* even when the pressure is in the form of a shock wave 42 in certain embodiments, with the understanding that there may be an impact on the operating life of certain components, such as the first and second primary water inlet valves 38*a* and 38*b*.

As another example, it may be possible to omit the isolation valves 58 in certain embodiments. To compensate, the controller 40 could wait until the die 32 is closed and the apparatus is filled up to the first and second ignition chambers 26*a* and 26*b* before transferring the combustibles 47 into the first and second ignition chambers 26*a* and 26*b*.

As another example, it is possible to provide a die 32 that has only a single die cavity. In this example, the single die cavity could be used to form the work piece 12, or to punch holes in the work piece 12, or both. Additionally, the work piece 12 may be trimmed of its end portions 244 and 246 in the single die cavity. As a result, the ignition chamber 26*b*, the transfer structure 30*b*, the pressure reducer 36*b* and the water valve 38*b* may be omitted from the apparatus 10.

As another example, in embodiments wherein the first opening 20 of the work piece 12 is oriented about a vertical axis, the transfer conduit 59 may be a simple conduit without bends or angle adjustment means.

In some embodiments, the apparatus 10 may be configured to form a work piece 12, punch holes in the work piece 12 and trim end portions off the work piece 12 in a single die cavity all with a single shock wave 42.

In the embodiment shown in the figures, the work piece 12 has first and second openings 20 and 24 into the work piece interior 14. In embodiments wherein the ignition chamber 26 generates a shock wave 42, providing two openings permits the shock wave 42 to enter the work piece 12 through the first opening 20 and exit the work piece 12 through the second opening 24, where the shock wave 42 can then be handled by the pressure reducer 36*a*. In this way reflections of the shock wave 42 are less likely to make their way back through the apparatus 10 to damage components such as the valves 48, 49, 50 and 51 and the igniter 52. It is alternatively possible, however, for the work piece 12 to have a single opening 20 into its interior 14. As a result, the shock wave 42 can pass into the work piece 12 through the opening 20, but may then be reflected at a blind end of the work piece 12, such that the reflection may then travel back through the work piece 12 and into the transfer structure 30 and into the ignition chamber 26.

It has been shown to fill the apparatus 10 with water 41 such that the work piece 12 is filled with water 41, the transfer structure is filled with water 41 and part of the ignition chamber 26 is filled with water 41. Providing the water 41 is advantageous for several reasons, one of which is that it protects the components to some extent from scorching and certain other types of wear or damage that could otherwise occur if components were exposed directly to the combusted gas. It is possible, however, in some embodiments of the invention, for the water 41 to only fill the work piece 12 and the transfer structure 30*a*. It is also possible in some embodiments, for the water 41 to only fill the work piece 12 and not the transfer structure 30*a*. It is also possible for the apparatus 10 to operate without the use of water 41 entirely. In embodiments wherein the fill level of the water 41 would be below the opening into the ignition chamber interior 45, certain components, such as the isolation valve 58 and the flex joint 106 would preferably be configured to seal against gas leakage therethrough instead of sealing against liquid leakage. In at least some of these embodiments, certain components may be omitted, such as the inlet valve 50 in the first and second ignition chambers 26*a* and 26*b*. In embodiments wherein there is no incompressible fluid provided, the inlet valves 38*a* and 38*b* may also be omitted and the second end of the pressure reducers 36*a* and 36*b* could be a simple blind end.

In the embodiment shown in the figures, the die 32 is made up of a first die plate 164 and a second die plate 166. It is, however, possible for the die 32 to have a single plate with a die cavity therein, for a work piece 12 that has a shape that can be ejected from such a die. In such an embodiment, there is no die press required to hold any die plates closed, since the die cavity is defined in one die plate. In such embodiments, the advantages of providing an isolation valve, such as the isolation valve 58 positionable to selectively isolate the ignition chamber 26 so that it can be filled with combustibles 47 simultaneously with other actions such as transferring a work piece into the die cavity and driving a transfer conduit into the end of the work piece, thereby reducing the cycle time associated with the modification of each work piece. It will be noted that such an advantage in cycle time reduction can be realized regardless of whether the apparatus 10 generates a shock wave 42 for modifying the work piece or whether the apparatus 10 generates a uniform pressure.

Figure 19A:
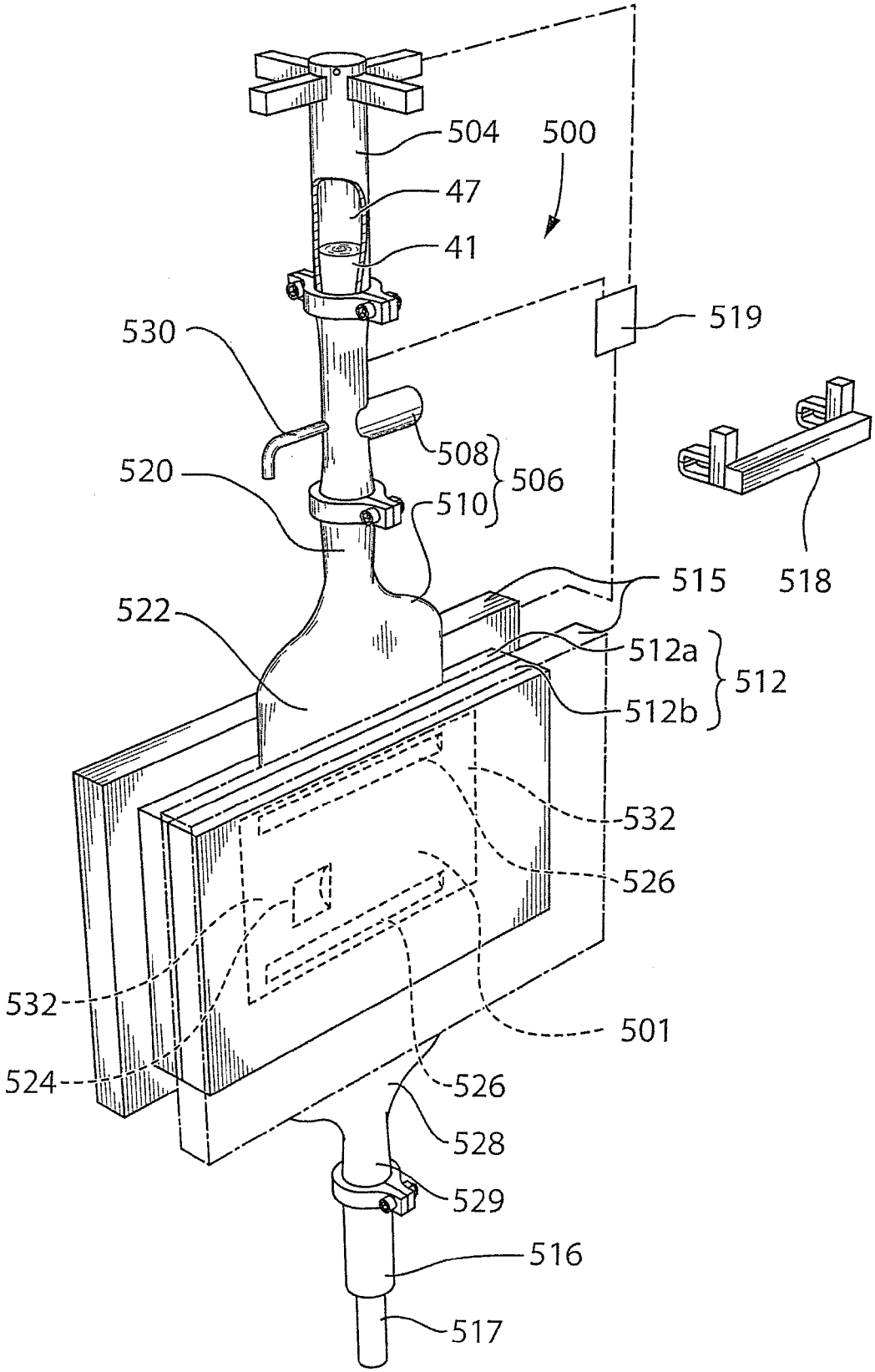
FIG. 19*a* is a perspective view of another apparatus for modifying a planar work piece in accordance with another embodiment of the present invention, prior to generation of a shock wave therein.
Figure 19B:
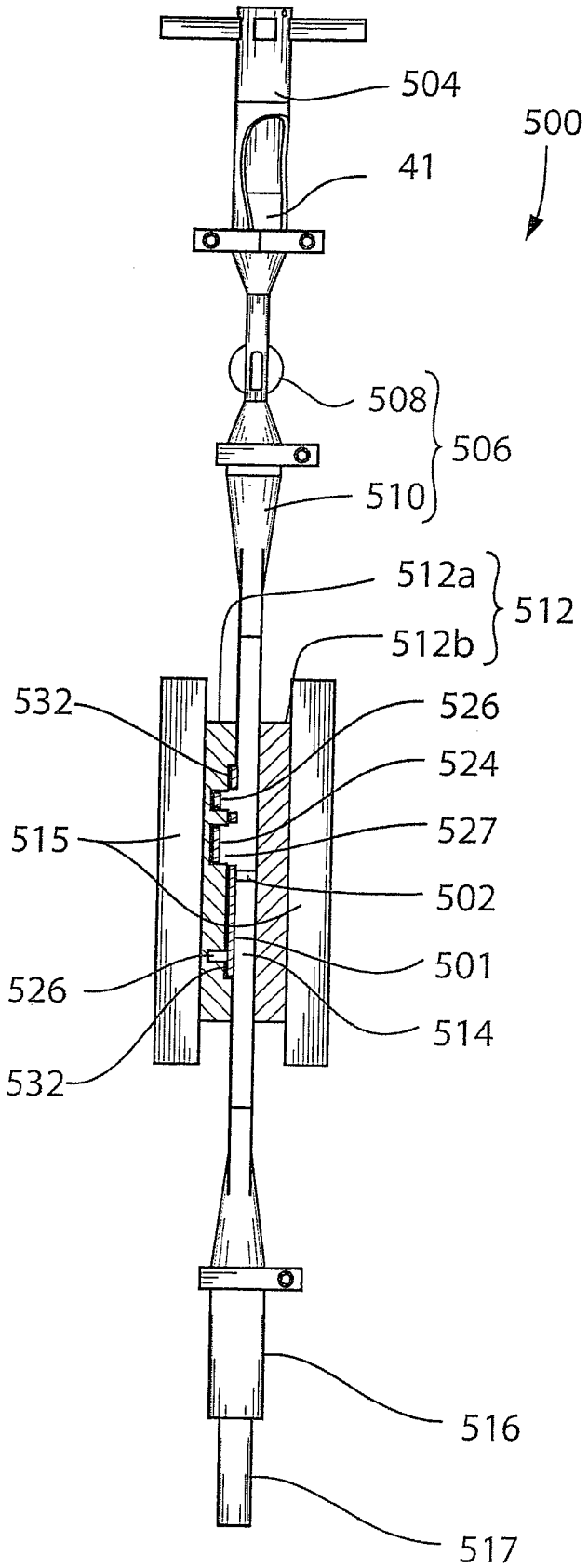
FIG. 19*b* is a side view of the apparatus shown in FIG. 19*a*, after generation of a shock wave therein.

Reference is made to FIGS. 19*a* and 19*b*, which show an apparatus 500 in accordance with another embodiment of the present invention. In FIG. 19*a*, the apparatus 500 is shown prior to ignition of combustibles 47. In FIG. 19*b*, the apparatus 500 is shown after ignition of combustibles 47 has taken place and a shock wave 502 has been generated.

The apparatus 500 is preferably similar to the apparatus 10 (FIG. 1) except that the apparatus 500 is configured to modify a work piece 501 that is planar, in the sense that the work piece 501 is not tubular (ie. it is not wrapped back on itself to form a tube or similar hollow body). It is not necessary that the work piece 501 be flat. For example, in the illustrated embodiment, the work piece 501 is made from sheet metal, but is three-dimensional.

The work piece 501 has a longitudinal axis along which a shock wave 502 travels during use. The work piece 501 has a longitudinal length, shown at Lwp, and a lateral width, shown at Wwp.

As can be seen in FIG. 19*b*, when the shock wave 502 travels along the work piece 501, the shock wave 502 is also in direct contact with a portion of the die cavity 514.

In the embodiment shown, the apparatus 500 includes an ignition chamber 504, a transfer structure 506 that includes an isolation valve 508 and a transfer conduit 510, a die 512 that is made up of a first die plate 512*a* and a second die plate 512*b* which together define a die cavity 514 (FIG. 19*b*), a die press 515, a pressure reducer 516 downstream from the die cavity 514, a water valve 517 downstream from the pressure reducer 516, a transfer mechanism 518 (FIG. 19*a*) and a controller 519 (FIG. 19*a*).

The ignition chamber 504 is preferably similar to the ignition chambers 26 shown in FIG. 1, and is tillable with combustibles 47, and optionally with a selected amount of water 41. The isolation valve 508 is preferably similar to the isolation valves 58 shown in FIG. 1.

In the embodiment shown, the work piece 501 is wider than the ignition chamber 504. To accommodate the difference in width, the transfer conduit 510 increases in width Wtc from its inlet end shown at 520 to its outlet end shown at 522, thereby changing from having a circular cross-sectional shape to an elongate cross-sectional shape. As the width Wtc of the transfer conduit 510 increases, the depth Dtc of the transfer conduit 510 decreases so that the cross-sectional area of the transfer conduit 510 is approximately constant along its longitudinal length Ltc. By doing so, the strength of the shock wave 502 (or any other form of pressure wave) is not reduced as it travels along the transfer conduit 510, or at least this effect can be mitigated.

The transfer conduit 510 is preferably retractable from the work piece 501 after the work piece 501 has been modified, to permit ejection of the work piece 501 and any trimmed portions from the die cavity 514. In the illustrated embodiment, the transfer conduit 510 is not articulated and is fixedly (ie. non-rotatably) connected with respect to the ignition chamber 504. Thus, the assembly made up of the transfer conduit 510, the isolation valve 508 and the ignition chamber 504 may all move together as a single unit between a retracted position and an advanced position.

In the embodiment shown in FIG. 19*a*, the die cavity 514 includes a punch aperture 524 and a trim aperture 526. As shown in FIG. 19*b*, when the shock wave 502 travels along the work piece 501 in the die cavity 514, the shock wave 502 punches an aperture 527 in the work piece 501 at the punch aperture 524. Additionally the shock wave 502 trims the work piece 501 along the trim aperture 526. In embodiments where the work piece 501 is made from a tough material such as a high-strength steel, trimming the work piece 501 using the apparatus 500 may be faster than trimming the work piece 501 by a traditional method using a cutting blade. Additionally, when the work piece 500 is made from a high-strength steel, trimming it using a traditional method can result in rapid wear in the cutting blade, necessitating frequent cutting blade replacement. By contrast, trimming the work piece 501 using the apparatus 500 does not involve a cutting blade, thereby eliminating a source of downtime and cost present using the traditional method.

The pressure reducer 516 is positioned to receive the shock wave 502 after it leaves the work piece 501 and to reduce the strength of the shock wave 502. The pressure reducer 516 includes an inlet section 528 that is configured to change from an elongate cross-sectional shape to a circular cross-sectional shape, and a generally cylindrical section shown at 529 that is similar to the pressure reducers 36 shown in FIG. 1. It is optionally possible for the inlet section 528 to increase in cross-sectional area in a downstream direction, in order to reduce the strength of the shock wave 502 as it travels therealong. The portion of the pressure reducer 516 downstream from the inlet section 528 is preferably similar to the pressure reducer 36.

The water valve 517 is preferably similar to the water valve 38. The filling of the apparatus 500 is similar to the filling of the apparatus 10 shown in FIG. 1. In other words, the apparatus 10 can be filled using a high flow rate of water 41 through the water valve 517 up to the isolation valve 508 by sensing for the presence of liquid in a drain line shown at 530 connected at the flow control member of the valve 508.

The pressure reducer 516 and water valve 517 are preferably movable between a retracted position and an advanced position in similar manner to the pressure reducer 36 and water valve 38 shown in FIG. 1.

The first and second die plates 512*a* and 512*b* have first and second die cavity portions 514*a* and 514*b* respectively and are movable by the die press 515 between an open position (not shown) and a closed position (shown in FIGS. 19*a* and 19*b*). The die plates 512*a*, 512*b* are similar to the first and second die plates 164 and 166 (FIG. 8*a*), except that the die plates 512*a* and 512*b* are closable directly against a side edge portion 532 of the work piece 501 to hold the work piece 502 in place in the die cavity 514 and to seal against leakage out of the die cavity 514. Note that in this embodiment the work piece 502 is itself used as a sealing member as it will be appreciated that the water 41 cannot occupy the space between the contouring portion of the die (e.g., punch aperture 524 and trim apertures 526) and the work piece 502 as otherwise there would be no room for the work piece to conform to the contour portion of the die given the incompressible nature of the water 41. Thus, the work piece segments the die cavity 514 into a contour portion and a non-contour portion, with the water 41 only filling the non-contour portion of the die cavity 514.

The die press 515 is preferably similar to the die press 34 (FIG. 8*a*). The transfer mechanism 518 is configured to transfer the work piece 501 out of the die cavity 514 after it has been modified by the apparatus 500, and is further configured to transfer another work piece 501 into the die cavity 514. The transfer mechanism 518, while being configured to handle two planar work pieces 501 instead of three tubular work pieces 12 (FIG. 8*a*), is otherwise preferably similar to the transfer mechanism 39 (FIG. 15).

The controller 319 preferably operates all of the above-described components according to a method similar to one of the methods 300, 400 or 450.

The cycle of operation includes the following steps, which do not necessarily occur sequentially. The die 512 is opened and the transfer conduit 510 is retracted from the work piece 501. The work piece 501 and any trimmed or punched pieces therefrom are ejected from the die cavity 514. The valve 508 is closed. The ignition chamber 504 is filled with top-off water 41 and combustibles 47. A new work piece 501 is transferred into the die cavity 514 and the die 512 is closed. The non-contour portion of the die cavity 514 is filled with water 41. The isolation valve 508 is opened. The combustibles 47 are ignited and the pressure, which is preferably in the form of the shock wave 502, is conveyed to and along the work piece 501 to modify it.

While it is preferable for the apparatus 500 to modify the planar work piece 501 by means of the shock wave 502, certain aspects of the apparatus 500 are advantageous whether or not the pressure in the die cavity 514 is in the form of a shock wave 502. For example, the isolation valve 508 permits the rapid filling of the apparatus 500 with water 41, and also permits the independent filling of the ignition chamber 504 with combustibles.

While it is preferable for the apparatus 500 to include the isolation valve 508, it is operable without the valve 508. In such an embodiment, water 41 can be filled to a selected fill level prior to filling the ignition chamber 504 with combustibles 47.

Figure 20:
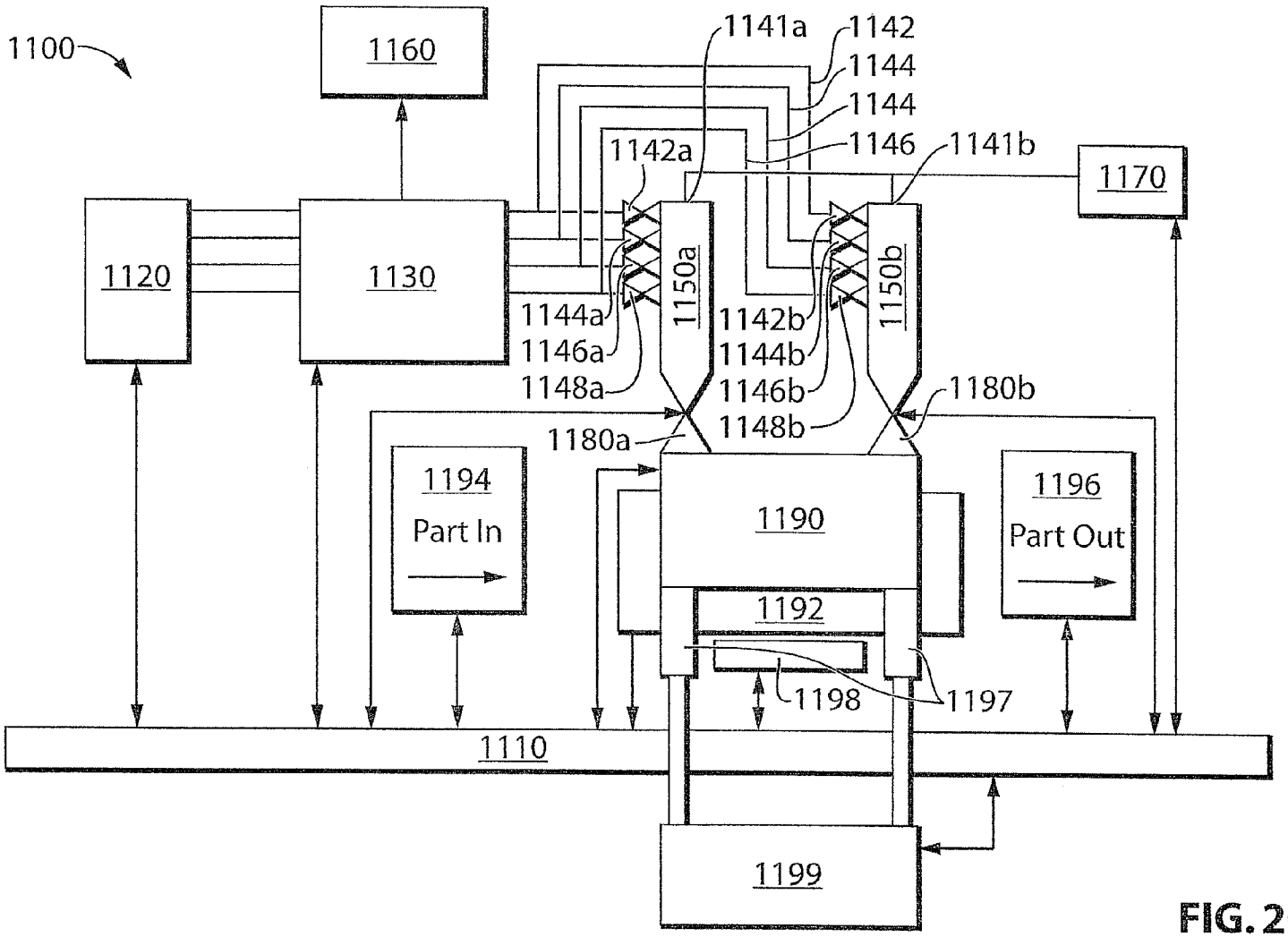
FIG. 20 shows a schematic representation of a combustion forming apparatus in accordance with yet another embodiment of the present invention.

Reference is made to FIG. 20. In accordance with an embodiment of the invention, a method and an apparatus are provided for combustive forming wherein an ignition tube or tubes are selectively separated or isolated from a die (which may also be referred to as a tool). The separation or isolation of ignition tube(s) and tool(s) or die(s) allows for substantially simultaneous charging of an ignition tube with a combustive charge and insertion of a blank or work piece into the tool(s) or die(s) as well as an individual removal of formed work pieces from the tool or die and exhaustion of the combusted combustibles from the ignition tube and tool or die. This is achieved by providing a transfer valve between an ignition tube and a tool or die.

FIG. 20 shows a schematic representation of combustion forming apparatus 1100 in accordance with an embodiment of the invention. The apparatus 1100 generally comprises a press 1192 on which a tool 1190 comprising a pair of die halves is mounted. Die halves of tool 1190 cooperate together to provide a die cavity therebetween. The inner surface of the die cavity is contoured to the desired outer shape of the formed blank. The press 1192 preferably has a horizontal die draw and is operable to move a movable die half of tool 1190 between an open and closed position relative to a stationary die half. In the closed position, the press 1192 exerts a closing force on the movable die half to hold the die halves together.

Preferably, apparatus 1100 includes a robotic part handler 194 for taking a raw blank or work piece and inserting the blank into the die cavity and a robotic part handler 1196 for removing a finished part from the die cavity and delivering the finished formed part to a conveyor or holding bin.

A fluid filling system 1199 is in fluid communication with the die cavity of the die halves of tool 1190 through a wave breaker 1197. Fluid filling system 1199 pumps a fluid into the die cavity to fill and immerse at least a portion of the work piece in the fluid. Alternatively, the whole work piece is submerged in the fluid. Additionally, the fluid filling system 1199 collects the fluid after the die halves of tool 1190 open and drains therefrom. The fluid is filtered and stored for reuse.

Figure 21:
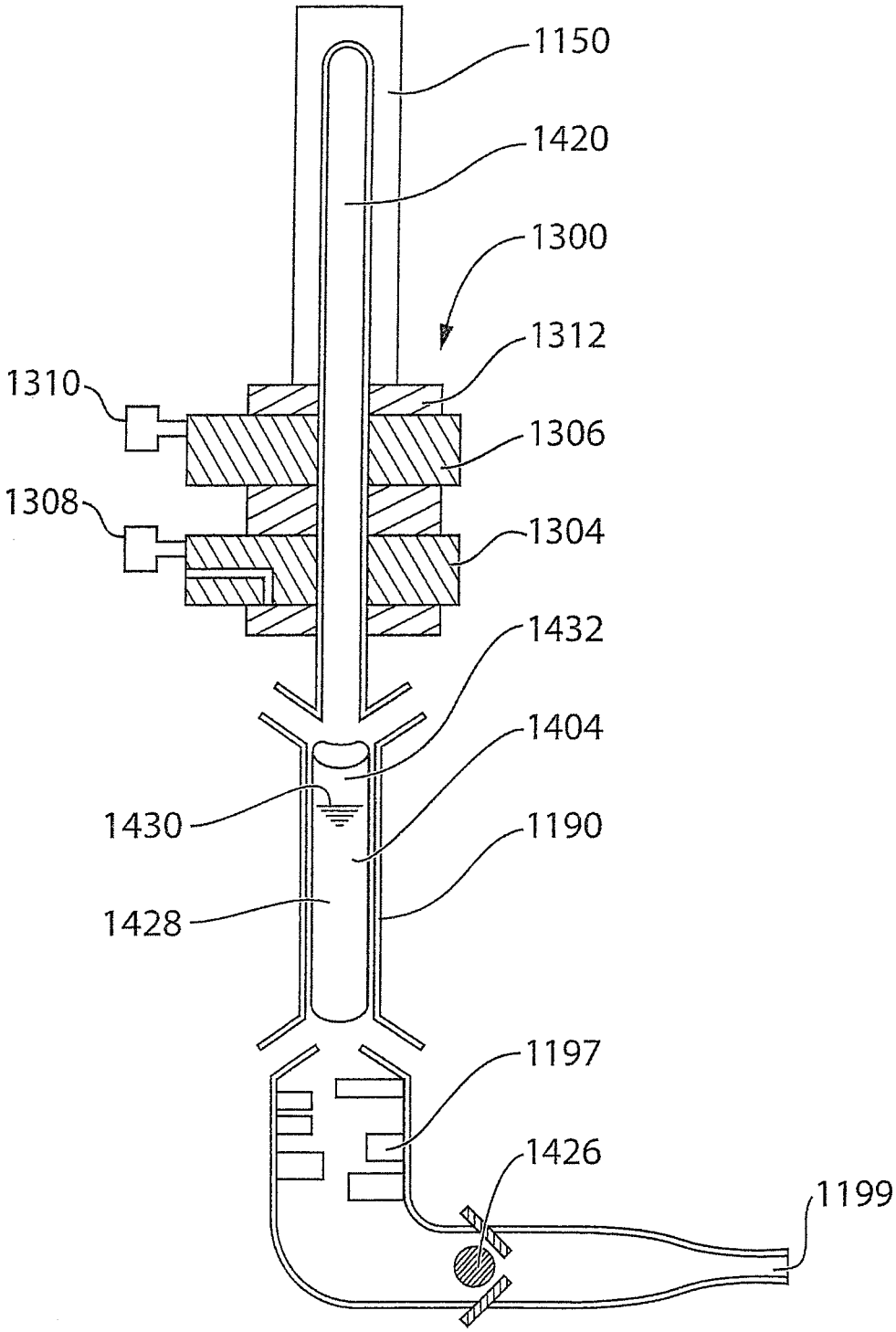
FIG. 21 shows a more detailed view of a portion of the apparatus shown in FIG. 20.

Referring additionally to FIG. 21, a portion of apparatus 1100 in accordance with the instant invention is shown in more detail. Apparatus 1100 comprises an ignition tube 1150, a work piece 1404 within forming die or tool 1190, and a transfer valve 1300 disposed between ignition tube 1150 and forming die or tool 1190.

Figure 22A:
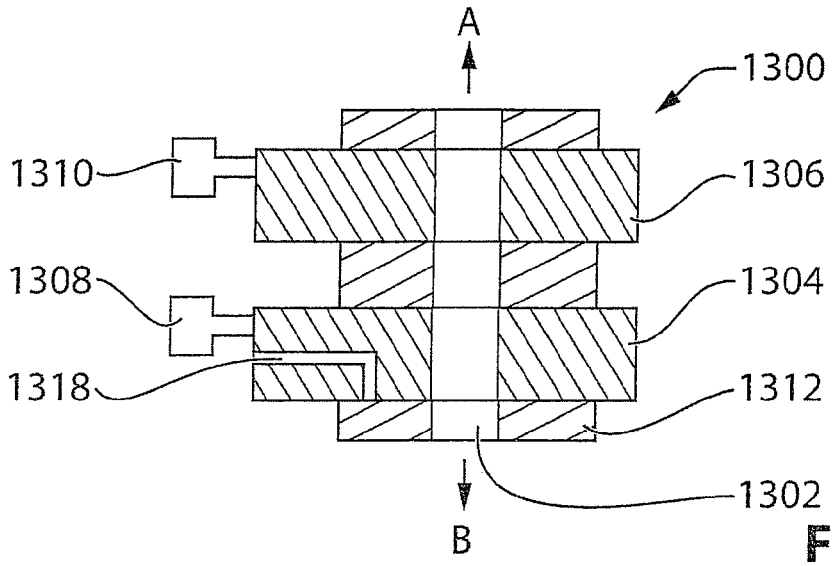
FIG. 22*a* shows a schematic view of a transfer valve that is part of the apparatus shown in FIG. 20, in an open position.

Turning now to FIG. 22*a*, transfer valve 1300 comprises a body 1312 having a longitudinal central passageway 1302 and pair of laterally moving slides 1304 and 1306. Passageway 1302 provides for fluid communication between a tool 1190 and an ignition tube 1150. Passageway 1302 is sized to allow travel of the pressure wave from the ignition tube 1150 to the die cavity with minimum energy loss. Slide 1304 also has a second vent port 1318 that extends longitudinally and then laterally. The vent port 1318 may be referred to as a passageway 1318.

Arrow A indicates the direction towards the ignition tube 1150 from valve 1300 and arrow B indicates the direction towards the tool 1190 from valve 1300.

Valve 1300 is a double fill system (DFS). Slides 1304 and 1306 are moved by actuators 1308 and 1310, respectively, in a direction lateral to a direction of flow of the fluids. The actuators can be hydraulic or pneumatic actuators or any other suitable actuators.

Actuators 1308, 1310 provide reciprocal sliding movement to slides 1304, 1306 through the main body 1312 of valve 1300. Actuators 1308 and 1310 move slides 1304, 1306 between a first "open" position, as depicted in FIG. 22*a*, a second "closed/venting" position, as depicted in FIG. 3*b*, and a third "closed" position, as depicted in FIG. 22*c*. Both slides 1304, 1306 have a longitudinal port 1314, 1316 therethrough, which ports 1314, 1316 align with the passageway 1302 of the main body 1312 of valve 1300 to yield the open position, as shown in FIG. 22*a*, so as to allow fluid communication between the ignition tube and the tool.

Figure 22B:
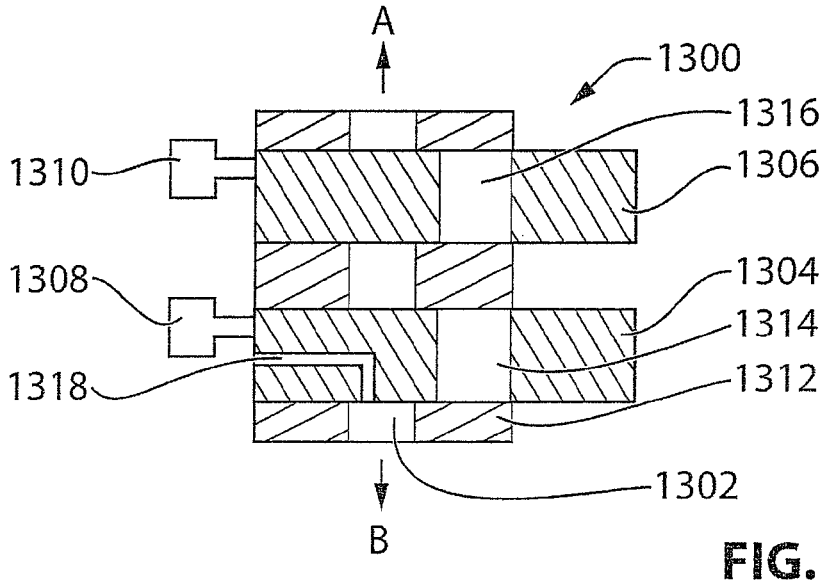
FIG. 22*b* shows a schematic view of the transfer valve shown in FIG. 22*a* in a "closed/venting" position.
Figure 22C:
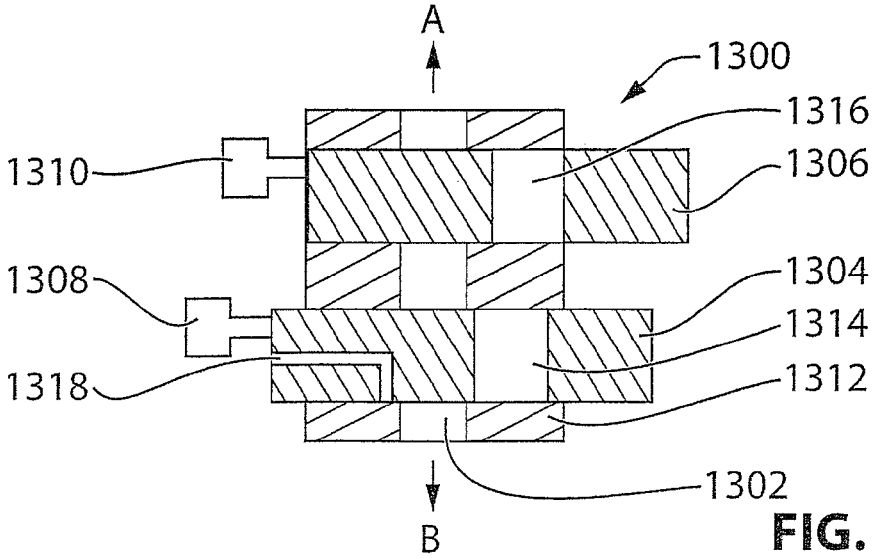
FIG. 22*c* shows a schematic view of the transfer valve shown in FIG. 22*a* in a closed position.

Turning now to FIG. 22*b*, the second closed/venting position is shown, wherein the slides are moved such that ports 1314, 1316 are moved out of alignment with the passageway 1302 of valve 1300 and passageway 1318 provided in slide 1304 moves into alignment with passageway 1302 of valve 1300 so as to allow for fluid communication between the tool and an external environment of valve 1300. This second closed/venting position, for example, allows for venting of air, water and exhaust gases from the tool when the valve is closed to the ignition tube by means of moving port 1316 of slide 1306 out of alignment with passageway 1302 of valve 1300.

Referring to FIG. 22*c*, the third closed position is shown. In this position, slide 1306 is moved such that port 1316 is moved out of alignment with passageway 1302, and slide 1304 is moved such that port 1314 is moved out of alignment with passageway 1302 and venting port 1318 is not yet moved into alignment with passageway 1302, i.e. both ports 1314, 1318 are out of alignment with passageway 1302. In the third closed position, ignition tube 1150 is isolated from the die cavity of tool 1190.

Referring back to FIG. 21, valve 1300 is shown in the first open position allowing for fluid communication between work piece 1404 in the die cavity of forming die 1190 and ignition tube 1150 as indicated by a continuous passageway 1420 between the ignition tube and the forming die. Wave breaker 1197 is in fluid communication with the forming die 1190. The wave breaker 1197 is provided to reduce the energy of the pressure wave generated by the ignition of combustive gases in the apparatus to form the work piece therein.

The wave breaker, which is provided along a propagation path of a pressure wave generated by an ignition of the combustibles in the ignition tube 1150, reduces the energy of the pressure wave and thus protects apparatus 1100 from high mechanical stresses and permanent damages. In addition, the reduction of the energy of the reflected pressure wave was found to increase the lifespan of the ignition tool and mechanism.

Nevertheless, it is advantageous to provide the wave breaker in an exchangeable manner so that it can be easily exchanged in case of material fatigue or degradation. The wave breaker can be made from steel and/or copper-beryllium (CuBe) since these materials are particularly suited for these kind of applications because of their toughness and simultaneous hardness.

As shown in FIG. 21, the wave breaker is provided on the side of the tool opposite to the ignition tube. Thus, the energy of the pressure wave is reduced once it has passed through the tool. In this manner the energy of the pressure wave can propagate well to the tool 1190. Alternatively, the wave breaker can also be provided on the side of the tool close to the ignition tube, i.e. between the ignition tube and the tool. In this manner, the energy of the reflected pressure wave can be reduced. However, the propagating pressure wave has still sufficient energy to form a blank in the tool.

The wave breaker can be provided within a tubular support. The tubular support can be made from a different material than the wave breaker.

Advantageously, the wave breaker is curve-shaped and/or has a smaller passage compared to the width of the ignition tube or the tubular support since such passage can significantly reduce the energy of the reflected pressure wave.

The wave breaker has one or more wave breaking elements, which reflect the pressure wave and thereby at least partially absorb the energy of the pressure wave. Non-limiting examples of elements suitable for use as wave breaking elements are octagonal-prismatic-shaped elements, hexagonal-prismatic-shaped elements, cube-shaped elements, walls arranged transversely to the propagation path of the pressure wave, L-shaped elements, curved elements, ball-shaped or tufted elements, or any combinations thereof.

Notably, the wave breaker includes at least one labyrinth element and/or several elements forming a labyrinth structure. Advantageously, the wave breaker includes a disk-like element with at least one opening therethrough, which offers a large collision surface while being relatively inexpensive. If desired, the openings of the wave breaking elements are arranged in a phase-shifted manner so that the pressure wave can be redirected multiple times, which is particularly advantageous in reducing the energy of the pressure wave.

The use of multiple wave breaking elements can reduce the impact of the reflected pressure wave on the internal space of the ignition tube or the tubular support and can distribute the reflected wave onto multiple elements. Advantageously, the wave breaker contains at least one one-way element so that the pressure wave can pass through the wave breaker while the reflected pressure wave is absorbed by the one-way element before it reaches the ignition tube.

The wave breaker can have one or more lateral branches so that the pressure wave can be broken apart at the location of the branch. Moreover, it is advantageous that the lateral branch is further ramified so as to create multiple ramifications to break up the pressure wave.

In accordance with an embodiment of the invention, at least one branch can form a fluid filling channel to provide a fluid to the tool via the wave breaker. For example, FIG. 21 shows the wave breaker 1197 in fluid communication with fluid filling system 1199.

A more detailed description of the wave breaker can be found in German Patent Application Serial No. 10 2008 006 979 entitled "Vorrichtung für das Explosionsumformen", filed on Jan. 31, 2008, the disclosure of which is incorporated herein by reference.

Fluid filling system 1199 has a ball-type check valve 426 between the wave breaker 1197 and the fluid reservoir. Fluid 1428, such as water or certain oils, is pumped into the internal space of work piece 1404 situated in forming die 1190. Fluid 1428 accumulates in work piece 1404 and forms a fluid surface 430. The remaining internal space is filled with combustive gases supplied via ignition tube 1150. The amount of combustive gas to fluid is chosen to be in a range from about 1:1 to about 1:20. The amount of fluid in work piece 1404 can be varied in accordance with predetermined optimum values for performing the method of the instant invention. A more detailed description of combustion forming with fluid filled blanks or work pieces is provided in German Patent Application DE 10 2007 007 330 entitled "Verfahren und Werkzeuganordnung zum Explosionsumformen" filed on Feb. 14, 2007, the disclosure of which is incorporated herein by reference.

The combustive gas mixture in the ignition tube 1150 and fluid-free space 432 of work piece 1404 is ignited by activating ignition system 1170. The resulting front of the pressure wave propagates from the ignition tube 1150 to the fluid-free space 432 of work piece 1404 and then meets the phase boundary, namely fluid surface 430. About 80% of the force of the pressure wave is transmitted to the fluid in this manner. The immediate contact between the combustive gas mixture and the fluid allows for a relatively good transfer of combustive forces. The pressure wave is then transmitted by the fluid and forces the work piece into conformity with the inner surface of the die cavity of the forming die.

Optionally, the work piece 1404 can be simultaneously formed and trimmed or pierced using the same force generated by combustion of the combustive gas mixture in the ignition tube. Advantageously, the quality of trimmed or pierced edges in the formed work pieces is improved using a pressure transfer from a gas phase to a fluid phase. Furthermore, the amount of combustive gas employed in each forming process can be reduced by filling at least at portion of the work piece with a fluid, such as water or certain oils to transmit the pressure wave from the gas phase to the liquid phase.

However, if desired, the combustive forming process in accordance with an embodiment of the invention can be performed solely in the gas phase. In this case, the combustive gas mixture is supplied from the fluid dosing system 130 to the ignition tube 1150 and from there via the opened transfer valve 180 to the work piece 1404 within the forming die 1190. The pressure wave generated by the ignition of the combustive gas mixture is transmitted through the gas phase and forces the work piece 1404 into conformity with the die cavity of the forming die 1190.

In the embodiment of FIG. 20, more than one ignition tube 1150 is illustrated, which are labeled ignition tube 1150*a* and 1150*b*. Ignition tube 1150*a* is positioned relative to the stationary die to be in selective fluid communication with the die cavity. Ignition tube 1150*a* is a hollow chamber having a predetermined interior volume. Preferably ignition tube 1150*a* is machined from hardened steel and has an ignition port 1141*a*, a plurality of inlet valves 1142*a*, 1144*a*, 1146*a*, 1148*a*, and an outlet transfer valve 1180*a*. Outlet transfer valve 1180*a* selectively couples fluid communication of the ignition tube 1150*a* with the die cavity.

Ignition port 1141*a* is operably connected to the ignition system 1170. Various methods for ignition have been disclosed in International Publication Nos. WO 2008/017332 and WO 2008/017444. Suitable ignition systems include laser, induction and electrical discharge.

Second ignition tube 1150*b* is also positioned relative to the stationary die to be in fluid communication with the die cavity. Ignition tube 1150*b* can either be in selective fluid communication with the same die cavity as ignition tube 1150*a* or with a second die cavity adjacent the first die cavity. However, second ignition tube 1150*b* is identical to ignition tube 1150*a*.

Ignition tubes 1150*a* and 1150*b* are in fluid communication with a dosing system 1130. Dosing system 1130 is in fluid communication with a fluid storage 1120. Dosing system 1130 receives fluids and delivers predetermined amounts of the fluid or charges to the ignition tubes 1150*a* and 1150*b*. Preferably, fluid storage 1120 are pressure tanks that are remote from the dosing system 1130. Dosing system 1130 is also in fluid communication with an exhaust system 1160.

A programmable logic control unit (PLC) 1110 is provided for processing a predetermined sequence program upon receiving input signals and outputting output signals as a result thereof so as to control operation of components of the system and thereby control the overall operation of apparatus 1100. A PLC is a digital computer used for automation of industrial processes. Unlike general purpose computers, the PLC is designed for multiple inputs and output arrangements, extended temperature ranges, immunity to electrical noise, and resistance to vibration and impact. A PLC is a real time system since output results must be produced in response to input conditions within a predetermined time limit.

The PLC 1110 controls the operation of the fluid storage 1120 from which the various fluids (gas and/or liquid) are supplied to the fluid dosing system 1130.

The dosing system 1130 is controlled by PLC 1110. The fluid dosing system 130 supplies the various fluids, such as hydrogen, oxygen, water, and other technical gases via the respective fluid lines 1142, 1144, 1146, 1148 to ignition tube 1150*a* via valves 1142*a*, 1144*a*, 1146*a*, and 1148*a* and/or to ignition tube 1150*b* via valves 1142*b*, 1144*b*, 1146, and 1148*b*. Any excess fluids are directed to exhaust system 1160. Dosing system 1130 can supply pure hydrogen or a mixture of hydrogen and oxygen or a mixture of other technical gases and liquids to fluid line 1148. Each of the valves 1142*a*, 1144*a*, 1146*a*, and 1148*a* and 1142*b*, 1144*b*, 1146, and 1148*b* are independently controlled by PLC 1110.

In a preferred mode of operation, fluid line 1146 is supplied with pure oxygen and fluid line 1148 is supplied with pure hydrogen. Fluid line 1146 may also be supplied with a mixture of hydrogen and oxygen or a mixture of other technical gases and liquids by dosing system 1130.

Fluid line 1144 is supplied with water or a mixture of hydrogen and oxygen or of other technical gases or liquids. In a preferred mode of operation, fluid line 1144 is supplied with water. Advantageously, a small amount of water is supplied to the ignition system so as to protect the valve(s).

Fluid line 1142 is used as a purge or exhaust line. For example, in an emergency where there are difficulties with the ignition of the combustive mixture, the purge or exhaust line is used to dilute the combustive mixture to a substantially non-combustive mixture so that it can be safely vented without causing any hazardous situations. For this purpose, an excess of pure nitrogen is supplied to the purge/exhaust line 1142 to dilute the combustive mixture, so that the resulting mixture contains approximately 97% nitrogen and 3% combustibles.

In accordance with an embodiment of the invention, the combustive mixture used in the ignition tube 1150 is an oxyhydrogen mixture. The oxyhydrogen mixture can be composed of a hydrogen ($H_2$)—oxygen ($O_2$)—mixture or of a hydrogen ($H_2$)—air mixture. In other embodiments of the invention and in dependence upon a particular application, other gases, such as nitrogen, can be added to the gas mixture. Advantageously, the combustive oxyhydrogen mixture provided in the ignition tubes 1150 is a stoichiometric mixture having a slight excess of oxygen. In this case, the amount of hydrogen can be chosen to be between about 4 to 76%. Alternatively, other combustive gas mixtures can be employed as well.

In response to a signal from PLC 1110, the respective fluids are provided to the ignition tubes 1150*a* and/or 1150*b* to form a combustive mixture which is ignited by ignition system 1170. The ignition tubes 1150*a* and 1150*b* are in fluid communication with the tool/die 1190 by means of transfer valves 1180*a* and 1180*b*, respectively. In an operative mode controlled by PLC 1110, valves 1180*a* and 1180*b* are opened, the combustive mixture in ignition tubes 1150*a* and 1150*b* is ignited by ignition system 1170 and the resulting pressure wave front is used to form a work piece (not shown) in tool 1190. Tool 1190 is designed such that it can be used to form, trim and/or pierce tubular and/or sheet parts.

The tool 1190 is positioned in clamping device 1192. Raw blanks or work pieces are transported into the tool 1190 via robotic part handler 1194 in response to a signal from PLC 1110. Once the work piece is formed, the formed part is transported away from the tool 1190 via robotic part handler 1196 in response to a signal from PLC 1110. A scrap remover 1198 is positioned to receive any scrap parts from the tool 1190.

Fluid filling system 1199 provides a fluid, such as water or certain oils, to fill the work piece inside the tool 1190. The fluid is used to more effectively transmit the forces of the pressure wave generated by the ignition of the combustive gas mixture.

Transfer valves 11180*a* and 1180*b* are provided to separate ignition tubes 1150*a* and 1150*b*, respectively, from the tool 1190. Valves 1180*a* and 1180*b* form a barrier between the environment and the atmospheres in the tool 1190 and the ignition tubes 1150.

In a first mode of operation, valves 1180*a* and 1180*b* are closed and the ignition tubes 1150*a* and 1150*b* are loaded with a combustive mixture via fluid lines 1144, 1146, 1148. The ignition tubes 1150 are hermetically sealed and separated from the die cavity of the tool 1190. Thus, the tool 1190 can be opened and loaded with a raw blank or work piece and a formed work piece can be removed from the tool while the ignition tubes are being exhausted and charged with a combustive mixture. Immediately after a work piece is formed in the tool 1190, the transfer valves 1180 are closed so as to separate or isolate the ignition tubes 1150 from the tool 1190 and the tool 1190 can be opened to remove the formed work piece.

In a second mode of operation, the tool 1190 is closed, the transfer valves 1180 are opened, and the combustive mixture in the ignition tubes 1150 is ignited by the ignition system 1170 and the resulting pressure wave is communicated through the transfer valves 1180 into the tool 1190 so as to form the work piece therein.

Thus, the instant invention provides a method and an apparatus that allows the exchange of the work pieces in the tool and exhaustion and charging of the ignition tubes at about the same time. This reduces the cycle time of the process. For example, the cycle time can be reduced by approximately 50% from about 20 seconds to about 8-10 seconds in accordance with the instant invention.

FIGS. 23*a*-23*e* show schematic views to illustrate the combustive forming process utilizing a flat blank rather than a hollow blank in accordance with an embodiment of the invention. For simplicity reasons, the schematic views only depict apparatus 1200 including a tool 1210, an ignition tube 1220, and a transfer valve 1230 to separate the tool from the ignition tube. The fluid lines, the fluid storage and dosing system, as well as the PLC and other components are not shown.

Figure 23A:
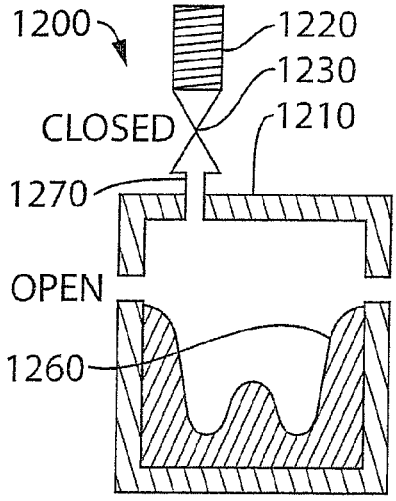
FIGS. 23*a*-23*e* show simplified schematic views to illustrate the combustion forming process of sheet raw blanks using an apparatus including a tool or forming die, an ignition tube, and a transfer valve to separate the tool from the ignition tube, in accordance with yet other embodiments of the present invention.

FIG. 23*a* shows apparatus 1200 in a first mode of operation. The tool 1210 is in an open position and transfer valve 1230 is in a closed position. Since ignition tube 1220 is separated from tool 1210 by valve 1230, the process of filling the ignition tube 1220 with a combustive mixture can be started.

Figure 23B:
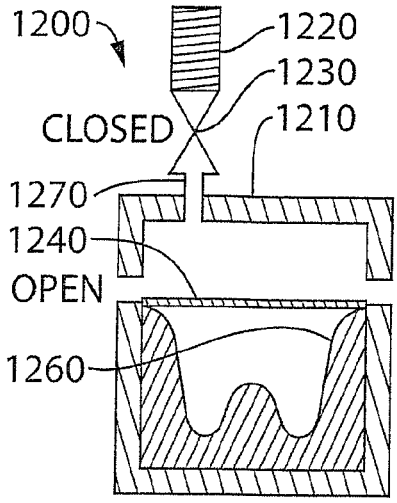

FIG. 23*b* shows a work piece 1240 being inserted into open tool 1210 while the transfer valve 1230 is still closed.

Figure 23C:
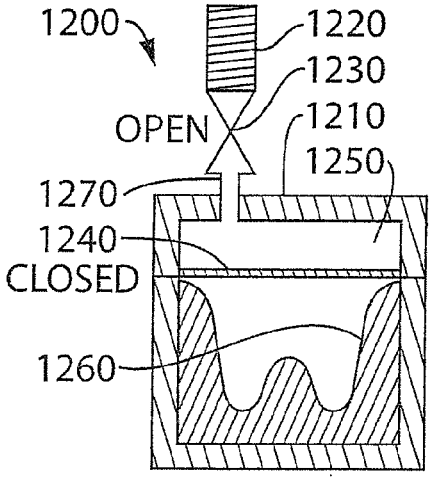

FIG. 23*c* shows apparatus 1200 in a second mode of operation. Tool 1210 is closed and transfer valve 1230 is opened to allow the combustive mixture to communicate with the die cavity 1250 and core 1260 of tool 1210 via transfer valve 1230 and passageway 1270 of mold 1210.

Figure 23D:
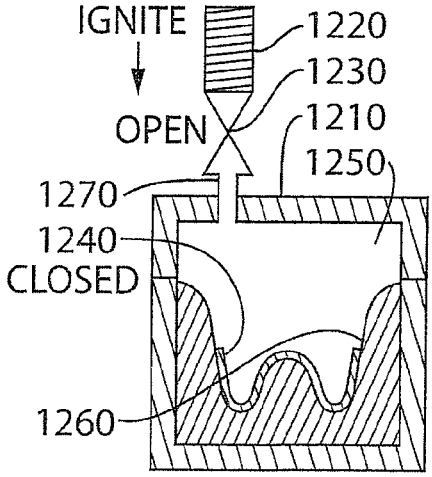

FIG. 23*d* depicts the forming process. The combustive mixture is ignited by the ignition system (not shown) while the tool 1210 is closed and transfer valve 1230 is open. Work piece 1240 is pressed against the surface of core 1260 by means of the pressure wave generated as a result of igniting the combustive mixture in the tool. After work piece 1240 is formed, transfer valve 1230 is closed to separate tool 1210 from ignition tube 1220.

Figure 23E:
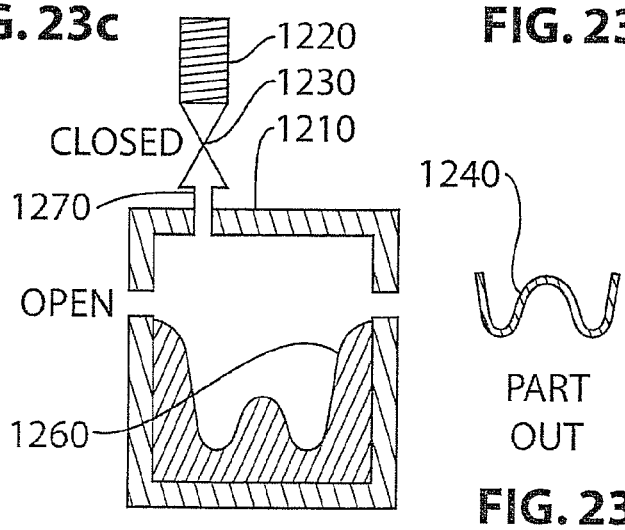

As can be seen from FIG. 23*e*, tool 1210 can be opened to remove the formed work piece 1240 from the tool while the ignition tube is vented and refilled with a combustive mixture for the forming step of the next work piece transported into tool 1210.

Vent openings (not shown) are provided in tool 1210 so that the work piece can be pressed more closely against the cavity during the forming step. These openings are preferably slit-like openings arranged longitudinally along the tool outline. In this manner, the air that is formed in the tool cavity can escape and hence does not interfere with the expansion of the work piece. The openings have an inner width that is approximately the same or smaller than the wall thickness of the tool so that the work piece is not pressed into the vent openings.

Figure 24:
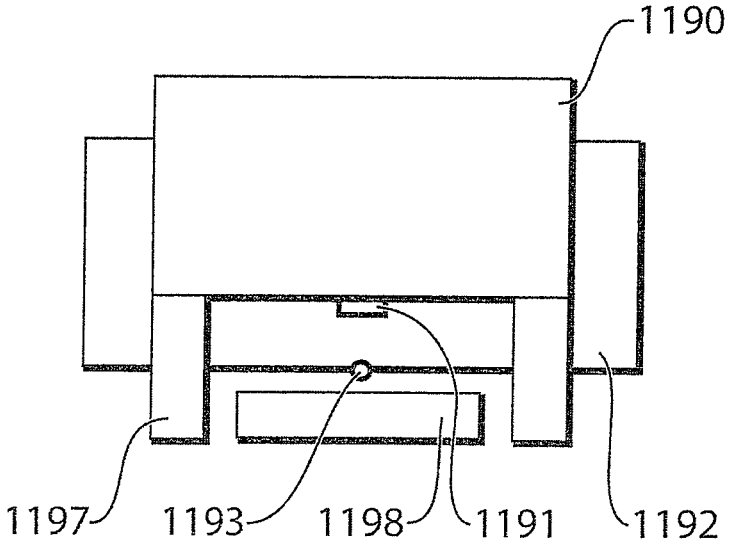
FIG. 24 shows a more detailed schematic view of the die press on which the die shown in FIGS. 23*a*-23*e* is mounted to ejection scrap material from the die to a scrap remover.

In accordance with another embodiment of the invention, the tool 1190 is further provided with at least one piercing and/or cutting die so that the work piece can be provided with punch holes and/or cut to desired length while it is undergoing a combustive forming process. FIG. 24 shows a more detailed schematic view of scrap remover 1198 and die press 1192 on which tool 1190 is mounted. As can be seen from FIG. 24, the piercing dies of tool 1190 have an ejection opening 1191 at their base to eject scrap material 1193, such as material being punched out by the piercing dies or cut by the cutting dies, into scrap remover 1198. In accordance with this embodiment of the invention, the pressure wave generated in the tool is further utilized to pierce and/or cut the work piece and to eject the scrap part through the ejection openings at the bottom of the tool.

Alternatively, the tool can be designed as a two-part tool wherein a first tool portion is employed for the combustive forming process and a second tool portion is used to trim, punch, or pierce the work piece after it has been formed. In accordance with this embodiment, the work piece is transported from the first tool portion to the second tool portion after the combustive forming step is completed. The first tool portion is re-loaded with a new work piece while the formed work piece is removed from the tool so that the next pressure wave is utilized to form the new work piece and trim, pierce, and/or punch the already formed work piece in the second tool portion.

The process of the present invention involves a plurality of steps. In a first step, the work piece is transported into the forming tool where a combustive forming takes place by means of a pressure wave generated by the discharge of a combustive mixture. The work piece is then transported from the forming tool to a piercing or punching tool. The piercing or punching step is also performed by means of a pressure wave generated by the discharge of a combustive mixture. Finally, the work piece is transported from the piercing or punching tool to a trimming or cutting tool where the work piece is trimmed to a predetermined dimension. The energy for the trimming or cutting step is also generated by the discharge of a combustive mixture generating a pressure wave. Each tool has its designated ignition tube and in accordance with the instant invention, the ignition tubes for each of the tools are separated from their respective tool by means of a valve so that the tool can be opened and unloaded and/or reloaded while the ignition tube is being vented and refilled with a combustive mixture for the next discharge cycle to generate the respective energy by means of a pressure wave for the forming step, the piercing or punching step, and the trimming or cutting step.

One or more ignition tubes 1150 are provided to be in fluid communication with a forming die 1190. In this context, reference is made to FIG. 20 showing two ignition tubes 1150*a* and 1150*b* at each end of forming die 1190. This is particularly advantageous for the combustive forming of more complex shapes. For example, in the case of a U-shaped work piece, one ignition tube can be provided at each end of the U-shaped work piece. In this manner, the combustive forming process can be more evenly performed as the combustive gas mixture is more evenly distributed in the work piece(s) within the forming die. Furthermore, in some complex shapes it might be difficult for the combustive gas mixture to reach particular areas within the work piece in the forming die and hence, the provision of one or more additional ignition tubes is advantageous.

Alternatively, the process comprises the combustive forming of a work piece is performed in a first step, and the trimming and the piercing of the work piece are performed in a second and/or third step. This requires the provision of one or more ignition tubes for each step of the process. The work piece is then moved from a first forming die in fluid communication with a first ignition tube to a trimming and/or piercing die which is in fluid communication with a second ignition tube.

Furthermore, at least two forming dies may be provided in an apparatus of the present invention, each forming die having one or more ignition tubes. In this manner, it is possible to fill the one or more ignition tubes of the one forming die with a combustive gas mixture while a combustive gas mixture in the one or more ignition tubes of the other forming die is being ignited, thus allowing more work pieces to be combustively formed in the same amount of time.

The ignition tube or tubes may also be provided with a cooling system which is operated in a closed-loop manner.

Another advantage in accordance with the instant invention results from the fact that the purge/exhaust lines are not running through the tool anymore. Once the transfer valve which separates the ignition tube(s) from the forming die is closed, the tool can be opened and the ignition tube(s) can be purged. This also brings about certain safety aspects, as it is now possible to vent the ignition tube(s) separately in case of a malfunctioning ignition or other problems with the system. By separating the tool from the ignition tube(s) and/or system, the combustive gas mixture can be restricted to a smaller volume.

It is optionally possible for the valve 1300 to be used in the apparatus 10 (FIG. 1) instead of the valve 58.

While the above description constitutes a plurality of embodiments of the present invention, it will be appreciated that the present invention is susceptible to further modification and change without departing from the fair meaning of the accompanying claims.

The invention claimed is:

1. An apparatus for modifying a work piece having a longitudinal length, the apparatus comprising:

an ignition chamber configured for generating a traveling shock wave that has a shock wave length that is less than the longitudinal length of the work piece;

a die, wherein the die includes a first die plate and a second die plate, wherein at least one of the first and second die plates is movable relative to the other between an open position and a closed position wherein the first and second die plates together define a die cavity in which the work piece can be positioned;

a transfer structure configured, in use, to convey the shock wave directly from the ignition chamber directly into the die cavity, wherein, in operation, the shock wave applies a localized pressure to the work piece in a direction that is transverse to the direction of travel of the shock wave, wherein the ignition chamber has at least one inlet for the ingress of oxygen and hydrogen combustibles, the apparatus further comprising an igniter and a controller for the transfer of a selected ratio and quantity of oxygen and hydrogen into the ignition chamber and for actuating the igniter to react the combustibles to generate an explosion that generates the shock wave, wherein the controller serially executes explosions and the apparatus further comprising a cooling system for cooling the ignition chamber so as to reduce the pressure of water vapour created by reacting oxygen and hydrogen.

2. An apparatus as claimed in claim 1, wherein the ignition chamber and the transfer structure together define a pre-work piece shock wave flow conduit that has a cross-sectional size and a cross-sectional shape that are substantially constant and substantially free of reflection elements.

3. An apparatus as claimed in claim 2, wherein the cross-sectional shape is circular.

4. An apparatus as claimed in claim 1, wherein the ignition chamber has at least one inlet for the ingress of oxygen and hydrogen combustibles, the apparatus further comprising an igniter and a controller for the transfer of a selected ratio and quantity of oxygen and hydrogen into the ignition chamber and for actuating the igniter to react the combustibles to generate an explosion that generates the shock wave.

5. An apparatus as claimed in claim 4, wherein the controller serially executes explosions and the apparatus further comprises a cooling system for cooling the ignition chamber so as to reduce the pressure of water vapour created by reacting oxygen and hydrogen.

6. An apparatus as claimed in claim 1, wherein the ignition chamber is generally cylindrical and has an ignition chamber interior that has at least a selected ratio of length to diameter.

7. An apparatus as claimed in claim 1 further comprising an incompressible fluid inlet positioned to permit, in use, he passage of incompressible fluid from an incompressible fluid source into a work piece when the work piece is in the die cavity.

8. An apparatus as claimed in claim 7, further comprising a controller configured to permit, prior to the generation of the shock wave, a flow of incompressible fluid into the die cavity to a selected fill level such that the work piece is substantially filled with incompressible fluid, and wherein the ignition chamber and the transfer structure together define a pre-work piece shock wave flow conduit that is configured to transfer the shock wave into the incompressible fluid.

9. An apparatus as claimed in claim 8, wherein the selected fill level is such that the transfer structure is substantially filled with incompressible fluid.

10. An apparatus as claimed in claim 9, wherein the selected fill level is such that part of the ignition chamber is filled with incompressible fluid.

11. An apparatus as claimed in claim 1, wherein the transfer structure includes an isolation valve positionable in an open position wherein, in use, the ignition chamber is fluidly connected to the work piece, and a closed position wherein, in use, the ignition chamber is isolated from the work piece.

12. An apparatus as claimed in claim 1, wherein the die cavity is defined by a die cavity wall having at least one punch aperture therein so that, in use, the shock wave punches a hole through the work piece into the die cavity aperture.

13. An apparatus as claimed in claim 1, wherein the die cavity is defined by a die cavity wall having at least one trim aperture that extends all the way around the die cavity, and that is positioned so that, in use, the shock wave trims an end portion from the work piece at the trim aperture.

14. An apparatus as claimed in claim 1, further comprising a pressure reducer configured to reduce the pressure associated with the shock wave, wherein the pressure reducer is positioned downstream from the die.

15. An apparatus as claimed in claim 14, wherein the pressure reducer includes a plurality of shock wave reduction elements that are positioned to impinge on a shock wave traveling therepast.

* * * * *